US009320942B2

(12) United States Patent
Maxwell et al.

(10) Patent No.: US 9,320,942 B2
(45) Date of Patent: Apr. 26, 2016

(54) GOLF BALL WITH COVER LAYER HAVING ZONES OF DIFFERING MATERIALS

(75) Inventors: Kerby LaVar Maxwell, Portland, OR (US); Yasushi Ichikawa, Tualatin, OR (US); Chia-Chyi Cheng, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1127 days.

(21) Appl. No.: 13/337,989

(22) Filed: Dec. 27, 2011

(65) Prior Publication Data

US 2012/0165129 A1 Jun. 28, 2012

Related U.S. Application Data

(63) Continuation-in-part of application No. 13/004,829, filed on Jan. 11, 2011, which is a continuation of application No. 12/690,761, filed on Jan. 20, 2010, now Pat. No. 8,556,750.

(51) Int. Cl.
*A63B 37/06* (2006.01)
*A63B 37/00* (2006.01)
(Continued)

(52) U.S. Cl.
CPC ..... *A63B 37/0004* (2013.01); *A63B 37/0006* (2013.01); *A63B 37/008* (2013.01); *A63B 37/0009* (2013.01); *A63B 37/0011* (2013.01); *A63B 37/0012* (2013.01); *A63B 37/0013* (2013.01); *A63B 37/0022* (2013.01); *A63B 37/0024* (2013.01); *A63B 37/0045* (2013.01);
(Continued)

(58) Field of Classification Search
CPC ..... A63B 37/0004; A63B 37/12
USPC ..... 473/378, 384, 385
See application file for complete search history.

(56) References Cited

U.S. PATENT DOCUMENTS 1,482,232 A 1/1924 Hazeltine
1,855,448 A 4/1932 Hazeltine
(Continued)

FOREIGN PATENT DOCUMENTS

CA 2728070 3/2011
CA 2728070 6/2012
(Continued)

OTHER PUBLICATIONS

JPO Office Action from corresponding Japanese Patent Application 2011-005928.
(Continued)

*Primary Examiner* — Raeann Gorden
(74) *Attorney, Agent, or Firm* — Honigman Miller Schwartz & Cohn LLP

(57) ABSTRACT

Generally disclosed is a golf ball having a core and a cover layer. The cover layer includes areas that are hard corresponding to the dimples, and areas that are soft corresponding to the land between the dimples. The cover layer may comprise two different materials, such as polyurethane and ionomer, that are laterally adjacent to each other in the cover layer. Alternatively, the cover layer may be selectively coated with a coating material having a different hardness, such as polyurethane or ionomer. As a result of the arrangement of the hard dimples and the soft land, the golf ball achieves reduced spin, and greater distances, when struck with a larger force (such as during a dive) while also achieving increased spin, and better control, when struck with a smaller force (such as during a chip).

17 Claims, 32 Drawing Sheets

(51) Int. Cl.
*A63B 37/12* (2006.01)
*A63B 45/00* (2006.01)

(52) U.S. Cl.
CPC ..... *A63B 37/0076* (2013.01); *A63B 37/0083* (2013.01); *A63B 37/0092* (2013.01); *A63B 37/12* (2013.01); *A63B 45/00* (2013.01)

(56) References Cited

U.S. PATENT DOCUMENTS

| | | | | |
|---|---|---|---|---|
| 2,861,810 | A * | 11/1958 | Veatch | 473/353 |
| 3,031,194 | A | 4/1962 | Strayer | |
| 4,235,441 | A | 11/1980 | Ciccarello | |
| 4,660,830 | A | 4/1987 | Tomar | |
| 4,863,167 | A | 9/1989 | Matsuki et al. | |
| 5,651,741 | A | 7/1997 | Masutani et al. | |
| 5,783,293 | A | 7/1998 | Lammi | |
| 5,827,567 | A | 10/1998 | Molitor | |
| 5,873,796 | A | 2/1999 | Cavallaro et al. | |
| 5,984,806 | A | 11/1999 | Sullivan et al. | |
| 5,994,472 | A | 11/1999 | Egashira et al. | |
| 6,010,442 | A | 1/2000 | Lemons et al. | |
| 6,012,992 | A * | 1/2000 | Yavitz | 473/378 |
| 6,103,166 | A | 8/2000 | Boehm et al. | |
| 6,193,617 | B1 | 2/2001 | Mertens | |
| 6,218,453 | B1 | 4/2001 | Boehm et al. | |
| 6,342,019 | B1 | 1/2002 | Boehm et al. | |
| 6,383,091 | B1 | 5/2002 | Maruko et al. | |
| 6,392,002 | B1 | 5/2002 | Wu | |
| 6,398,667 | B1 | 6/2002 | Lemons | |
| 6,422,954 | B1 | 7/2002 | Dewanjee | |
| 6,433,094 | B1 | 8/2002 | Nesbitt et al. | |
| 6,454,666 | B1 | 9/2002 | Shira | |
| 6,464,600 | B2 | 10/2002 | Takemura et al. | |
| 6,575,847 | B1 | 6/2003 | Yamagishi et al. | |
| 6,585,607 | B2 | 7/2003 | Tzivanis et al. | |
| 6,648,776 | B1 | 11/2003 | Boehm et al. | |
| 6,648,778 | B2 | 11/2003 | Sullivan et al. | |
| 6,699,143 | B2 | 3/2004 | Nardacci et al. | |
| 6,743,123 | B2 | 6/2004 | Sullivan | |
| 6,802,787 | B2 | 10/2004 | Ogg | |
| 6,827,657 | B2 | 12/2004 | Sullivan et al. | |
| 6,832,963 | B2 | 12/2004 | Sullivan et al. | |
| 6,835,793 | B2 | 12/2004 | Yokota et al. | |
| 7,022,034 | B2 | 4/2006 | Sullivan et al. | |
| 7,041,011 | B2 | 5/2006 | Sullivan et al. | |
| 7,048,656 | B2 | 5/2006 | Litchfield | |
| 7,125,345 | B2 | 10/2006 | Sullivan et al. | |
| 7,134,974 | B2 * | 11/2006 | Shannon et al. | 473/378 |
| 7,160,209 | B2 | 1/2007 | Marotta et al. | |
| 7,195,564 | B2 | 3/2007 | Han | |
| 7,255,655 | B2 | 8/2007 | Gojny | |
| 7,278,930 | B2 | 10/2007 | Yokota et al. | |
| 7,278,931 | B2 | 10/2007 | Manami et al. | |
| 7,429,220 | B2 | 9/2008 | Kuntimaddi et al. | |
| 7,470,203 | B1 | 12/2008 | Stillinger | |
| 7,601,080 | B2 | 10/2009 | Olson et al. | |
| 7,926,645 | B2 | 4/2011 | Contoli et al. | |
| 8,529,375 | B2 * | 9/2013 | Ichikawa | 473/378 |
| 8,556,750 | B2 * | 10/2013 | Ichikawa et al. | 473/378 |
| 2001/0019969 | A1 | 9/2001 | Binette et al. | |
| 2002/0019269 | A1 | 2/2002 | Watanabe | |
| 2004/0132552 | A1 | 7/2004 | Chen | |
| 2008/0064527 | A1 | 3/2008 | Wu et al. | |
| 2008/0081710 | A1 | 4/2008 | Chen et al. | |
| 2008/0251400 | A1 | 10/2008 | Ulrich | |
| 2009/0017941 | A1 | 1/2009 | Sullivan et al. | |
| 2009/0205931 | A1 | 8/2009 | Contoli et al. | |
| 2011/0177884 | A1 | 7/2011 | Ichikawa et al. | |
| 2011/0177887 | A1 | 7/2011 | Ichikawa et al. | |
| 2011/0177890 | A1 | 7/2011 | Tutmark | |

FOREIGN PATENT DOCUMENTS

| | | | |
|---|---|---|---|
| CA | 2775128 | | 5/2013 |
| CN | 101002986 | A | 7/2007 |
| CN | ZL201120022039.5 | | 1/2011 |
| CN | 201988125 | | 9/2011 |
| CN | ZL201120021903 | | 2/2012 |
| CN | ZL201120237927.9 | | 5/2012 |
| CN | ZL201110025876.8 | | 2/2013 |
| EP | 0476147 | | 3/1992 |
| EP | 2347799 | | 1/2013 |
| JP | 6034469 | A | 2/1985 |
| JP | 60-171459 | | 11/1985 |
| JP | 6277312 | | 10/1994 |
| JP | 09-028832 | | 2/1997 |
| JP | 09182814 | | 7/1997 |
| JP | 2002000765 | | 1/2002 |
| JP | 2002224241 | | 8/2002 |
| JP | 2002-369896 | A | 12/2002 |
| JP | 2004-147836 | A | 5/2004 |
| JP | 2008155013 | | 7/2008 |
| JP | 05-111550 | B2 | 1/2013 |
| KR | 1087414 | | 11/2011 |
| TW | I303180 | | 11/2008 |
| WO | 9843711 | | 10/1998 |
| WO | 2008118629 | | 10/2008 |

OTHER PUBLICATIONS

Response to Final Office Action mailed Mar. 26, 2013 for U.S. Appl. No. 12/690,761, filed May 21, 2013.
Response to Non-Final Office Action mailed Jan. 7, 2013 for U.S. Appl. No. 12/831,940, filed Jun. 7, 2013.
Response to Final Office Action mailed Feb. 20, 2013 for U.S. Appl. No. 12/690,881, filed May 20, 2013.
Notice of Allowance mailed May 31, 2013 for U.S. Appl. No. 12/690,881.
Response to Office Action mailed Dec. 13, 2012 for Chinese Invention Patent Application No. 201110025891.2 as filed on Apr. 22, 2013 and the English translation thereof.
Response to Office Action mailed Feb. 19, 2013 for Japanese Patent Application No. 2011-003995 as filed on May 13, 2013 and the English translation thereof.
Initiative Amendment as filed on May 7, 2013 for Chinese Invention Patent Application No. 201210375510.8.
Response to Office Action mailed Feb. 19, 2013 for Japanese Patent Application No. 2011-005928 as filed on May 14, 2013 and the English translation thereof.
Notification of Grant of Patent Right for Invention for Chinese Invention Patent Application No. 201110025891.2 mailed on Jun. 4, 2013.
Final Office Action for U.S. Appl. No. 12/690,761 mailed Mar. 26, 2013.
Final Office Action for U.S. Appl. No. 12/690,881 mailed Feb. 20, 2013.
Final Office Action for U.S. Appl. No. 13/004,829 mailed Mar. 26, 2013.
Office Action for U.S. Appl. No. 12/831,940, mailed on May 10, 2012.
Office Action for Japanese Patent Application No. 2011-003995 mailed on Feb. 19, 2013.
Office Action for Japanese Patent Application No. 2011-005928 mailed on Feb. 19, 2013.
International Search Report and Written Opinion for PCT/US2011/020996, mailed Jul. 4, 2011.
Extended European Search Report dated Jul. 4, 2011 in European Application No. 11151551.6.
Extended European Search Report dated Jan. 3, 2012 in European Patent Application No. EP11172727.7.
Official Letter and Search Report mailed Apr. 19, 2013 for Taiwan Patent Application No. 99145844 and the English translation thereof.
Official Letter and Search Report mailed Apr. 29, 2013 for Taiwan Patent Application No. 100101631 and the English translation thereof.
European Search Report for European Patent Application No. EP12001388.3, mailed on Jul. 3, 2012.

(56) References Cited

OTHER PUBLICATIONS

Notice of Allowance for Canadian Patent Application No. 2728070, mailed on Nov. 3, 2011.
Communication under Rule 71(3) EPC for European Patent Application No. 12001388.3, mailed on Jan. 4, 2013.
Office Action for Korean Patent Application No. 10-2011-0005899, mailed on Apr. 25, 2011.
Notice of Decision for Patent for Korean Patent Application No. 10-2011-0005899, mailed on Aug. 23, 2011.
Notification of First Office Action for Chinese Invention Patent Application No. 201110025891.2, issued on Dec. 13, 2012.
Notification of Grant of Patent Right for Utility Model for Chinese Utility Model Patent Application No. 201120022039.5, issued on May 19, 2011.
Office Action for U.S. Appl. No. 12/831,940, mailed on Jan. 7, 2013.
Notification of Grant of Patent Right for Utility Model for Chinese Utility Model Patent Application No. 201120237927.9, issued on Jan. 20, 2012.
Communication under Rule 71(3) EPC for European Patent Application No. 11172727.7, mailed on Jan. 17, 2013.
Extended European Search Report for European Patent Application No. 12001388.3, issued on Jul. 3, 2012.
Notification of Grant of Patent Right for Invention issued Oct. 24, 2012 in Chinese Patent Application No. 201110025876.8.
Notification of Grant of Patent Right for Utility Model issued Dec. 23, 2011 in Chinese Patent Application No. 201120021903.X.
Communication under Rule 71(3) EPC mailed May 22, 2012 for European Patent Application No. 11 151 551.6.
Notification of Allowance mailed Oct. 2, 2012 for Canadian Patent Application No. 2,775,128.
Office Action in Utility U.S. Appl. No. 12/690,881, mailed on Nov. 2, 2012.
Office Action in Canadian Patent Application No. 2,728,070, mailed on May 12, 2011.
Notification of First Office Action in Chinese Invention Patent Application No. 201110025876.8, issued on May 2, 2012.
Notification of First Office Action in Chinese Utility Model Patent Application No. 201120021903.X, issued on Jun. 17, 2011.
Notification of Second Office Action in Chinese Utility Model Patent Application No. 201120021903.X, issued on Sep. 6, 2011.
Result of Consultation in European Patent Application No. EP11 151 551.6, mailed on May 10, 2012.
Extended European Search Report in European Patent Application No. EP11 150 779.4, mailed on May 3, 2011.
Communication under Rule 71(3) EPC for European Patent Application No. EP11 150 779.4, mailed Jul. 16, 2012.
Office Action in Utility U.S. Appl. No. 12/690,761, mailed on Dec. 18, 2012.
Office Action in Utility U.S. Appl. No. 13/004,829, mailed on Sep. 17, 2012.

* cited by examiner

GOLF BALL WITH COVER LAYER HAVING ZONES OF DIFFERING MATERIALS

CROSS-REFERENCE TO RELATED APPLICATIONS

This application is a Continuation-in-Part of co-pending application Ser. No. 13/004,829 filed Jan. 11, 2011, the disclosure of which is hereby incorporated by reference.

This application is a Continuation-in-Part of co-pending application Ser. No. 12/690,761 filed Jan. 20, 2010, the disclosure of which is hereby incorporated by reference.

BACKGROUND

The present invention relates generally to a golf ball, and a method of manufacturing the golf ball. In particular, a cover layer on the golf ball includes areas having a higher hardness and areas having a lower hardness.

The game of golf is an increasingly popular sport at both the amateur and professional levels. A wide range of technologies related to the manufacture and design of golf balls are known in the art. Such technologies have resulted in golf balls with a variety of play characteristics. For example, different golf balls are manufactured and marketed to players having different golfing abilities, such as different swing speeds.

Similarly, a golfer may use different golf balls having different play characteristics depending on the golfer's preferences. For example, different dimple patterns may affect the aerodynamic properties of the golf ball during flight, or a difference in the hardness of the cover layer may affect the rate of backspin. With regard to hardness in particular, a golfer may choose to use a golf ball having a cover layer and/or a core that is harder or softer. A golf ball with a harder cover layer will generally achieve reduced driver spin, and achieve greater distances. However, a harder cover layer will generally cause a lower rate of spin, such that the golf ball will be better for drives but more difficult to control on shorter shots. On the other hand, a golf ball with a softer cover will generally experience more spin and therefore be easier to control and stop on the green, but will lack distance off the tee.

A wide range of golf balls having a variety of hardness characteristics are known in the art. Generally, the hardness of a golf ball is determined by the chemical composition and physical arrangement of the various layers making up the golf ball. Accordingly, a number of different golf ball materials are mixed and matched in various combinations and arrangements to create golf balls having different hardness values and different hardness profiles.

However, designing golf balls to achieve desired hardness characteristics suffers from at least several difficulties. Generally, the construction of known golf balls requires that a wide range of design variables such as layer arrangement, materials used in each layer, and layer thickness be balanced against each other. Changes to any of these variables may therefore improve a desired hardness only at the expense of other play characteristics. Additionally, materials costs and design costs associated with known golf ball constructions may unduly increase the cost of the golf ball to the end consumer. Perhaps most importantly, known golf balls generally cannot simultaneously achieve the advantageous play characteristics associated with high cover hardness (greater distances) while also achieving the advantageous play characteristics associated with low cover hardness (greater spin).

Therefore, there is a need in the art for a system and method that addresses the shortcomings of the prior art discussed above.

SUMMARY

Generally, this disclosure provides golf balls having a cover layer where certain portions of the cover layer are made from an ionomer material, and other portions of the cover layer are made from a polyurethane material. The different materials may have different physical properties, such as hardness or compressibility, that result in the golf ball exhibiting various play characteristics.

In one aspect, this disclosure provides a golf ball comprising: a core; and a cover layer, the cover layer substantially surrounding the core and including a plurality of dimples and at least one land area separating the dimples; wherein the cover layer includes a first portion, the first portion of the cover layer having a first hardness, and a second portion, the second portion of the cover layer having a second hardness; the first portion and the second portion being laterally adjacent to each other within the cover layer; the first portion comprising a polyurethane material; the second portion comprising a ionomer material; and the first hardness is different from the second hardness.

In another aspect, this disclosure provides a golf ball comprising: a core; and a cover layer substantially surrounding the core, the cover layer being formed of a first material having a first hardness, and the cover layer having a plurality of dimples and at least one land area thereon; the plurality of dimples being arranged on the cover layer in a first pattern; the at least one land area being arranged on the cover layer in a second pattern, the first pattern and the second pattern being non-overlapping patterns; wherein the cover layer is coated with a second material, the second material having a second hardness, such that the coating material overlaps at least a portion of one of the first pattern and the second pattern but substantially does not overlap the other of the first pattern and the second pattern; the second hardness is different from the first hardness; the first material comprises a material that is selected from the group consisting of: an ionomer material, and a polyurethane material; the second material comprises a material that is selected from the group consisting of: an ionomer material, and a polyurethane material; and the second material is different from the first material.

In yet another aspect, this disclosure provides a golf ball comprising: a core; a cover layer substantially surrounding the core; the cover layer being formed of a cover material; the cover material comprising a material that is selected from the group consisting of: an ionomer material, and a polyurethane material; the cover material having a first hardness and a first compressibility; the cover layer including one or more grooves extending radially inward from an outer surface of the cover layer; and a groove material disposed within the one or more grooves; the groove material having a second hardness and a second compressibility; wherein the groove material comprises a material that is selected from the group consisting of: an ionomer material, and a polyurethane material; the groove material being different from the cover material; the first hardness being different from the second hardness, and the first compressibility is different from the second compressibility.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Generally, the present disclosure relates to a golf ball having areas on the cover layer that are relatively hard and areas on the cover layer that are relatively soft. The hard areas may be made of a ionomer material, and the soft areas may be made of a polyurethane material.

The relatively hard areas may correspond to at least some of the dimples in the cover layer, and the relatively soft areas may correspond to at least part of at least one land area between the dimples. Alternatively, the hard areas (or soft areas) may be configured in one or more grooves in the otherwise soft (or hard, respectively) cover layer.

As a result of these arrangements, the golf ball may experience a lower rate of spin when struck with a larger force (such as during a drive) while also experiencing a higher rate of spin and increased control when struck with a smaller force (such as during a chip). The golf ball therefore achieves improved play characteristics associated with harder cover layers (such as longer distance) during drives, while also achieving improved play characteristics associated with softer cover layers (such as higher spin) during short shots.

This disclosure further relates to methods of manufacturing such a golf ball.

Figure 1:
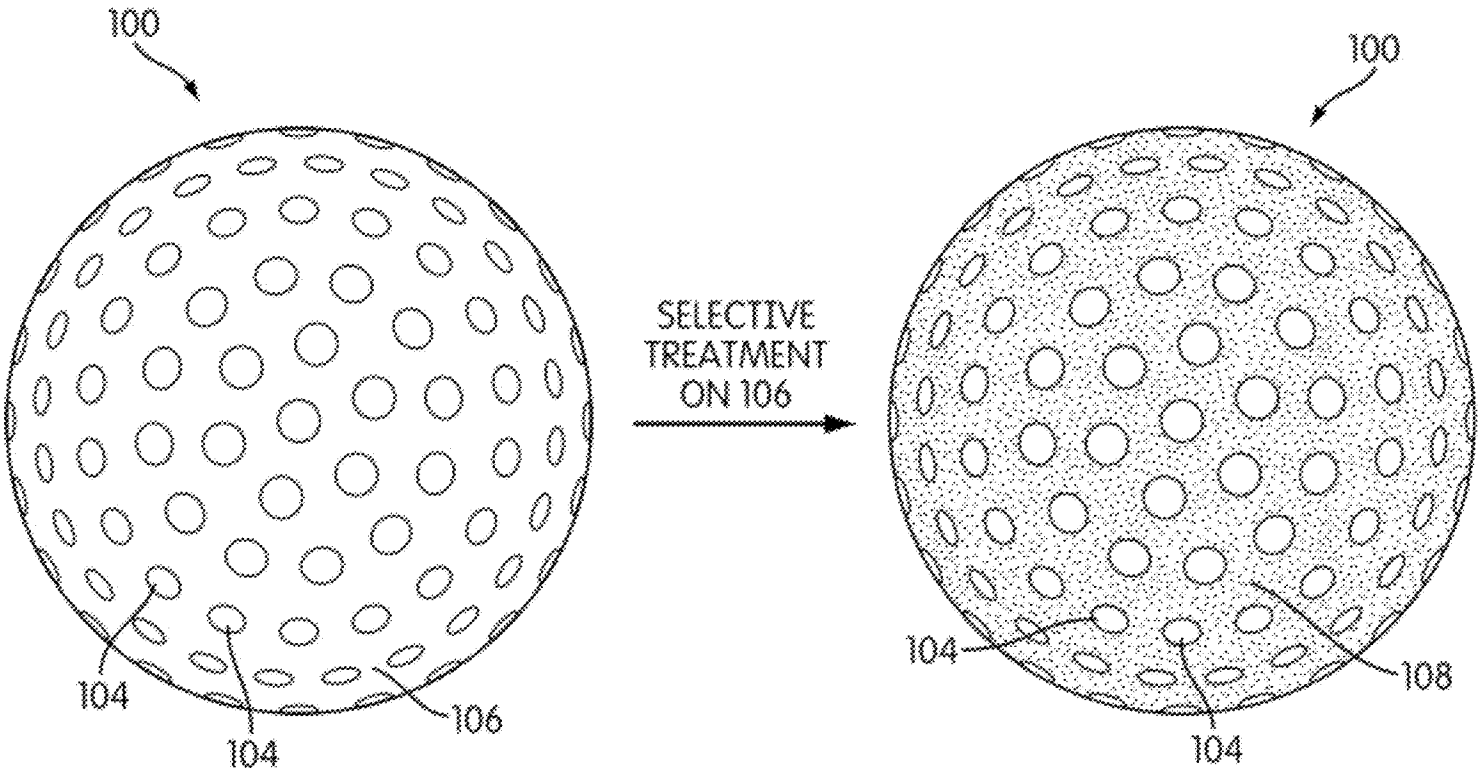
FIG. 1 shows an exemplary golf ball before and after selective treatment.

FIG. 1 shows an exemplary golf ball 100 in accordance with this disclosure. Golf ball 100 is made up of a cover layer having thereon a plurality of dimples 104 and at least one land area 106. Golf ball 100 may generally be any type of golf ball having a core and a cover layer substantially surrounding the core. For example, golf ball 100 may be of a two-piece construction, having only a core and a cover layer, or golf ball 100 may have one or more intermediate layers located between the core and the cover layer. Except as otherwise herein discussed, each layer of golf ball 100 may be formed of any material or construction as is generally known in the art of golf ball manufacturing. For example, various layers of golf ball 100 may be comprised of rubber, rubber composites, thermoplastic polyurethane, highly-neutralized polymers, ionomers, and other polymer materials as are known in the art of golf ball manufacturing.

The plurality of dimples 104 may generally be arranged on the cover layer in any pattern, as may be known in the art of golf balls. Various known dimple packing patterns are known in the art. Dimples 104 may generally be of any shape, such as circular, triangular, or multi-sided. Dimples 104 may be of uniform shape and size, or the dimple pattern may be made up of two or more different types of dimples having (for example) different sizes or different shapes. At least one land area 106 is a part of the cover layer that separates at least two dimples 104 and that is not indented or otherwise part of a dimple. Generally, land area 106 is the "ridge" or "fret" between adjoining dimples 104. Golf ball 100 may include one continuous land area 106 across the entire cover layer, as is shown in FIG. 1, or a plurality of separate land areas between the plurality of dimples 104.

As shown in FIG. 1, golf ball 100 undergoes selective treatment of land area 106. In the embodiment shown in FIG. 1, the selective treatment changes the entirety of land area 106 from a first state into land area 108 in a second state. In other embodiments, the selective treatment may be applied to a portion of land area 106. This selective treatment may comprise a heating step, discussed in further detail below.

Figure 2:
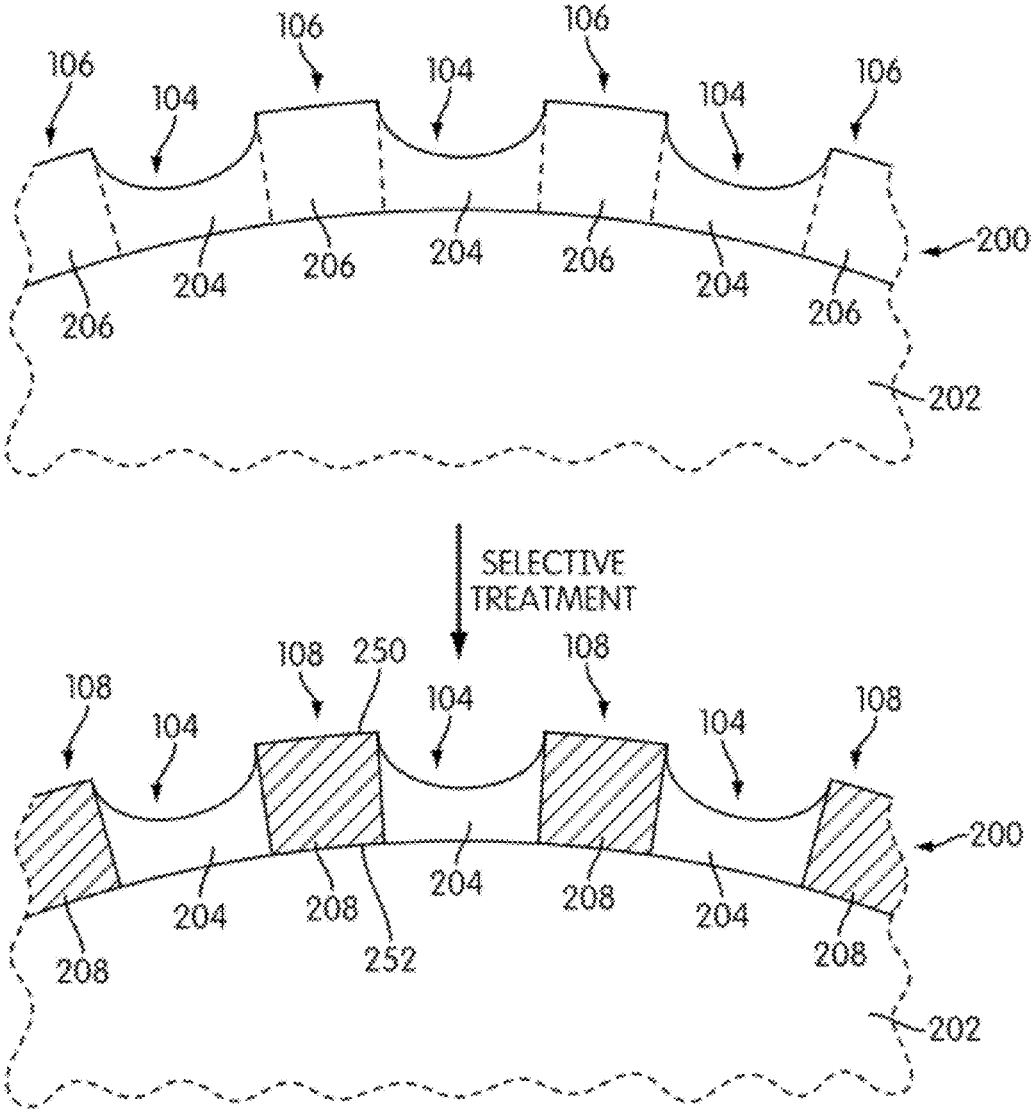
FIG. 2 shows a cross section of the golf ball, before and after the selective treatment.

FIG. 2 shows a cross section of golf ball 100, before and after the selective treatment. In particular, golf ball 100 includes core 202 and cover layer 200. Cover layer 200 includes dimples 104 and land areas 106 thereon. Prior to the selective treatment, cover layer 200 is made up of several sections 204 having at least one dimple 104 thereon, and several sections 206 having at least a part of at least one land area 106 forming the top boundary thereof. After the selective treatment, the sections 206 having a part of at least one land area 106 thereon are changed into a second state 208 as discussed above with respect to land areas in a second state 108.

After the selective treatment, cover layer 200 generally includes a first portion having a first hardness, and a second portion having a second hardness. The first portion generally includes those sections 204 of cover layer 200 having at least one dimple 104 thereon. The first portion may include all sections 204 of cover layer 200 having dimples 104 thereon, or the first portion may include some of the sections 204 but not others. In other words, the first portion as a whole may include all of the dimples 104 thereon, or a subset of fewer than all of the plurality of dimples 104 thereon. Generally, the first portion of cover layer 200 can be made up of any number and arrangement of the sections 204. Similarly, the second portion of cover layer 200 generally includes those sections 208 having at least a part of at least one land area 108 thereon. The second portion may also be made up of all sections 208, or fewer than all of the sections 208. In other words, the second portion as a whole may include the entirety of all of the land area(s) thereon, or may include less than the entirety of all of the land area(s) thereon.

Figure 5:
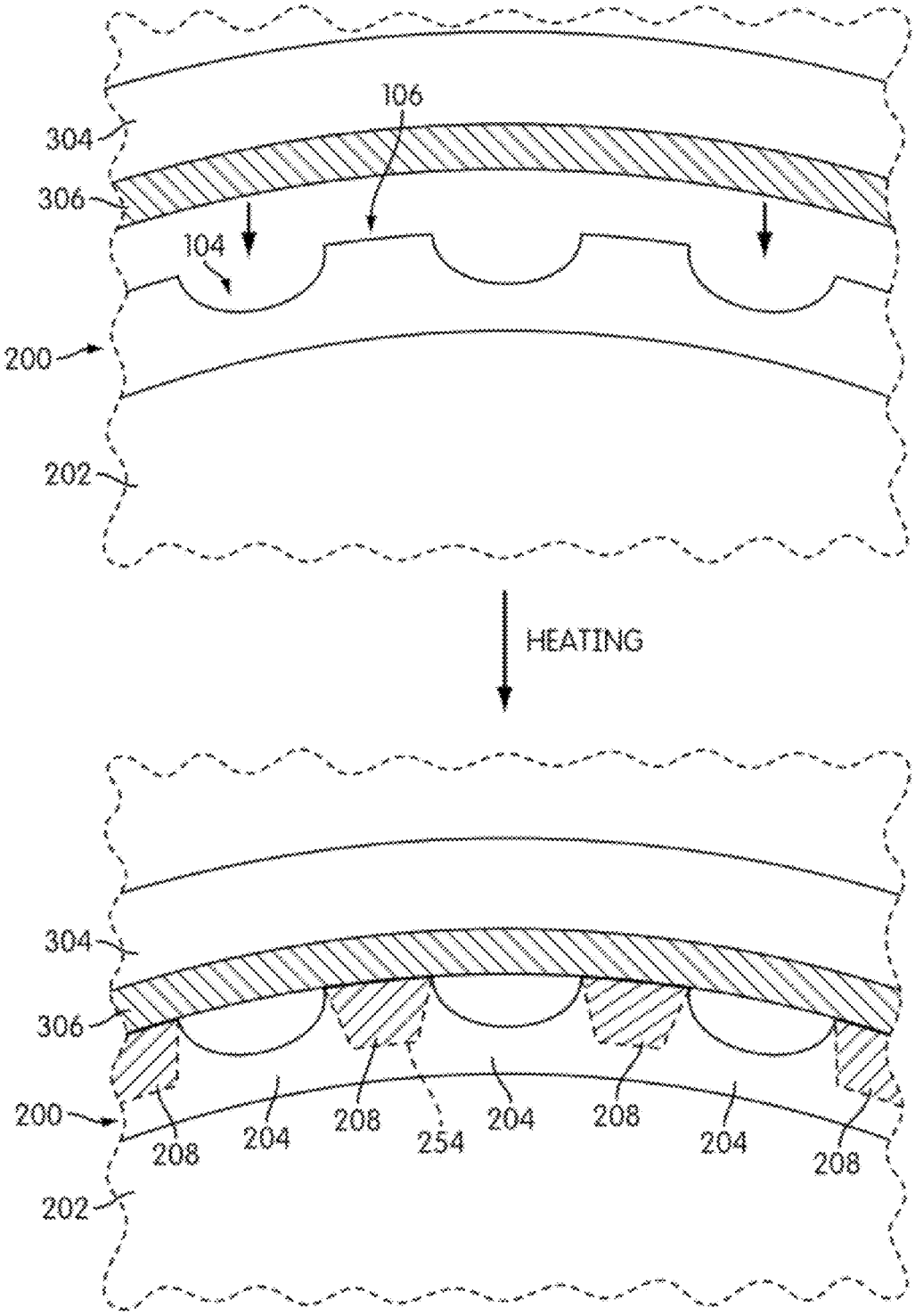
FIG. 5 shows a cross section of the golf ball and heating device, before and after heating.

Either of the first or the second portion may extend through the entire cross-sectional thickness of the cover layer 200, as shown in FIG. 2, or only though a portion of the cross section of cover layer 200, as shown in FIG. 5. Referring again to FIG. 2, specifically, the second portion may extend from an outer surface 250 of cover layer 200 to an inner surface 252 of cover layer 200. Alternatively, as shown in FIG. 5, the second portion may extend from an outer surface 250 of the cover layer 200 to an intermediate point 254 between the outer surface 250 and the inner surface 252 of cover layer 200.

Each of the first portion and the second portions are non-overlapping portions of a continuous cover layer material. Namely, as shown in FIG. 2, the portions 204 and the portions 206 are defined by the dimples 104 and the land 106 but are otherwise parts of the same continuous cover layer 200. In particular embodiments, the first portion and the second portion of cover layer 200 have the same material composition, i.e. there is no difference in the chemical composition of the materials making up the first portion and the second portion.

The first hardness, associated with the first portion of cover layer 200, is higher than the second hardness, associated with the second portion of cover layer 200. Accordingly, the portions of cover layer 200 associated with dimples 104 are generally relatively hard, while the portions of cover layer 200 associated with land areas 108 are generally relatively soft. The degree of difference in hardness between the first portion and the second portion may be any non-trivial difference in hardness. In certain embodiments, the hardness of the first portion may be at least about 3 units on the Shore D scale harder than the hardness of the second portion. In other embodiments, the first portion may be at least about 5 units on the Shore D scale harder than the second portion.

Generally, the present disclosure encompasses two or more zones of differing hardness of the cover layer. For example, a golf ball may have three zones of hardness. In such an embodiment, cover layer 200 includes a third portion. The first portion, the second portion, and the third portion are all non-overlapping portions of the continuous cover layer material.

Figure 3:
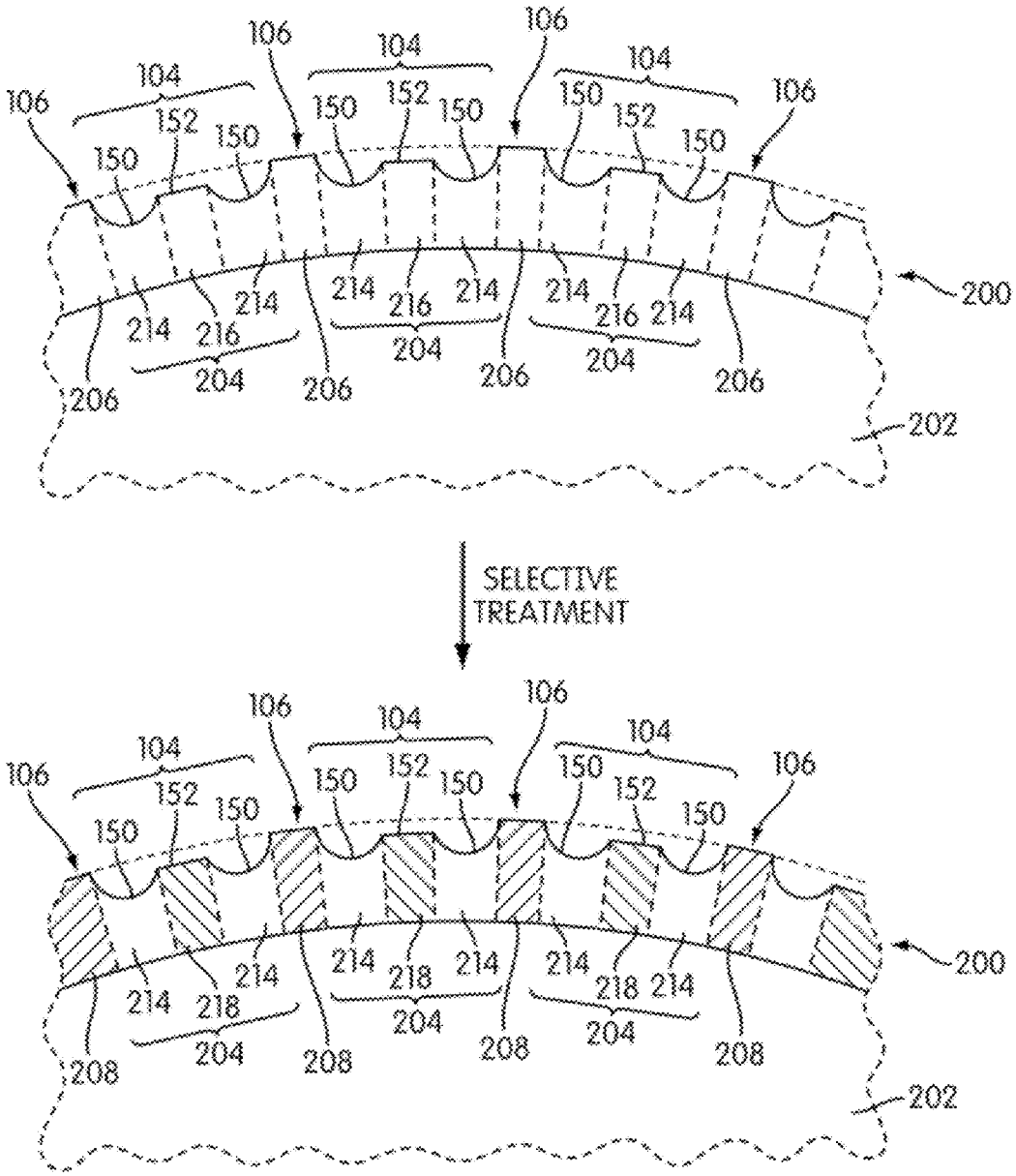
FIG. 3 shows a cross section of a golf ball having an alternative dimple pattern.

For example, a second embodiment of a dimple pattern that may be used in conjunction with the present disclosure is shown in FIG. 3. In this embodiment, cover layer 200 again includes dimples 104 and land areas 106 separating at least two dimples 104. Here, each dimple 104 is made up of a center dimple section 152 and a radial edge dimple section 150. Cover layer 200 includes portions 206 underlying the land areas (as in the embodiment shown in FIG. 2, discussed above), portions 214 underlying radial edge dimple sections 150, and portions 216 underlying center dimple sections 152. Portions 214 and 216 are collectively equivalent to portion 204 in the embodiment shown in FIG. 2, discussed above.

This cover layer 200 as shown in FIG. 3 may then undergo selective treatment so as to change the hardness of certain portions of the cover layer. Specifically, first, portions 206 may undergo selective treatment so as to change into portions 208 in a second state. Portions 208 thereby achieve a second hardness, as discussed above. Furthermore, portions 216 also undergo selective treatment so as to change into portions 218 in a second state. Portions 218 have a third hardness. The third hardness may be different from or equal to the second hardness. Finally, portions 214 may remain unchanged, and have a fourth hardness. The fourth hardness may be greater than the third hardness. Accordingly, after undergoing selective treatment, cover layer 200 achieves three zones of hardness: land areas 106 having a second hardness, center dimple sections 152 having a third hardness, and radial edge dimple section 150 having a fourth hardness. In this case, the "first portion" discussed above includes at least one dimple 104 having a center dimple section 152 and a radial edge dimple section 150, and the "first hardness" discussed above may be considered as the effective average of the third hardness and the fourth hardness based on the relative proportions of center dimple section 152 and radial edge dimple section 150 in the dimple 104.

Cover layer 200 is generally made of any material that can change in hardness in response to a selective treatment. In particular embodiments where the selective treatment comprises heating, cover layer 200 may comprise a phase transition material as described in U.S. Patent Application Publication No. 2008/0081710 (hereinafter referred to as "the '710 Publication"), the disclosure of which is hereby incorporated in its entirety. Specifically, the phase transition material described in the '710 Publication is an acid copolymer that comprises copolymerized residues of at least one alpha olefin having from two to six carbon atoms and copolymerized residues of at least one α,β-ethylenically unsaturated carboxylic acid having from 3 to 8 carbon atoms.

As described in the '710 Publication, this phase transition material changes hardness in response to heating. Specifically, heat energy decreases the hardness by disrupting the material's secondary crystal structure. As is generally known in the arts of polymer science, the hardness of a semi-crystalline polymer material can be proportional to the degree of crystallinity of the polymer material. The degree of crystallinity is the amount of the material that is in a crystalline phase, as compared to the amount of the material that is in an amorphous phase. The crystalline phase is generally harder than the amorphous phase, due to the close-packing crystal structure of the polymer molecules therein.

Figure 4:
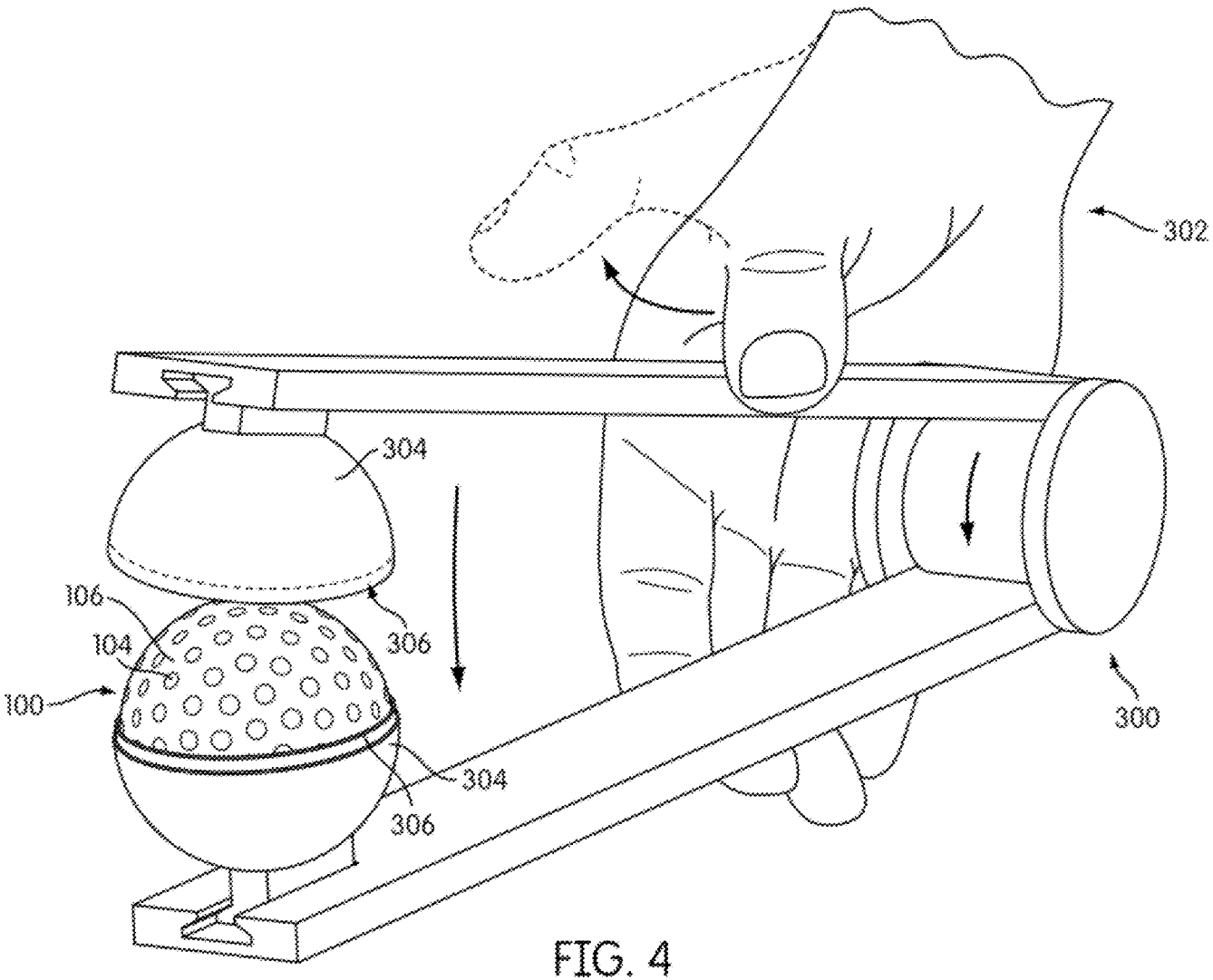
FIG. 4 shows a heating device that can be used to achieve selective heating.

Therefore, golf ball 100 may be heated in a heating device 300 as shown in FIG. 4 in order to achieve the desired difference in hardness. The heating device 300 is fully described in U.S. Pat. No. 7,926,645, entitled Device for Heating a Golf Ball, and filed on Oct. 23, 2009, the disclosure of which is hereby incorporated by reference in its entirety. Heating device 300 is held by a user's hand 302 and moved, as shown, such that heating surface 106 is brought into contact with the golf ball 100.

Specifically, as shown in FIG. 5, cover layer 200 may be selectively heated by a heating element 306 in order to achieve the desired difference in hardness. Specifically, heating element 306 may be brought into contact with the land areas 106 of cover layer 200. The sections of cover layer 200 closest to the surface of land areas 106 touching heating element 306 are therefore heated. These sections form the second portion of the cover layer, as described above. In the embodiment described here, and as shown in FIG. 5, the second portion extends from the outer surface 250 of the cover layer 200 to an intermediate point 254 between the outer surface 250 and the inner surface 252, depending on the nature and extent of the heat applied by the heating element 306. As a result of the selective heating applied to the land areas 106, the first portion of cover layer 200 (encompassing untreated sections 204) has a first hardness that is higher than the second hardness of the second portion (encompassing treated sections 208). Specifically, the secondary crystal structure of the second portion has been disrupted, and so the degree of crystallinity of the first portion is higher than the degree of crystallinity of the second portion.

Although FIG. 5 only shows this selective heating process being applied to a particular cross section of the cover layer 200, this selective heating process may be applied to the entire surface of golf ball 100, such that all land areas 106 are heated. Alternatively, the selective heating process may be applied to certain land areas 106 on different locations on golf ball 100, but not others, as may be desired. In either case, the second portion of cover layer 200 will encompass only those portions of cover layer 200 that are heated, and therefore have a difference in hardness from the first portion of cover layer 200.

In another embodiment, the cover layer 220 may comprise a semi-crystalline thermoplastic material. Methods for changing the hardness of semi-crystalline thermoplastic materials are fully described in U.S. Pat. No. 8,602,914, entitled Methods and Systems for Customizing a Golf Ball, and filed on Jan. 20, 2010, the disclosure of which is hereby incorporated by reference in its entirety.

Figure 6:
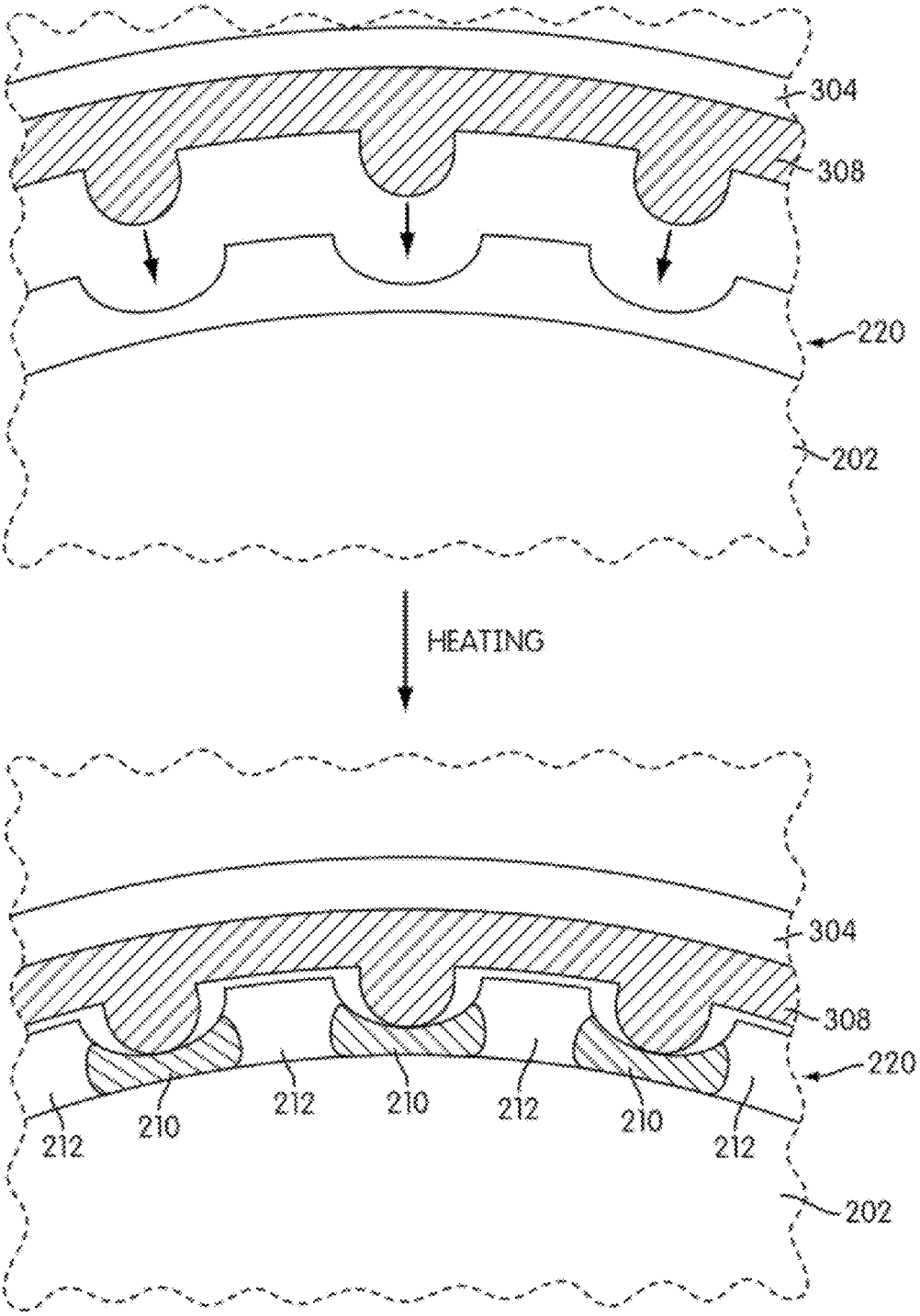
FIG. 6 shows a cross section of a portion of the golf ball and a second heating device, before and after heating.

Specifically, as is shown in FIG. 6, heating element 308 may be used to heat sections 210 of the cover layer 220 associated with the dimples 104. In accordance with the methods described in the '493 application, these sections 210 may be heated to increase the movement of the polymer molecules in the semi-crystalline thermoplastic material, and subsequently slowly cooled such that the degree of crystallinity in these sections 210 increases. Sections 210 therefore collectively make up the first portion of cover layer 200, as described above, and have a hardness that is higher than the un-heated sections 212 collectively making up the section portion. In such embodiments, again, the degree of crystallinity of the first portion of cover layer 200 is higher than the degree of crystallinity of the second portion. In other words, the first portion has a first degree of crystallinity, and the second portion has a second degree of crystallinity, where the first degree of crystallinity is higher than the second degree of crystallinity.

Heating element 306 or heating element 308, as used in the methods described above, may generally be any heating mechanism that is capable of selectively heating the desired portions of the cover layer. In a particular embodiment, as mentioned above and shown in FIG. 4, the heating element may be a component of the heating apparatus described fully in U.S. patent application Ser. No. 12/304,830 (hereinafter referred to as "the '830 application"). In such embodiments, the heating element 306 or the heating element 308 may be the internal heating surface as described in the '830 application. Similarly, the heating element backing 304, shown in FIGS. 5 and 6, may be the external housing described in the '830 application. The device described in the '830 application allows a consumer to create a desired difference in hardness in accordance with the present disclosure through the use of a particular pattern on the internal heating surface.

FIGS. 7-10 show a second category of embodiments within the scope of this disclosure. In FIGS. 7-10, the golf ball cover layer comprises two different materials. Generally, one of these materials may be an ionomer material, and the other may be a polyurethane material. A first portion of the golf ball cover layer may be made of the ionomer material, while a second portion of the golf ball cover layer may be made of the polyurethane material.

Figure 7:
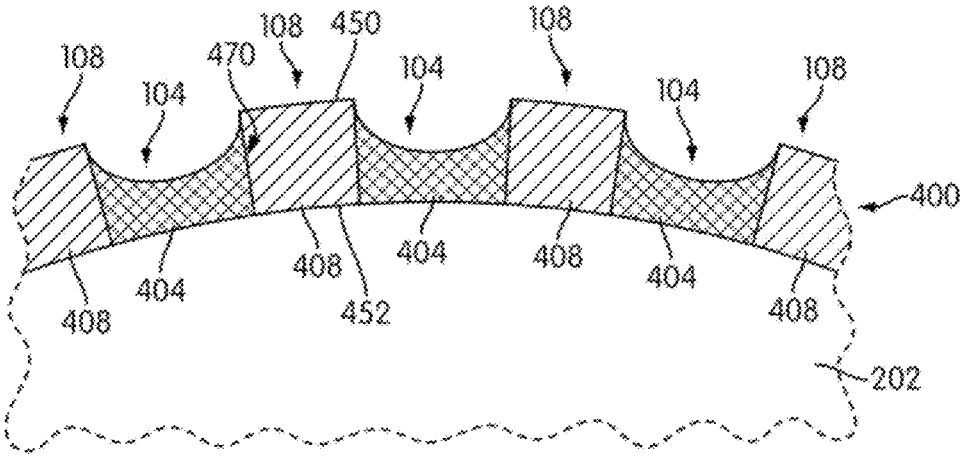
FIG. 7 shows a cross section of a portion of a first golf ball cover layer made from two different materials.

In particular, FIG. 7 shows a first embodiment of a cover layer 400 that is made up of two different materials. Cover layer 400 includes dimples 104 and land areas 108, as discussed above with respect to other embodiments. As shown in FIG. 7, portions 404 of cover layer 400 that correspond to dimples 104 may be made from a first material. Portions 408 of cover layer 400 that correspond to land areas 108 may be then made from a second material.

In the embodiment shown in FIG. 7, each material extends the full thickness of cover layer 400. That is, each material comprises the entire cross section of cover layer 400 from inner surface 452 to outer surface 450. Furthermore, as shown, each material makes up the entire lateral width of the dimple 104 or land area 108. For example, portion 404 made of the first material extends laterally from boundary 470 at the edge of dimple 104 to the other corresponding edge of dimple 104. Therefore, portions 404 made of the first material and portions 408 made of the second material are laterally adjacent to each other. In the particular embodiment shown in FIG. 7, portions 404 and 408 are entirely laterally adjacent to each other, and do not overlap each other in any manner.

As mentioned, portions 404 may be comprised of a first material, while portions 408 may be comprised of a second material. In embodiments, the first material may be a polyurethane material or an ionomer material, while the second material may also be a polyurethane material or an ionomer material, where the first material and the second material are different materials. For example, the first material may be a polyurethane while the second material is an ionomer. Alternatively, the first material may be an ionomer while the second material is a polyurethane.

Polyurethane materials are known to be used in golf ball construction. Generally, polyurethane polymers are formed from the reaction of a long-chain polyol and a polyisocyanate. Polyurethane includes thermosetting urethane and thermoplastic polyurethanes. A wide range of polyurethane formulations are known to a person having ordinary skill in the art of golf ball manufacturing. Example representative polyurethane compositions are disclosed in: U.S. Pat. No. 6,392,002 to Wu, entitled "Urethane Golf Ball" and issued on May 21, 2002; U.S. Pat. No. 6,835,793 to Yokota et al., entitled "Golf Ball having a Polyurethane Cover" and issued on Dec. 2, 2004; and U.S. Pat. No. 6,422,954 to Dewanjee, entitled "Golf Ball having a Polyurethane Cover" and issued on Jul. 23, 2002. The disclosures of these three U.S. patents are hereby incorporated by reference.

Ionomer materials are also known to be used in golf ball construction. Generally, ionomer polymers include any polymer formed from both an electrically neutral monomer and an ionized monomer. Ionomer polymers that are commonly used in golf ball construction are often formed from an short-chain alkene and an organic acid. Ionomer materials include the category of materials referred to as high acid ionomers, and includes the category of materials referred to as highly-neutralized polymers, among many others. Example representative ionomer materials are disclosed in: U.S. Pat. No. 5,994,472 to Egashira et al., entitled "Ionomer Covered Golf Ball" and issued on Nov. 20, 1999; U.S. Pat. No. 5,873,796 to Cavallaro et al., entitled "Multi-Layer Golf Ball Comprising a Cover of Ionomer Blends" and issued on Feb. 23, 1999; and U.S. Pat. No. 6,433,094 to Nesbitt et al., entitled "Golf Ball Covers Containing High Acid Ionomers" and issued on Aug. 13, 2002. The disclosures of these three U.S. patents are hereby incorporated by reference. In particular, commonly used ionomer materials include the Surlyn® line of materials commercially available from E.I. du Pont de Nemours and Company.

Polyurethane materials and ionomer materials may have different physical properties, and this difference in physical properties may be used in the construction of the present golf ball to achieve desired play characteristics. In particular, polyurethane materials and ionomer materials may have different hardnesses. Hardness is generally measure in accordance with ASTM D-2240, and is given in units of Shore D unless otherwise noted.

Generally, polyurethane materials used in golf ball construction may have a hardness of from about 20 to about 60 Shore D. Ionomer materials used in golf ball construction may have a hardness of from about 40 to about 80 Shore D. Generally, the two materials used should have different hardness values. Typically, in some embodiments, polyurethane materials used in golf ball construction have a lower hardness than ionomer materials used in golf ball construction.

The degree of difference in hardness between the polyurethane material and the ionomer material may be any non-trivial difference in hardness. In certain embodiments, the hardness of the ionomer material may be at least about 3 units on the Shore D scale harder than the hardness of the polyurethane material. In other embodiments, the ionomer material may be at least about 5 units on the Shore D scale harder than the polyurethane material, or at least about 10 units, or at least about 15 units.

Figure 8:
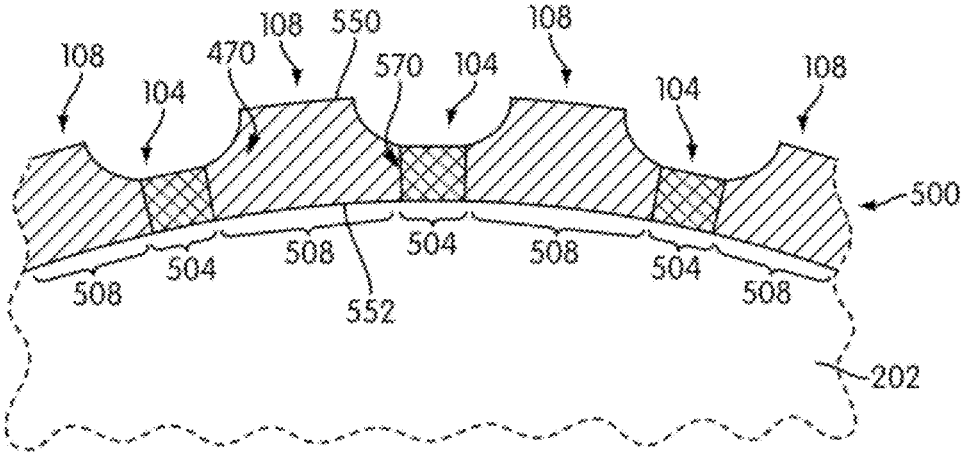
FIG. 8 shows a cross section of a portion of a second golf ball cover layer made from two different materials.

FIG. 8 shows a second embodiment of a cover layer that is comprised of two different materials. Here, cover layer 500 includes portions 504 that correspond to a part of each dimple 104. Portions 504 may be comprised of a first material. Cover layer 500 also includes portions 508 that correspond to land areas 108 and part of each dimple 104. Portions 5008 may be comprised of a second material. Portions 508 are wider than portions 408, as shown in FIG. 7. Portions 508 and portions 504 are laterally adjacent to each other, at boundary 570. In this embodiment, boundary 570 is located in dimple 104. In contrast, boundary 470 in cover layer 400 is located at the interface between dimple 104 and land 108. Each of portions 504 and portions 508 may extend through the entire thickness of cover layer 500, from bottom surface 552 to top surface 550.

Figure 9:
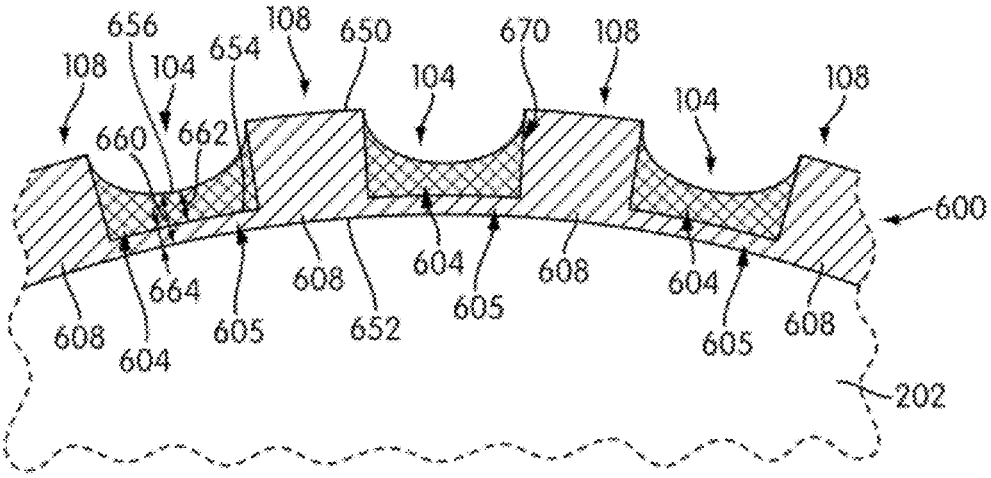
FIG. 9 shows a first cross section of a portion of a third golf ball cover layer made from two different materials.

FIG. 9 shows a third embodiment of a cover layer that is comprised of two different materials. Cover layer 600 may include portions 604 that correspond to each dimple 104. Portions 604 may be made of a first material. Portions 604 may extend from an outer surface 656 of the cover layer 600 at dimple 104 to an intermediate point 654 that is between outer surface 656 and an inner surface 652 of cover layer 600. Intermediate point 654 may be located so that portion 604 has depth 662. Located beneath portion 604 may be portion 605. Portion 605 may be made of a second material, and may have thickness 664. Thickness 664 and thickness 662 may be any value within the total thickness 660 of cover layer 600. Portions 608 may also be made of the second material, and may be laterally continuous with portions 605 as shown.

Portions 604 and portions 608 may be laterally adjacent to each other at boundary 670. In the particular embodiment shown in FIG. 9, boundary 670 may extend vertically from top surface 650 to intermediate point 654. This is in contrast to the above discussed embodiments where the boundary line extends through the entire thickness of the cover layer.

Figure 10:
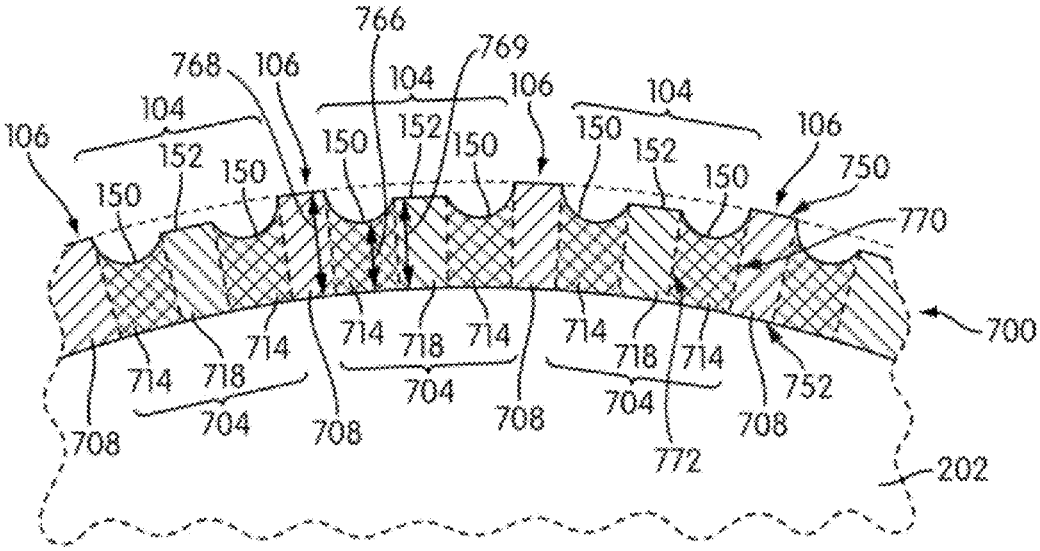
FIG. 10 shows a first cross section of a portion of a fourth golf ball cover layer made from two different materials.

FIG. 10 shows a fourth embodiment of a cover layer that is comprised of two different materials. The configuration of dimples 104 in FIG. 10 is substantially similar to the configuration of dimples 104 in FIG. 3, discussed above. Namely, cover layer 700 may include portions 714 that correspond to the radial edge dimple section 150. Portions 714 may be comprised of a first material. Cover layer 700 may also include portions 718 that correspond to center dimple section 152. Portions 718 may be comprised of a second material. Collectively, portions 714 and portions 718 may correspond to dimple 104. Cover layer 700 may then also include portions 708 that correspond to land areas 106. Portions 708 may also be comprised of the second material.

In the embodiment shown in FIG. 10, portions 714 may have thickness 766. Thickness 766 may extend through the entire thickness of cover layer 700, as shown. However, in other embodiments not shown, thickness 766 may extend from a top surface 152 of cover layer 700 to an intermediate point between the top surface and inner surface 752, as was discussed with respect to the embodiment of FIG. 9 above.

Portions 718 may have thickness 769, and portions 708 may have thickness 768. Generally, thickness 769 may be less than thickness 768.

Generally, in each of FIGS. 7-10 discussed various above, the first material may be either polyurethane or ionomer, and the second material may be either polyurethane or ionomer, as long as the second material is different from the first material. Namely, in some embodiments the first material may be polyurethane and the second material may be ionomer. In other embodiments, the first material may be ionomer and the second material may be polyurethane.

Figure 11:
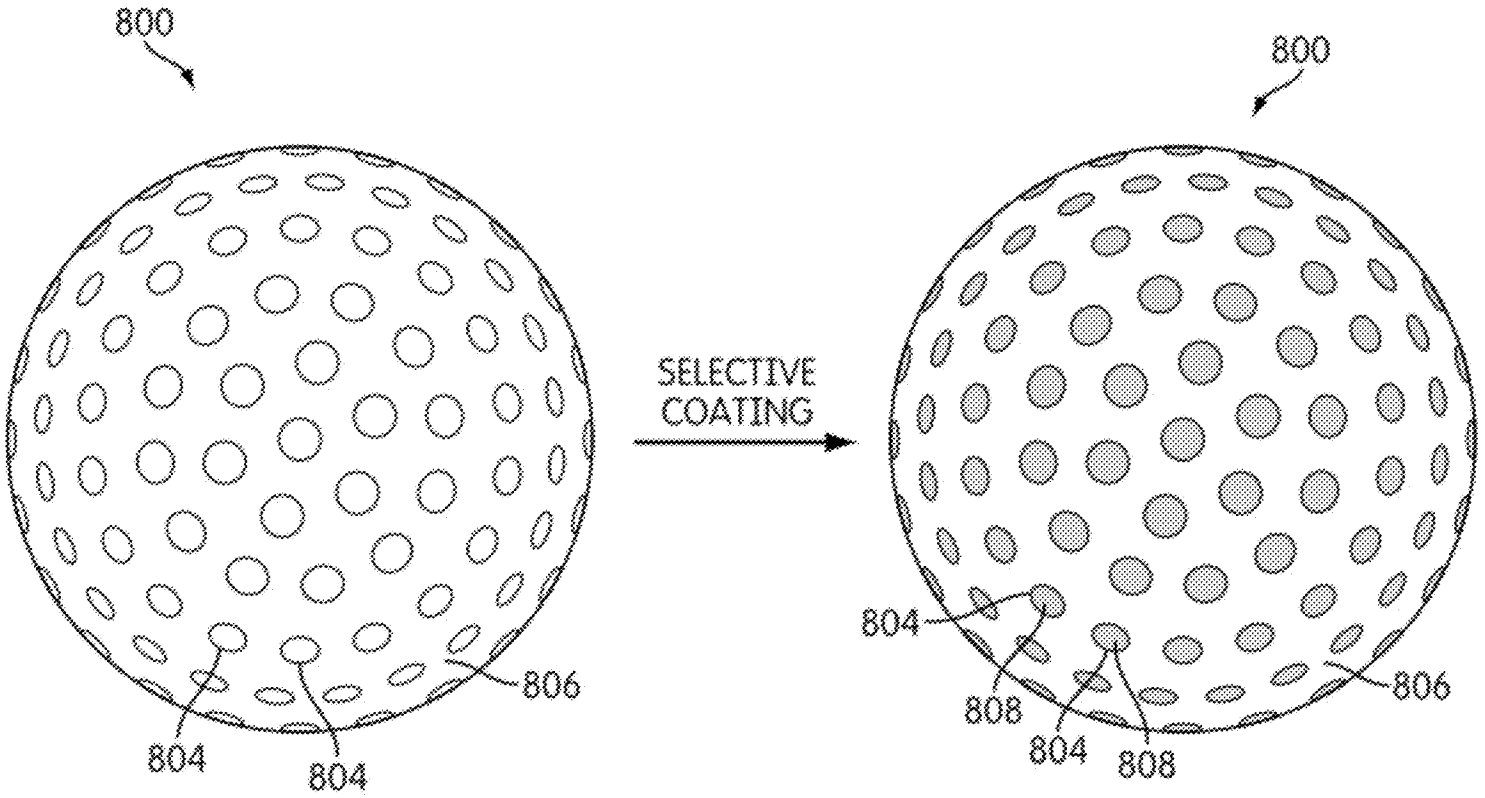
FIG. 11 shows an exemplary golf ball before and after selective coating.

In different embodiments than those discussed variously above, the difference in hardness between the dimples and the land areas can be achieved through the use of a coating material. FIG. 11 shows a golf ball 800 in accordance with these embodiments, and a general process for making such a golf ball. Generally, a golf ball 800 may comprise a core and a cover layer substantially surrounding the core, where the cover layer is formed of a material having a first hardness and has a plurality of dimples 804 and at least one land area 806 thereon. The plurality of dimples 804 may be arranged on the cover layer in a first pattern, and the at least one land 806 area may be arranged on the cover layer in a second pattern, where the first pattern and the second pattern are non-overlapping patterns. Then, the cover layer may be coated with a coating material 808 having a second hardness, such that coating material 808 overlaps at least a portion of one of the first pattern and the second pattern, but substantially does not overlap the other of the first pattern and the second pattern. The second hardness may be different from the first hardness.

In the embodiment shown in FIG. 11, the coating material 808 is selectively applied on the first pattern corresponding to the dimples 804. In such an embodiment, the second hardness (i.e., the hardness of the coating material) is higher than the first hardness (i.e., the hardness of the cover material). Therefore, coating material 808 makes the dimples 804 hard while the cover layer, exposed on the land areas 806, is soft. Although FIG. 11 shows all of the dimples 804 being coated with the coating material 808, coating material 808 may alternatively coat only a portion of the first pattern.

Figure 12:
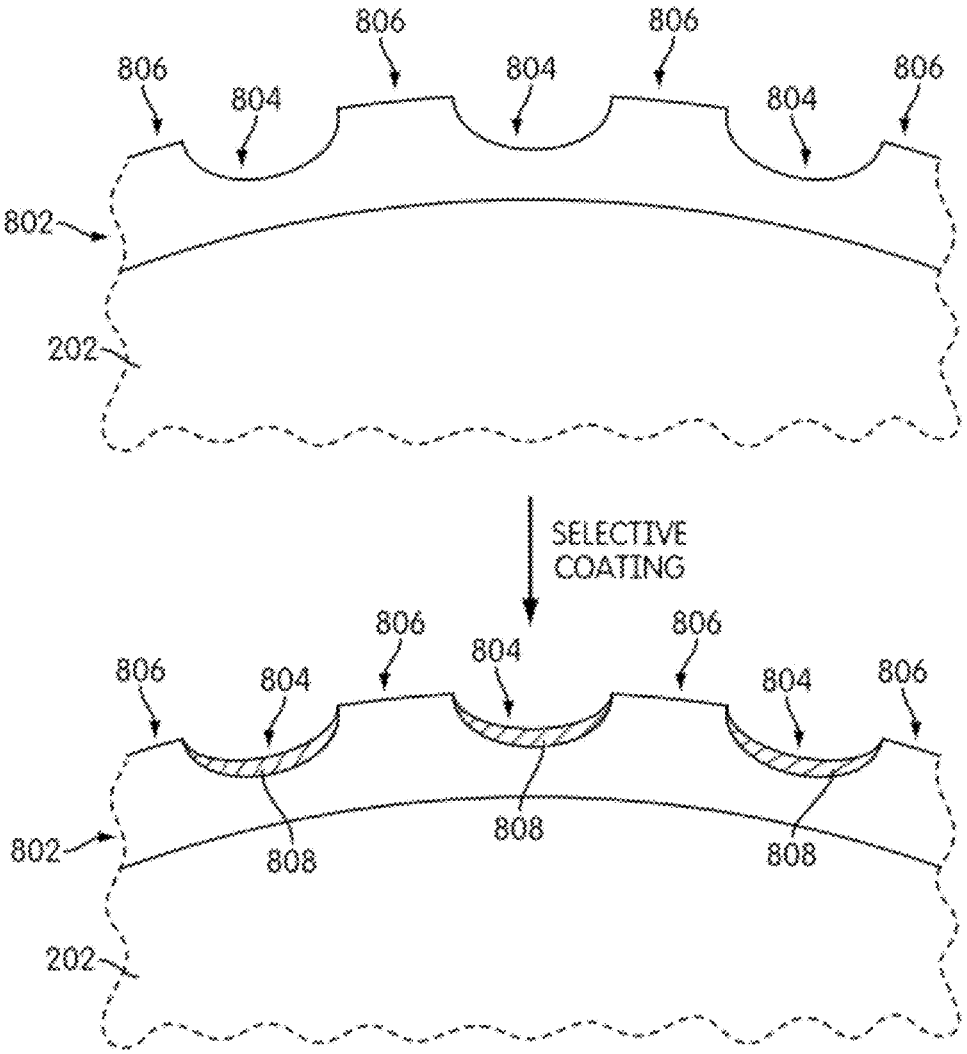
FIG. 12 shows a cross section of a portion of a golf ball cover layer, before and after the selective coating.

FIG. 12 shows a cross-sectional view of the dimples 804 and land areas 806 shown in FIG. 11. In FIG. 12, coating material 808 is coated on top of each of the dimples 804, forming a thin layer of coating material 808 on a cover layer 802. The thickness of the coating material 808 may generally be any thickness that fits within a dimple. Coating material 808 should generally not be so thick as to significantly affect the aerodynamics of the golf ball, however coating material 808 may be applied in such a way as to achieve a desired dimple depth configuration. In certain embodiments, cover layer 802 may have a thickness of about 2 mm or less. Accordingly, in these embodiments coating material 808 may have a thickness that is, for example, on the order of 0.5 mm or less, or 0.3 mm or less, or 0.1 mm or less.

Figure 13:
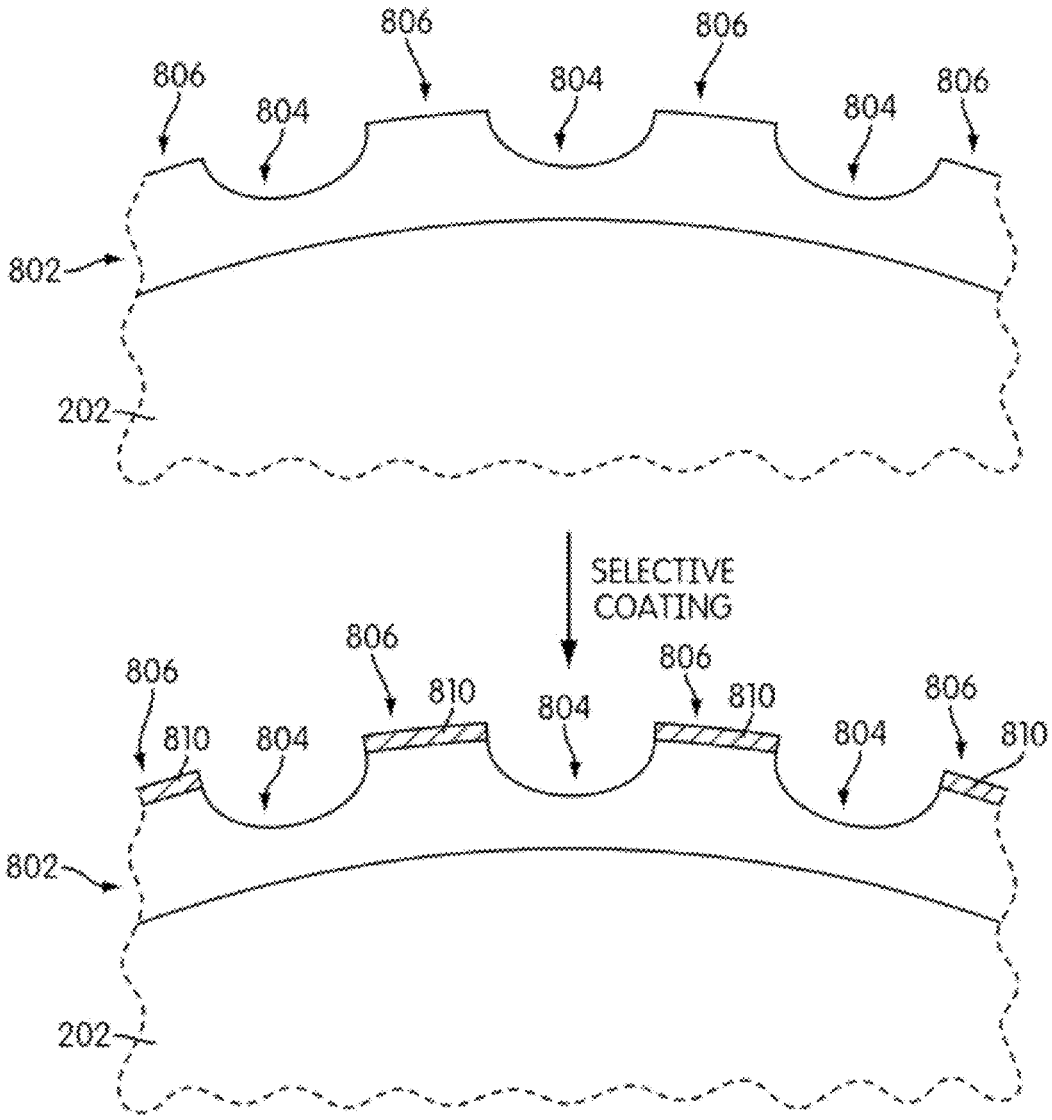
FIG. 13 shows a cross section of a portion of a golf ball cover layer, before and after a different selective coating.

FIG. 13 shows another embodiment, wherein land areas 806 are coated with a coating material 810. In this embodiment, coating material 810 covers at least a part of the second pattern, the second pattern corresponding to the land areas 806. As mentioned above with respect to the embodiment in FIG. 12, in the embodiment of FIG. 13 coating material 810 may generally cover all of the second pattern or less than all of the second pattern in any arrangement as may be desired. In embodiments where coating material 810 covers at least a part of the second pattern, the second hardness (i.e., the hardness of coating material 810) is less than the hardness of the cover layer material. Accordingly, land areas 806 coated with coating material 810 are relatively soft, while dimples 804 are relatively hard.

Figure 14:
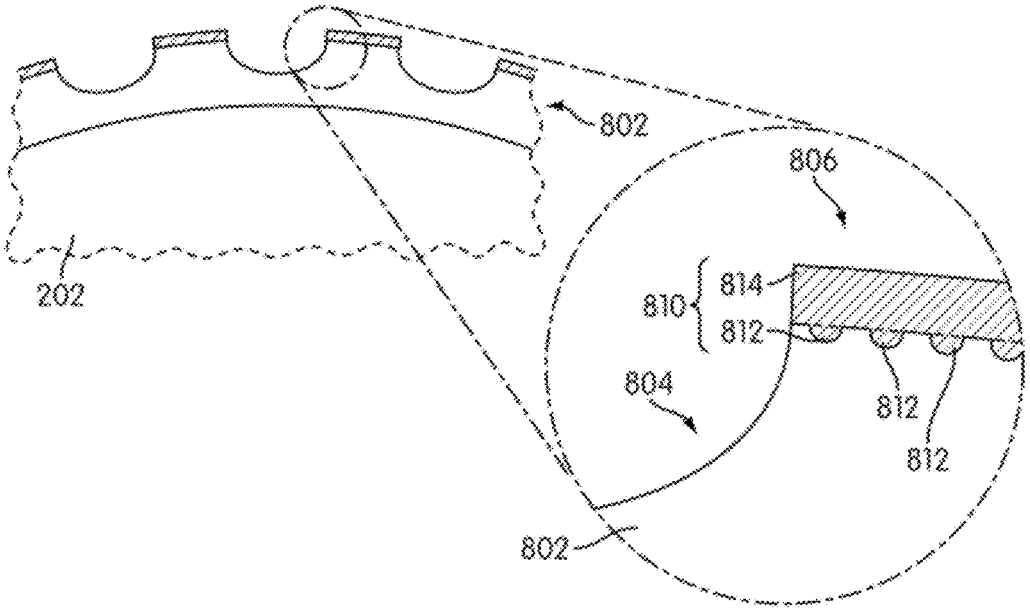
FIG. 14 shows a cross section of a portion of a golf ball cover layer, in further detail.
Figure 15:
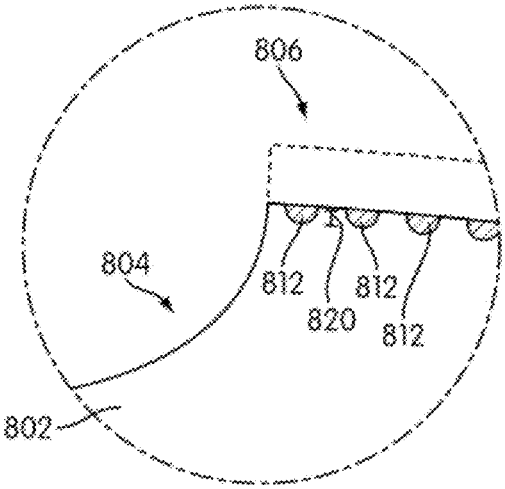
FIG. 15 shows a close-up cross section of a portion of a golf ball cover layer, after a part of a selective coating has been removed.
Figure 16:
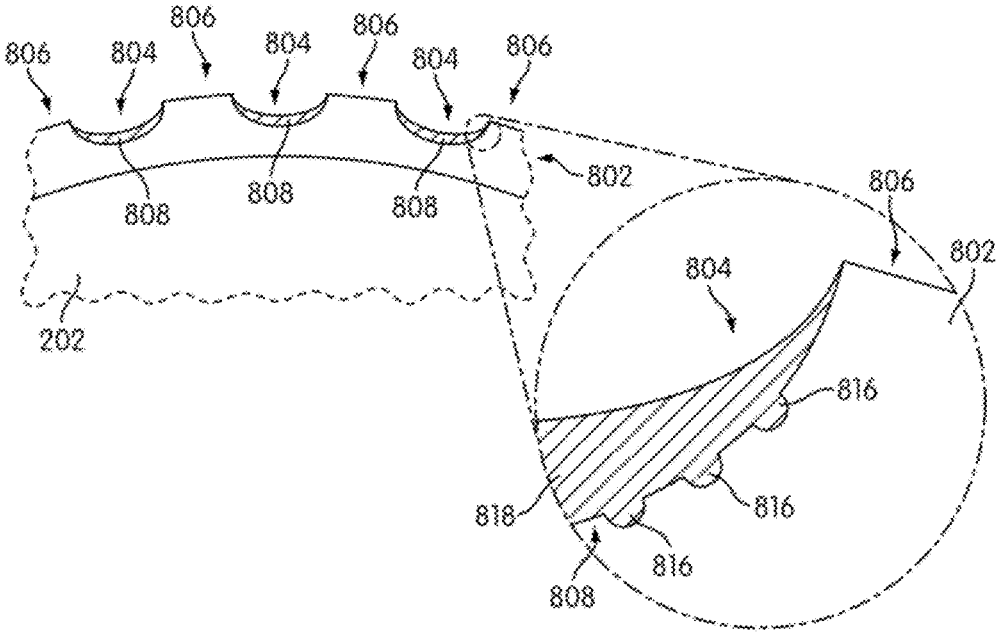
FIG. 16 shows a second embodiment of a cross section of a portion of a golf ball cover layer, in further detail.
Figure 17:
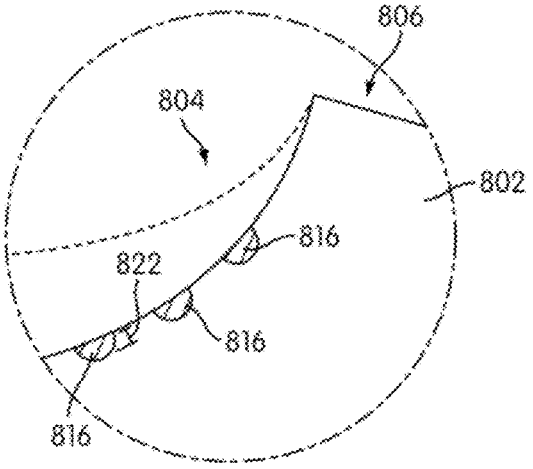
FIG. 17 shows a second embodiment of a close-up cross section of a portion of a golf ball cover layer, after a part of a selective coating has been removed.

FIGS. 14 and 15 show a further feature of the coating that may be used in conjunction with any of the above discussed embodiments. Specifically, FIG. 14 shows several pockets 812 in the surface of the cover layer 802. Although FIG. 14 shows pockets 812 as being located on cover layer 802 corresponding to land area 806, pockets 812 may equally be located on cover layer 802 corresponding to dimples 804, as shown in FIGS. 16 and 17. Generally, pockets 812 are small indentations or abrasions intentionally formed in the surface of cover layer 802. Pockets 812 generally have a depth 820 that is at least less than the depth of dimple 804, and, in some embodiments, significantly less than the depth of dimples 804. In embodiments where cover layer 802 has a thickness of about 2.0 mm, the pockets 812 may have a depth 820 of less than about 0.5 mm, less than about 0.3 mm, or less than about 0.1 mm. Pockets 812 may enable coating material 808, 310 to better adhere to cover layer 802. Pockets 812 may also allow more flexibility in the design of the golf ball, such as by achieving a desired difference in hardness without, for example, changing the dimple depth or total diameter of the golf ball.

When coating material 810 is coated on cover layer 802 having pockets 812 therein, coating material 810 fills the pockets 812 as well as coats the surface of cover layer 802 with a top section 814 of coating material 810. The top section 814 of coating material 810 may be left in place on the second pattern on top of land areas 806, if desired, or may be removed to leave coating material 810 only in the pockets 812. FIG. 15 show coating material present only the pockets 812. As shown in FIG. 15, the coating material is located in the pockets, but does not otherwise substantially overlap the surface of cover layer 802.

FIGS. 16 and 17 show an embodiment wherein pockets 816 are made in the surface of cover layer 802 located on dimple 804. Similar to as discussed above, coating material 808 may include a top section 818 as well as fill the pockets 816. The top section 818 of coating material 808 may then be removed, if so desired, leaving coating material 808 only in pockets 816. Pockets 816 in dimple 804 have a depth 822 that may be the same as or different from depth 820 of pockets 812 associated with land area 806.

In these embodiments including pockets 812 and/or pockets 816, generally, the coating material may be used to change the hardness of the second pattern in accordance with this disclosure, without changing the diameter or aerodynamic performance of the golf ball. Therefore a wider range of golf ball designs may be used in accordance with the present disclosure, without the need to redesign the physical structure of the golf ball or sacrifice advantageous aerodynamic properties.

The coating material may generally be selected in accordance with the desired hardness. In embodiments, such as are shown in FIGS. 11 and 12, wherein the coating material has a hardness higher than the hardness of the cover layer material, the coating material may be a hard polymer or a metal plating. A wide range of hardness of a polymer material may generally be controlled by, for example, the degree of cross-linking, the degree of crystallinity, and the chain length. In a specific embodiment, for example, the cover layer material may be a thermoplastic polyurethane (TPU) having a hardness of about 45 to 60 on the Shore D scale, and the coating material may be a thermoplastic polyurethane having a hardness of about 65 on the Shore D scale. Generally, the polymer coating material may be any thermoplastic, thermoset, ionomer, copolymer, or other polymer material known and used in the art of golf balls.

In other embodiments, the coating material may be polyurethane or an ionomer in particular. For example, cover layer 802 may be comprised of a polyurethane or an ionomer, while the coating material may be comprised of the other of a polyurethane or an ionomer. In the embodiment of FIG. 12, for example, cover layer 802 may be comprised of an ionomer while coating material 804 may be a polyurethane. When the hardness of the ionomer is greater than the hardness of the polyurethane, this configuration would result in hard land areas and soft dimples. Conversely, in other embodiments, cover layer 802 may be comprised of a polyurethane while coating 808 may be comprised of an ionomer.

Similarly, in the embodiment of FIG. 13 the cover layer 802 may be comprised of a polyurethane, while coating 810 may be comprised of an ionomer. When the hardness of the ionomer is greater than the hardness of the polyurethane, this configuration would again result in hard land areas (due to the coating on the land) and soft dimples. In other embodiments in accordance with FIG. 13, cover layer 802 may be comprised of an ionomer while coating 810 may be comprised of a polyurethane. Polymers are known in the art that have high hardness values.

Additionally, the coating material may be a metal plating. Nearly any typical metal may be used, as most metals have a hardness at conventional temperatures that is higher than polymer materials conventionally used to form golf ball cover layers. Exemplary metals that may be used as the coating material include aluminum, steel, tungsten, titanium, magnesium, and iron alloys, among a variety of others. The metal coating material may be selected based on hardness, workability, and cost effectiveness.

Figure 18:
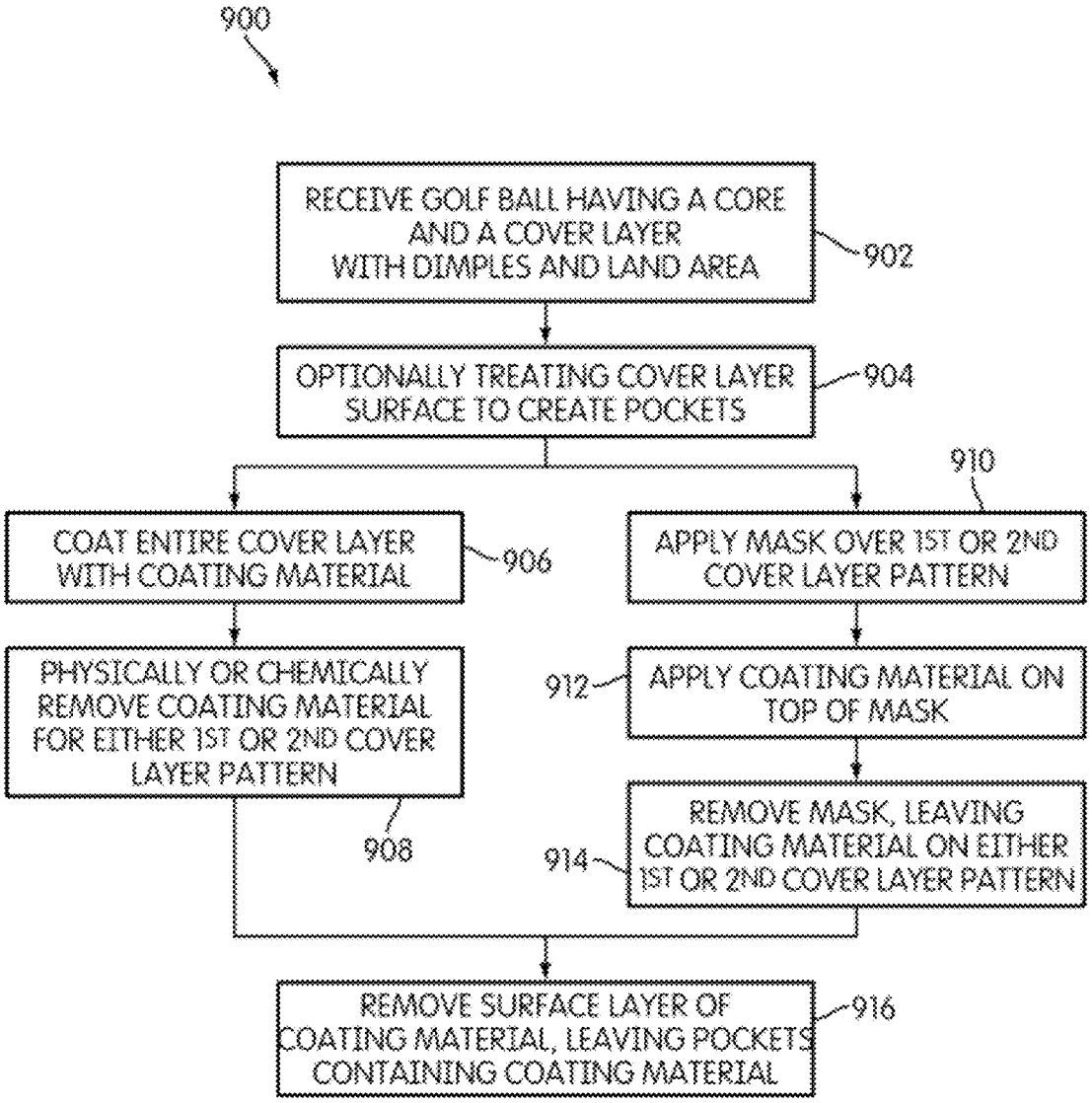
FIG. 18 is a flowchart detailing a method of manufacturing a golf ball, including optional steps.

FIG. 18 is a flowchart detailing a method of manufacturing the golf ball discussed above, including optional steps. Generally, a method 900 of manufacturing a golf ball includes first step 902 of receiving a golf ball having a core and a cover layer with a plurality of dimples and at least one land area thereon. The golf ball may then undergo an optional preliminary step of treating the cover layer so as to create pockets 812 in the cover layer. This preliminary treatment step may be, for example, a physical surface roughening, or a chemical etching that etches only a small portion of the cover layer such as an unmasked portion of the surface of the golf ball.

Next, method 900 of manufacturing the golf ball may take either of two general routes. In a first step 906 of a first route, the entire cover layer is coated with the coating mater. The coating may be a physical coating step, such as by brushing, dipping, spraying or other physical application means. Alternatively, the coating may be a chemical coating step, such as chemical vapor deposition (CVD), plasma spray coating, or other chemical application means. The coating material is then selectively removed in step 908, such that the coating layer remains only on either of the first or second pattern, as desired. The removal of the coating material may be a physical grinding away of the coating, or may be a chemical removal such as by chemical etching using a mask to protect selected coated areas to prevent the removal of selected coated areas.

Alternatively, in step 910 a mask may be applied over the golf ball. The mask may be a physical mask having a pattern of holes corresponding to either of the first pattern or the second pattern. The coating material is then 912 applied on top of the mask, after which 914 the mask is removed, leaving the coating material on only the pattern corresponding to the holes in the mask.

Finally, if the golf ball underwent step 904 to create pockets, the surface portion of the coating material 814 may be removed in step 916. This step leaves the coating material in only the pockets, and not otherwise substantially overlapping the surface of the cover layer.

FIGS. 19-38 show another category of embodiments within the scope of this disclosure. Generally, FIGS. 19-38 refer to embodiments where the golf ball cover has a groove therein, and the groove contains a material that is different from the material of the cover layer. Associated methods of making these golf balls are detailed in FIGS. 35-38 in particular.

For purposes of this disclosure, the terms "compressible," "compressibility," and the like refer to the amount deformation exhibited by an object when compressed under a predetermined set of loading parameters. As used in the present disclosure, compressibility shall refer to compression deformation, which is the deformation amount (in millimeters) of an object when compressed by a force, specifically, the deformation of the object when the compression force is increased from 10 kg to 130 kg. The deformation amount of the object under the force of 10 kg is subtracted from the deformation amount of the object under the force of 130 kg to obtain the compression deformation value of the object. While compressibility (and compression deformation) is a parameter that may be measured for entire golf balls, compressibility can also be measured for individual components of golf balls. In the present disclosure, compressibility of a golf ball groove material is measured and discussed in detail.

Figure 19:
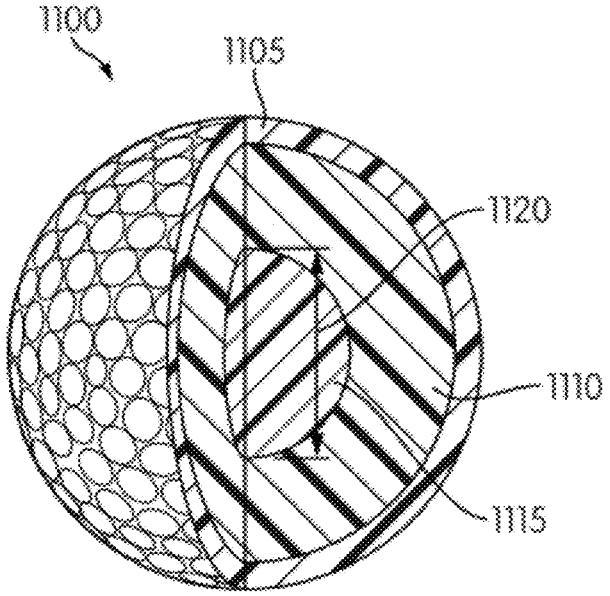
FIG. 19 shows a cutaway, partial cross-sectional view of an exemplary golf ball having a three-piece construction.
Figure 20:
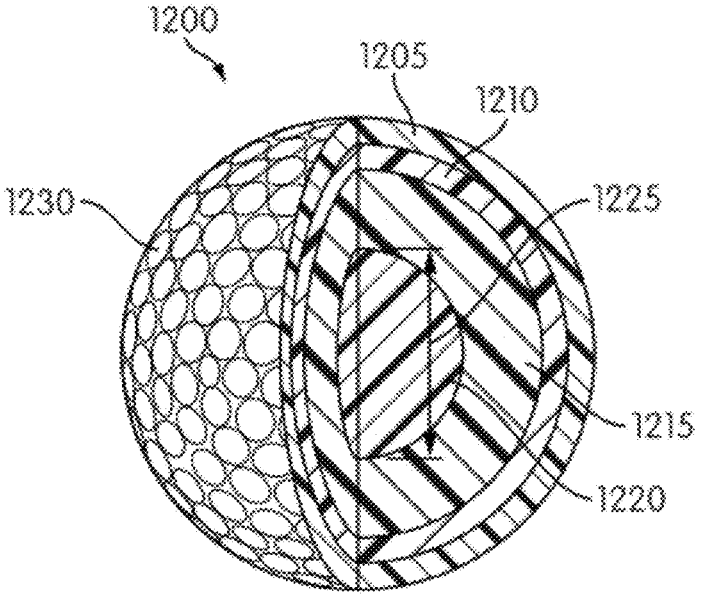
FIG. 20 shows a cutaway, partial cross-sectional view of an exemplary golf ball having a four-piece construction.

As mentioned above, these embodiments may be applicable to golf balls having any internal structural configuration. FIGS. 19 and 20 illustrate exemplary 3-layer and 4-layer golf ball constructions, respectively.

FIG. 19 illustrates a cutaway, partial cross-sectional view of an exemplary three-layer golf ball construction. As shown in FIG. 19, a golf ball 1100 may include a cover layer 1105, an outer core layer 1110 disposed radially inward of cover layer 1105, and an inner core layer 1115 disposed radially inward of outer core layer 1110. The dimensions and materials of each layer may be selected to achieve desired performance characteristics.

Cover layer 1105 may be formed of a relatively soft but durable material. For example, cover layer 1105 may be formed of a material that compresses/flexes when struck by a golf club, in order to provide spin of the ball and feel to the player. Although relatively soft, the material may also be durable, in order to withstand scuffing from the club and/or the golf course. Generally, the cover layer may be formed of either a polyurethane material or an ionomer material. Polyurethane materials and ionomer materials are discussed above, and are well known to a person having ordinary skill in the art.

In addition, FIG. 19 illustrates the outer surface of cover layer 1105 as having a generic dimple pattern. While the dimple pattern on golf ball 1100 may affect the flight path of golf ball 1100, any suitable dimple pattern may be used with the disclosed embodiments. In some embodiments, golf ball 1100 may be provided with a dimple pattern including a total number of dimples between approximately 300 and 400.

Outer core layer 1110 may be formed of a relatively firm and suitably resilient material. Outer core layer 1110 may be configured to provide a relatively high launch angle and a relatively low spin rate when the ball is struck by a driver, and a relatively higher spin rate and increased control when struck with irons. This may provide distance off the tee with spin and control around the greens. Inner core layer 1115 may be formed of a relatively firm material in order to provide distance.

The thickness of the golf ball layers may be varied in order to achieve desired performance characteristics. In some embodiments, inner core layer 1115 may have a diameter in the range of about 19 mm to 30 mm. For example, in some embodiments, inner core layer 1115 may be spherical with a diameter 120 of approximately 24 mm to 28 mm.

FIG. 20 is a cutaway, partial cross-sectional view of a golf ball 1200 having a four-piece construction. As shown in FIG. 20, golf ball 1200 may have four layers that are positioned adjacent one another. For example, in some embodiments, golf ball 1200 may include an outer cover layer 1205 and an inner cover layer 1210 disposed radially inward of outer cover layer 1205. Golf ball 1200 may also include an outer core layer 1215 disposed radially inward of inner cover layer 1210, and an inner core layer 1220 disposed radially inward of outer core layer 1215. Any layer may surround or substantially surround any layers disposed radially inward of that layer. For example, outer core layer 1215 may surround or substantially surround inner core layer 1220.

As shown in FIG. 20, golf ball 1200 may dimples 1230 which may be formed in outer cover layer 1205. As noted above, dimples 1230 may have any suitable configuration.

In the present disclosure and drawings, golf ball 1200 is described and illustrated as having four layers. In some embodiments, at least one additional layer may be added. For example, in some embodiments, a mantle layer may be added between outer core layer 1215 and inner cover layer 1210. In some embodiments, an intermediate cover layer may be inserted between inner cover layer 1210 and outer cover layer 1205. Further, in some embodiments, an intermediate core layer may be inserted between inner core layer 1220 and outer core layer 1215. Other layers may be added on either side of any disclosed layer as desired to achieve certain performance characteristics and/or attributes.

In some embodiments, golf ball 1200 may have a diameter of at least 42.67 mm (1.680 inches), in accordance with the Rules of Golf. For example, in some embodiments, golf ball 1200 may have a ball diameter between about 42.67 mm and about 42.9 mm, and may, in some embodiments, have a ball diameter of about 42.7 mm. Golf ball 1200 may have a ball weight between about 45 g and about 45.8 g and may, in some embodiments, have a ball weight of about 45.4 g.

The thickness of the layers of golf ball 1200 may be varied in order to achieve desired performance characteristics. In some embodiments, outer cover layer 1205 may have a thickness of approximately 0.5 mm to 2 mm. In addition, in some embodiments, inner cover layer 1210 may have a thickness of approximately 0.5 mm to 2 mm. In some embodiments, outer cover layer 1205 and/or inner cover layer 1210 may have a thickness of approximately 0.8 mm to 2 mm. In some embodiments, outer cover layer 1205 and/or inner cover layer 1210 may have a thickness of approximately 1 mm to 1.5 mm.

In some embodiments, outer core layer 1215 may have a thickness of at least about 5 mm. In some embodiments, inner core layer 1220 may be a sphere having a diameter 1225 in the range of approximately 21 mm to 30 mm. In some embodiments, diameter 1225 of inner core layer 1220 may be in the range of approximately 24 mm to 28 mm. For example, in some embodiments, diameter 1225 may be 24 mm. In other embodiments, diameter 1225 may be 28 mm.

In some embodiments, the inner core layer may be formed by any suitable process, such as injection molding or compression molding. Further the inner core layer may be formed of any suitable material, such as a thermoplastic material, for example. In some embodiments, suitable thermoplastic materials may include, for example, an ionomer resin, such as Surlyn®, produced by E. I. Dupont de Nemours and Company. In some embodiments, the inner core layer may be formed from a highly neutralized acid polymer composition. Exemplary highly neutralized acid polymer compositions suitable for forming the inner core layer may include, for example, HPF resins such as HPF1000, HPF2000, HPF AD1024, HPF AD1027, HPF AD1030, HPF AD1035, HPF AD1040, all produced by E. I. Dupont de Nemours and Company.

The acid polymer may be neutralized to 80% or higher, including up to 100%, with a suitable cation source, such as magnesium, sodium, zinc, or potassium. Suitable highly neutralized acid polymer compositions for use in forming the inner core layer may include a highly neutralized acid polymer composition and optionally additives, fillers, and/or melt flow modifiers.

Suitable additives and fillers may include, for example, blowing and foaming agents, optical brighteners, coloring agents, fluorescent agents, whitening agents, UV absorbers, light stabilizers, defoaming agents, processing aids, antioxidants, stabilizers, softening agents, fragrance components, plasticizers, impact modifiers, acid copolymer wax, surfactants. In some embodiments, the additives and fillers may include, for example, inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate, and other types of organic fillers. In some embodiments, the additives and fillers may include, for example, high specific gravity metal powder fillers, such as tungsten powder, molybdenum powder, and others. In some embodiments the additives and fillers may include regrind, that is, core material that is ground and recycled.

Any suitable melt flow modifiers may be included in the highly neutralized acid polymer composition. Exemplary suitable melt flow modifiers may include, for example, fatty acids and salts thereof, polyamides, polyesters, polyacrylates, polyurethanes, polyethers, polyureas, polyhydric alcohols, and combinations thereof.

The outer core layer may be formed by any suitable method, such as compression molding. Further, the outer core layer may be formed of any suitable material, such as a thermoset material. For example, in some embodiments, outer core layer 1215 may be formed by crosslinking a polybutadiene rubber composition. When other rubber is used in combination with a polybutadiene, polybutadiene may be included as a principal component. For example, a proportion of polybutadiene in the entire base rubber may be equal to or greater than 50% by weight and, in some embodiments, may be equal to or greater than 80% by weight. In some embodiments, outer core layer 215 may be formed of a polybutadiene rubber composition including a polybutadiene having a proportion of cis-1,4 bonds of equal to or greater than 60 mol %. For example, in some embodiments, the proportion may be equal to or greater than 80 mol %.

In some embodiments, cis-1,4-polybutadiene may be used as the base rubber and mixed with other ingredients. In some embodiments, the amount of cis-1,4-polybutadiene may be at least 50 parts by weight, based on 100 parts by weight of the rubber compound. Various additives may be added to the base rubber to form a compound. The additives may include a cross-linking agent and a filler. In some embodiments, the cross-linking agent may be zinc diacrylate, magnesium acrylate, zinc methacrylate, or magnesium methacrylate. In some embodiments, zinc diacrylate may provide advantageous resilience properties.

In some embodiments, the filler may include zinc oxide, barium sulfate, calcium carbonate, or magnesium carbonate. In some embodiments, zinc oxide may be selected for its advantageous properties. In some embodiments, the filler may be used to increase the specific gravity of the material. For example, metal powder, such as tungsten, may alternatively be used as a filler to achieve a desired specific gravity. In some embodiments, the specific gravity of outer core layer 215 may be in the range of about 1.05 g/cm^3 to about 1.35 g/cm^3.

In some embodiments, a polybutadiene synthesized using a rare earth element catalyst is preferred. Using this polybutadiene may provide golf ball 200 with increased resilience. Examples of rare earth element catalysts include lanthanum series rare earth element compound, organoaluminum compound, and almoxane and halogen containing compound. A lanthanum series rare earth element compound is preferred. Polybutadiene obtained by using lanthanum rare earth-based catalysts usually employ a combination of a lanthanum rare earth (atomic number of 57 to 71) compound, but particularly preferred is a neodymium compound.

In some embodiments, the polybutadiene rubber composition may comprise at least from about 0.5 parts by weight to about 5 parts by weight of a halogenated organosulfur compound. In some embodiments, the polybutadiene rubber composition may comprise at least from about 1 part by weight to about 4 parts by weight of a halogenated organosulfur compound. The halogenated organosulfur compound may be selected from the group consisting of pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenol; pentabromothiophenol; 2-bromothiophenol; 3-bromothiophenol 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; and their zinc salts, the metal salts thereof and mixtures thereof.

One or more cover layers may be molded to enclose the outer core layer. Generally, the cover layers may be formed of any suitable materials. For example, in some embodiments, cover layers may be formed from thermoplastic or thermoset materials. In some embodiments, inner cover layer 1210 and/or outer cover layer 1205 may be made from a thermoplastic material including at least one of an ionomer resin, a highly neutralized acid polymer composition, a polyamide resin, a polyester resin, and a polyurethane resin. In some embodiments, inner cover layer 1210 may be formed of the same type of material as outer cover layer 1205. In other embodiments, inner cover layer 1210 may be formed of a different type of material from outer cover layer 1205. In some embodiments, outer cover layer may be comprised of either polyurethane or ionomer, in particular. For example, the outer cover layer may be comprised of an ionomer such as Surlyn®.

The disclosed concepts may be implemented in golf balls having three-layer construction, four-layer construction, five-layer construction, or any other suitable configuration. Exemplary such concepts are discussed below.

In some embodiments, an exemplary disclosed golf ball may include features that provide increased spin and/or feel when struck. In order to provide such characteristics, the golf ball may be provided with one or more components formed of a material having an increased compressibility. That is, the material may deflect a greater amount when exposed to a given amount of force than a relatively less compressible material. In order to provide increased spin and/or feel, such compressible material may be disposed radially outward from the center of the ball, for example at or near the outer surface of the ball.

It is generally desirable for a golf ball to exhibit minimal spin when struck with a driver. Further, when a golf ball is struck with a club moving at a relatively high club head speed, such as a driver, the amount of deformation of the ball is significant, such that the properties of the core and other inner layers of the ball determine the playing characteristics, particularly distance. For these reasons, it may be desirable to provide a golf ball with a relatively hard and incompressible outer cover layer. An outer cover layer that is too compressible may be too "grippy" and thus produce more spin, even when struck with a driver. Further, a compressible outer cover layer would tend to absorb some of the energy of the impact with the club head and, therefore, reduce the distance achievable with the ball.

During short game play, however, it may be desirable for a golf ball to exhibit greater amounts of spin and feel. Greater amounts of spin facilitate greater control of the ball. During short game play, where club head speeds are relatively slower, the compressibility of the cover layers of the ball determine the playing characteristics, since the ball is not typically struck hard enough to compress the inner layers of the ball. Increased spin may be provided by a compressible outer cover layer material. Further, such a compressible outer cover layer may also provide improved feel of the ball when struck at relatively slow club head speeds. Thus, the desirability of having a compressible cover for short game play (e.g., playing with irons) may be in conflict with the desirability of having a relatively incompressible cover for long game play (e.g., hitting with a driver).

The present disclosure provides ball configurations, which implement both compressible and incompressible materials in the cover in order to produce a ball that has both good distance with low spin when struck with a driver, and increased spin and feel when struck with a short game club (e.g., irons, pitching wedge, sand wedge). In some embodiments, an exemplary disclosed golf ball may include one or more core layers and one or more cover layers. In some embodiments, an outermost cover layer, formed of a first material, having formed therein one or more grooves. For example, such grooves may include one or more channels, which may be formed in any suitable configuration. In some embodiments, for example, the outermost cover layer may include at least one spiral channel. In some embodiments, the cover layer may include circular grooves or circumferential grooves, which may be arranged in a grid about the outer surface of the ball.

In order to provide the increased spin and/or feel, a relatively compressible material may be disposed within the one or more grooves. Such material may have a compressibility that is less than the compressibility of the outermost cover layer material. In some embodiments, the outer cover layer material may constitute a substantial majority of the outer surface area of the golf ball and the outer surface of the material disposed in the grooves may constitute a substantial minority of the outer surface area of the golf ball. In some embodiments, the compressible material in the grooves, i.e. the groove material, may be selected from a polyurethane and an ionomer. Specifically, in some embodiments, the groove material may be polyurethane.

Similarly, in some embodiments, the outermost cover layer material may also be selected from a polyurethane and an ionomer, so long as the groove material and the cover material are different. For example, when the groove material is polyurethane the cover material may be an ionomer. However, in other embodiments, the groove material may be an ionomer while the cover material may be a polyurethane.

In some embodiments, the golf ball may include features that affect the aerodynamics of the ball. For example, in some embodiments, the outer surface of the material disposed in the grooves may extend beyond or may be recessed from the outer surface of the outermost cover layer. Therefore, the ball may include either bulges and/or recesses in the outer surface, which may have an effect on aerodynamics. In some embodiments the aerodynamic effect may be a reduction in drag coefficient, to improve distance and/or spin. In other embodiments, the effect may be an increase in drag coefficient, possibly in exchange for increased or decreased spin and/or control. In some embodiments, the orientation of the bulges and/or recesses may induce spin during flight. For example, a spiral arrangement of elongate bulges and/or recesses may cause a particular spin of the ball during flight.

Figure 21:
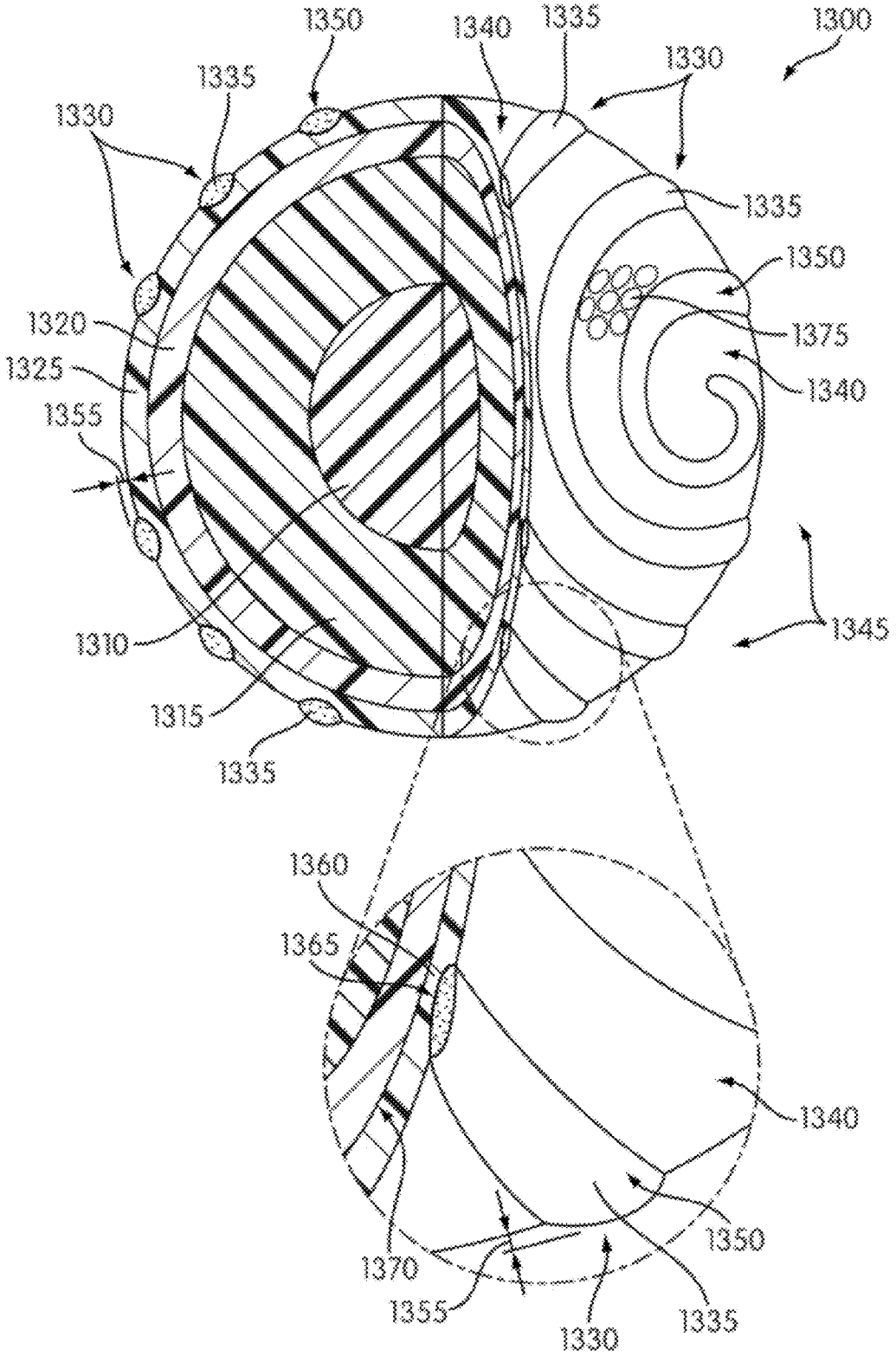
FIG. 21 shows a cutaway, partial cross-sectional view of an exemplary golf ball having material-filled spiral grooves in an outer layer.

FIG. 21 illustrates an exemplary golf ball 1300. Ball 1300 may include an inner core layer 1310 and an outer core layer 1315 disposed radially outward of inner core layer 1310. In addition, ball 1300 may include an inner cover layer 1320 disposed radially outward of outer core layer 1315, and an outer cover layer 1325 disposed radially outward of inner cover layer 1320. These layers may be configured generally as discussed above with respect to FIGS. 19 and 20. In some embodiments, ball 1300 may have more or fewer layers. Suitable materials for inner core layer 1310, outer core layer 1315, inner cover layer 1320, and outer cover layer 1325 are discussed above. Other suitable materials will be recognized by those having ordinary skill in the art.

For purposes of this disclosure and claims, the outer cover layer shall be referred to, in some cases, as the "outermost layer" of the golf ball. Similarly, the term "outermost surface area" of the golf ball is used in reference to the outer surface of the disclosed layers. It will be understood by those having ordinary skill in the art, however, that one or more finish coatings, including paint or other colorations, as well as one or more topcoats or clearcoats may be applied to an outer surface of the disclosed layers. These finish coatings have relatively insignificant thickness and, therefore, the outer surfaces of the disclosed layers are effectively the outermost surfaces of the golf ball, from a structural standpoint.

According to exemplary disclosed embodiments, spin and/or feel of the golf ball may be increased by the inclusion of a relatively compressible material at and/or near the outer surface of the outer cover layer. In some embodiments, a second material may be molded into the grooves of the outer cover layer, wherein the second material has a compressibility that is different than the compressibility of the outer cover layer material. For example, in some embodiments, a material that is more compressible than the outer cover layer material may be molded into the grooves. In other embodiments, the outer cover layer material may be more compressible than the material molded into the grooves. Although the material molded into the grooves ("groove material") may be more or less compressible than the outer cover layer, for purposes of discussion, the embodiments discussed below, unless otherwise noted, will be described as having a groove material that is more compressible than the outer cover layer material.

In some embodiments, the outer surface of the groove material forms a portion of the outer surface of the ball. The surface area and thickness of the groove material may be factors in the extent to which the groove material affects the spin and feel of the ball. Generally, the greater the amount of exposed surface area and/or thickness of a compressible material, the greater the increases in spin and feel will be. A compressible material will exhibit more grip against the club face, much like a soft compound tire provides more road grip. Therefore the amount of compressible material surface area will affect the amount of grip the ball will have against the club face. This increase in grip provides more spin and feel when striking the ball. In addition, the thickness of the compressible material has a similar effect on grip, the thickness of the compressible material is related to the amount of compressible material present at the outer portion of the ball. The more compressible material present at the outer portion of the ball, the more the outer portion deforms when struck, even on short game strikes, which tend to be less forceful.

In order to limit the increase in spin provided by the inclusion of compressible groove material, the groove material may constitute a limited amount of the outer surface area of the ball. For example, in some embodiments, the outer surface of the outer cover layer may constitute a substantial majority of the overall surface area of the ball, and the outer surface of the groove material may constitute a substantial minority of the outer surface of the ball. In other embodiments, the outer surface of the groove material may constitute a substantial majority of the outer surface area of the ball, and the outer surface of the outer cover layer may constitute a substantial minority of the outer surface area of the ball. This configuration may be advantageous, for example, when the outer cover layer material is more compressible than the groove material.

In addition, the extent to which the groove material extends radially beyond the outer surface of the outer cover layer may also influence the spin and feel. In some embodiments, the groove material may partially fill the grooves, and thus, may have an outer surface that is recessed from the outer surface of the outer cover layer. In some embodiments, the groove material may completely fill the grooves. For example, in some embodiments, the outer surface of the groove material may be substantially flush with the outer surface of the outer cover layer. In some embodiments, the outer surface of the groove material may overfill the grooves, bulging out such that the outer surface of the groove material extends radially outward beyond the outer surface of the outer cover layer. Generally, the greater the distance of a groove material from the center of the ball (relative to the outer surface of the outer cover layer), the greater the increases in spin and feel. The further the groove material extends radially, the more surface area of the groove material will be engaged by the club face and the less surface area of the outer cover layer will be engaged by the club face, thus providing increased grip against the club face, resulting in increased spin and feel.

In some embodiments, outer cover layer 1325 may include a groove 1330 extending radially inward from an outer surface 1340 of outer cover layer 1325. In some embodiments, groove 1330 may have the form of an elongate channel. Such channels may have any suitable configuration, such as, for example a spiral arrangement, as shown in FIG. 21. As further illustrated in FIG. 21, groove 1330 may be a continuous spiral groove encircling golf ball 1300 and extending substantially from one side of the golf ball to an opposite side of the golf ball. Other embodiments may incorporate more than one channel, such as a plurality of spiral grooves. Other arrangements are also possible. In addition, groove 330 may have any suitable shape, length, width, and depth. Exemplary alternative groove configurations are shown in the figures and discussed below.

Ball 1300 may include a groove material 1335 disposed within groove 1330. In some embodiments, groove material 1335 may have a compressibility that is different from the compressibility of the material from which outer cover layer 1325 is formed. In some embodiments, groove material 1335 may be more compressible than the material of outer cover layer 1325. In other embodiments, groove material 1335 may be less compressible than outer cover layer 1325. In particular embodiments, groove material 1335 may be selected from an ionomer and a polyurethane, while outer cover layer 1325 may be made of a material selected from an ionomer and a polyurethane, where outer cover layer 1325 is made from a different material than the groove material 1335. Accordingly, in a particular embodiment, outer cover layer 1325 may comprise an ionomer while groove material 1335 may comprise a polyurethane. Generally, as is known to a person having ordinary skill in the art, a polyurethane material may be more compressible than an ionomer material.

In some embodiments, groove material 1335 may have a hardness that is different than the hardness of outer cover layer 1325. For example, in some embodiments, groove material 1335 may have a hardness that is lower than the hardness of outer cover layer material 1325. Specifically, in one embodiment, groove material 1335 may comprise a polyurethane while outer cover layer 1325 may comprise an ionomer. As discussed variously above, a polyurethane may have a hardness that is less than a hardness of an ionomer.

In such embodiments, the harder outer cover layer material may provide durability to the outer surface 1345 of ball 1300, while the softer groove material 1335 may provide increased spin and/or feel. In other embodiments, groove material 1335 may have a hardness that is greater than the hardness of outer cover layer 1325.

The placement of the relatively compressible groove material 1335 in the cover region of ball 1300, radially displaced from the center of ball 1300, may enhance the increase in spin and/or feel provided by compressible groove material 1335. In addition, the compressible groove material 1335 may further enhance the increase in spin and/or feel in some embodiments where groove material 1335 extends radially outward beyond outer surface 1340 of outer cover layer 1325. For example, as shown in FIG. 21, an outer surface 1350 of groove material 1335 may extend radially outward beyond outer surface 1340 of outer cover layer 1325. A bulge dimension 1355, shown in FIG. 21, illustrates an exemplary amount by which outer surface 1350 of groove material 1335 may extend beyond outer surface 1340. Exemplary alternative configurations with respect to the relative placement the outer surfaces of the groove material and the outer cover layer are shown and discussed in greater detail in conjunction with other disclosed embodiments.

The cross-sectional shape and the depth of groove 1330 within outer cover layer 1325 may have a number of possible configurations, as shown and discussed with respect to several exemplary disclosed embodiments. In one possible configuration shown in FIG. 21, groove 1330 may have a curved cross-sectional shape, such that a bulged groove material 1335 appears to have an American football-shaped cross-sectional shape. In addition, in some embodiments, groove 1330 may extend partially through outer cover layer 1325, thus forming a recess in outer cover layer 1325, such that a portion 1360 of outer cover layer 1325 may extend between an inner surface 1365 of groove material 1335 and an outer surface 1370 of inner cover layer 1320, which may be a different material than outer cover layer 1325 and groove material 1335.

The bulging of groove material 1335 beyond outer surface 1340 of outer cover layer 1325 may provide at least two benefits. First, the bulging groove material 1335 may provide ball 1300 with a different surface area when struck hard, such as with a driver, than when struck more easily, such as on short game strokes. When struck hard, the compressibility of groove material 1335 may allow groove material 1335 to deflect (compress) such that outer surface 1350 of groove material 1335 becomes substantially flush with outer surface 1340 of outer cover layer 1325. Thus, the surface area of outer surface 1345 of ball 1300 that contacts the club face when struck hard, will be constituted of all of outer surface 1340 and outer surface 1350 in the area of ball 1300 struck by the club face. In such situations, since the surface area of outer cover layer 1325 may constitute a substantial majority of outer surface 1345 of ball 1300, when ball 1300 is struck hard, more of the contact area between ball 1300 and the club face will be constituted by outer surface 1340 of outer cover layer 1325. Since outer cover layer 1325 may be less compressible than groove material 1335, this may be beneficial when driving the ball, because less spin is desired for drives.

When struck lightly, groove material 1335 may not compress completely. Accordingly, a larger proportion of the surface area of ball 1300 contacting the club face will be constituted by outer surface 1350 of groove material 1335. This may provide a grippier surface of ball 1300, thus producing more spin and providing increased feel.

A second benefit is that the bulging of groove material 1335 may provide an aerodynamic effect. The bulges of groove material 1335 may disrupt airflow around ball 1300, disrupting airflow in much the same way dimples do on a conventional golf ball. In addition, the pattern of bulging groove material 1335 may induce other aerodynamic effects. For example, a spiral arrangement, such as that shown in FIG. 21, may induce a particular spin during flight. In some embodiments, this induced spin may enhance spin generated at club face contact. For example, a spiral groove material configuration may induce backspin, which enhances the backspin produced by the club face. In some embodiments, the induced spin may be counter to, or off angle from, the spin generated by the club face. For example, in some embodiments, the spiral configuration may produce a rotation about the axis of ball flight (like an American football).

In addition to aerodynamic effects provided by groove material 1335, ball 1300 may be provided with other aerodynamic effects by other structural features. For example, in some embodiments, ball 1300 may include dimples 1375 on outer surface 1340 of at least a portion of outer cover layer 1325. Alternatively, or additionally, in some embodiments, ball 1300 may have dimples in outer surface 1350 of groove material 1335 (not shown). Dimples 1375 may have any suitable configuration. In some embodiments, dimples 1375 may have an arrangement that is based on one or more dimple patterns known to those having ordinary skill in the art.

Figure 22:
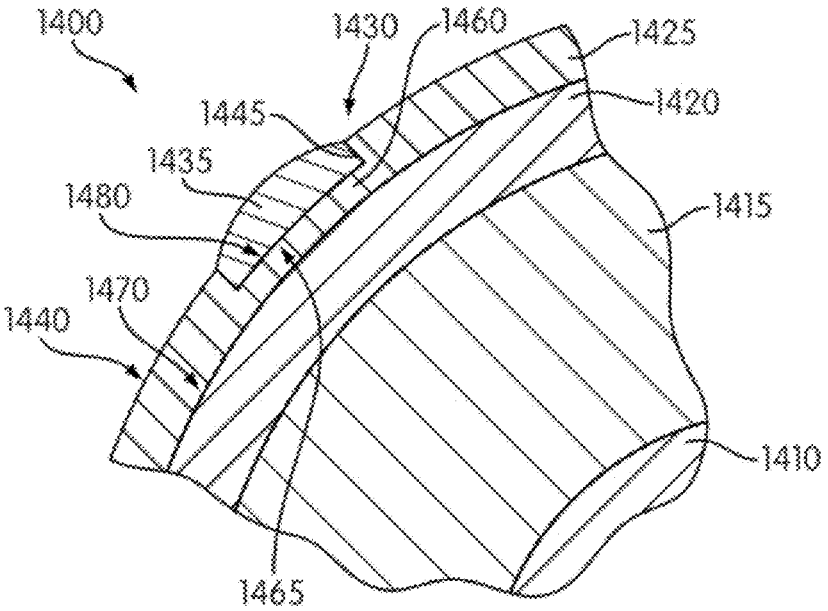
FIG. 22 shows a partial cross-sectional view of an exemplary alternative golf ball embodiment.

FIG. 22 shows an enlarged cross-sectional view of a portion of an exemplary golf ball having an alternative groove configuration. FIG. 22 illustrates an exemplary golf ball 1400. Ball 1400 may include an inner core layer 1410 and an outer core layer 1415 disposed radially outward of inner core layer 1410. In addition, ball 1400 may include an inner cover layer 1420 disposed radially outward of outer core layer 1415, and an outer cover layer 1425 disposed radially outward of inner cover layer 1420. These layers may be configured generally as discussed above with respect to FIGS. 19 and 20, as well as FIG. 21.

As shown in FIG. 22, outer cover layer 1425 of ball 1400 may include groove 1430 extending radially inward from an outer surface 1440 of outer cover layer 1425. Ball 1400 may also include a groove material 1435 disposed within groove 1430. Groove 1430 may have any suitable configuration, such that the outer surface of groove material 1435 may have any suitable shape, including for example, round, elongate, rectangular, oval, polygonal, or any other suitable shape. Groove material 1435 may have performance characteristics, such as compressibility, that are the same or similar to those discussed above with respect to groove material 1335.

Similar to the embodiment shown in FIG. 21, groove material 1435 may be bulged beyond an outer surface 1440 of outer cover layer 1425, as shown in FIG. 22. Groove material 1430 may be formed as a recess, such that a portion 1460 of outer cover layer 1425 may extend between an inner surface 1465 of groove material 1435 and an outer surface 1470 of inner cover layer 1420.

Groove 1430 may have side walls 1445. In some embodiments, side walls 1445 may be angled with respect to outer surface 1440 of outer cover layer 1425. For example, as shown in FIG. 22, side walls 1445 may be oriented substantially radially, that is, substantially perpendicular to outer surface 1440. Other similar embodiments may implement side walls that are parallel to one another and, therefore, not precisely radial. Such radial and parallel configurations may provide durability under shear loads (loads on groove material 1435 that are substantially tangential to the outer surface of the ball). Radially oriented side walls 1440 may retain groove material 1435 in groove 1430 under shear loads by providing lateral support against groove material 1435.

Also unlike groove 1330 in FIG. 21, groove 1430 may have a substantially planar bottom surface 1480, as shown in FIG. 22. A planar bottom surface (as opposed to a curved bottom surface as shown in FIG. 21) may accommodate a larger amount of groove material, which may be desirable to provide increased spin and/or feel. Additionally, a planar bottom surface may be easier to manufacture, for example, via molding or machining.

Figure 23:
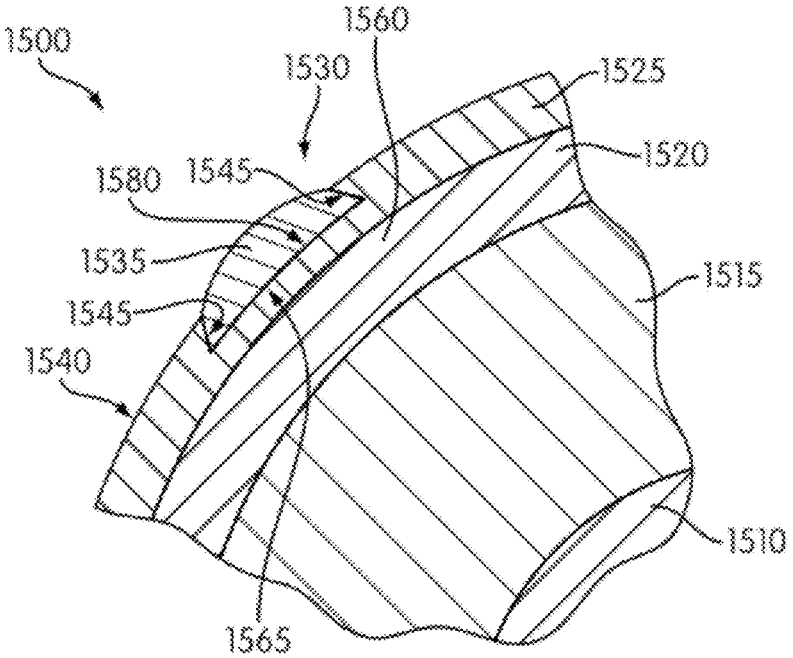
FIG. 23 shows a partial cross-sectional view of an exemplary alternative golf ball embodiment.

FIG. 23 illustrates a similar embodiment to that shown in FIG. 22. FIG. 23 shows a golf ball 1500 having an inner core layer 1510, an outer core layer 1515, an inner cover layer 1520, and an outer core layer 1525. Ball 1500 may also include a groove 1530, and a groove material 1535 disposed within groove 1530. As shown in FIG. 23, groove material 1535 may be bulged beyond an outer surface 1540 of outer cover layer 1525, and thus, may have an outward facing surface that is substantially similar to groove material 1435 in FIG. 22.

As illustrated in FIG. 23, ball 1500 may include side walls 1545 that are angled with respect to outer surface 1540 of outer cover layer 1525. In some embodiments, opposing side walls 1545 may be angled closer to one another near outer surface 1540 of outer cover layer 1525. Having side walls 1545 angled in this manner may increase durability by providing additional retention of groove material 1535 in groove 1530 under loading.

As also illustrated in FIG. 23, an inner surface 1565 of groove material 1535 and mating bottom surface 1580 of groove 1530 may be curved in an arc about the center of ball 1500. Accordingly, the thickness of the portion 1560 of outer cover layer 1525 may be consistent across substantially the entire groove 1530. This may provide predictability regarding the structural properties of the assembly.

In some embodiments, grooves may extend completely through the outer cover layer of the golf ball. In some such embodiments, the inner surface of the groove material may be in contact with the outer surface of the inner cover layer. In other embodiments, a portion of an underlying, inner cover layer may extend radially outward into (and in some cases through) the groove to form the groove material. These configurations may provide still further increases in manufacturability and/or durability of the assembly.

Figure 24:
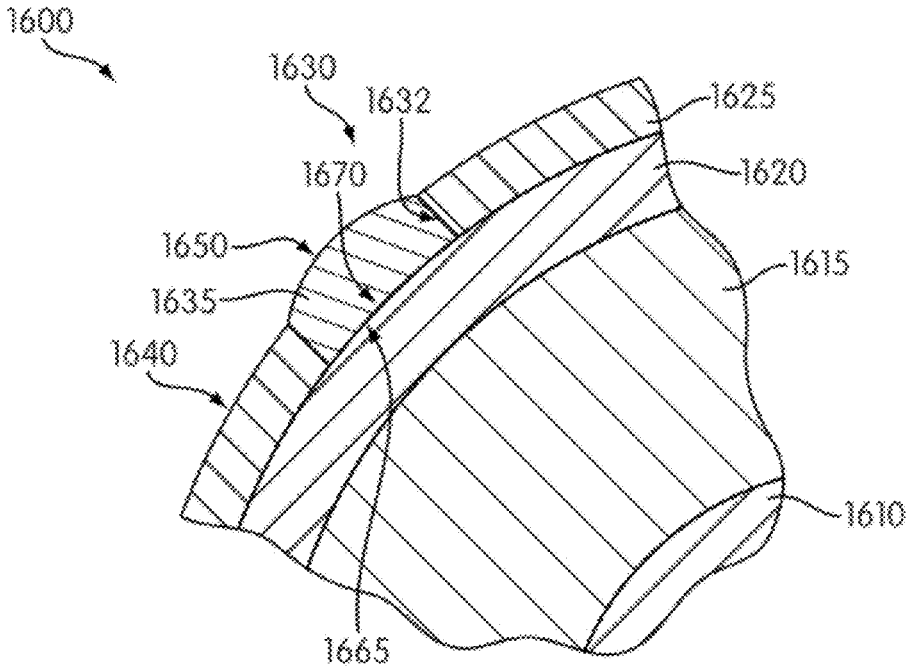
FIG. 24 shows a partial cross-sectional view of an exemplary alternative golf ball embodiment.

FIG. 24 is an enlarged, partial cross-sectional view of a golf ball having a bulged groove material disposed within a groove that extends completely through the outer cover of the ball. FIG. 24 shows a golf ball 1600, having an inner core layer 1610, an outer core layer 1615, an inner cover layer 1620, and an outer core layer 1625. Ball 1600 may also include a groove 1630, and a groove material 1635 disposed within groove 1630. As shown in FIG. 24, an outer surface 1650 of groove material 1635 may extend radially outward beyond an outer surface 1640 of outer cover layer 1625. As illustrated in FIG. 24, groove 1630 may extend completely through outer cover layer 1625. Accordingly, an inner surface 1665 of groove material 1635 may be in contact with an outer surface 1670 of inner cover layer 1620.

Figure 25:
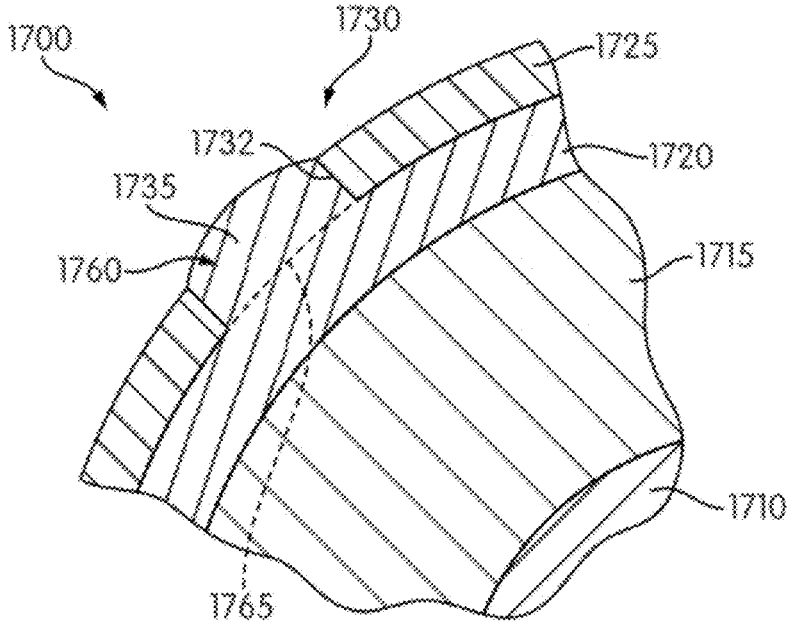
FIG. 25 shows a partial cross-sectional view of an exemplary alternative golf ball embodiment.

FIG. 25 illustrates an enlarged, partial cross-sectional view of another golf ball embodiment featuring a bulging groove material disposed within a groove that extends completely through the outer cover layer. FIG. 25 shows a golf ball 1700, having an inner core layer 1710, an outer core layer 1715, an inner cover layer 1720, and an outer core layer 1725. Ball 1700 may also include a groove 1730, and a groove material 1735 disposed within groove 1730. As shown in FIG. 25, in some embodiments, groove material 1735 may be formed by a portion 1760 of the inner cover layer material that extends radially outward into groove 1730. For purposes of illustration, FIG. 17 includes a dashed line 1765 to delineate a boundary between inner cover layer 1720 and groove material 1735.

In some embodiments, groove material may be recessed from the outer surface of the outer cover layer. In some such embodiments, the outer cover layer may be formed of a more compressible material than the groove material. This configuration may operate on similar principles to embodiments, wherein a bulging groove material is more compressible than an outer cover layer into which it is molded. In some embodiments, this may provide a larger surface area of the ball formed of the more compressible material. Thus, such an embodiment could be implemented to provide even greater amounts of spin and/or feel.

In some embodiments, recessed groove material may be formed of a material that is more compressible than the outer cover layer. For example, the outer cover layer may be an ionomer when the groove material is a polyurethane. Such configurations may be implemented to provide a golf ball with a more durable outer surface. In a recessed groove material embodiment, contact between the outer surface of the groove material with clubs and the ground may be limited. By having a less compressible, and possibly harder, material disposed further radially outward than the more compressible groove material, and thus, exposed to more contact with the clubs and the ground, a more durable material may be subjected to a substantial majority of the abuse.

In addition to the benefits (discussed above) of adding a compressible material in the cover region of a golf ball having a recessed groove material, the recesses in the grooves may also provide an aerodynamic effect. As discussed above regarding the embodiment shown in FIG. 21, like bulged groove material, recesses in grooves may provide disruption of airflow at boundary layers (similar to dimples). Also like bulged groove material, recesses in grooves may be arranged to provide other aerodynamic effects, such as by inducing spin.

Figure 26:
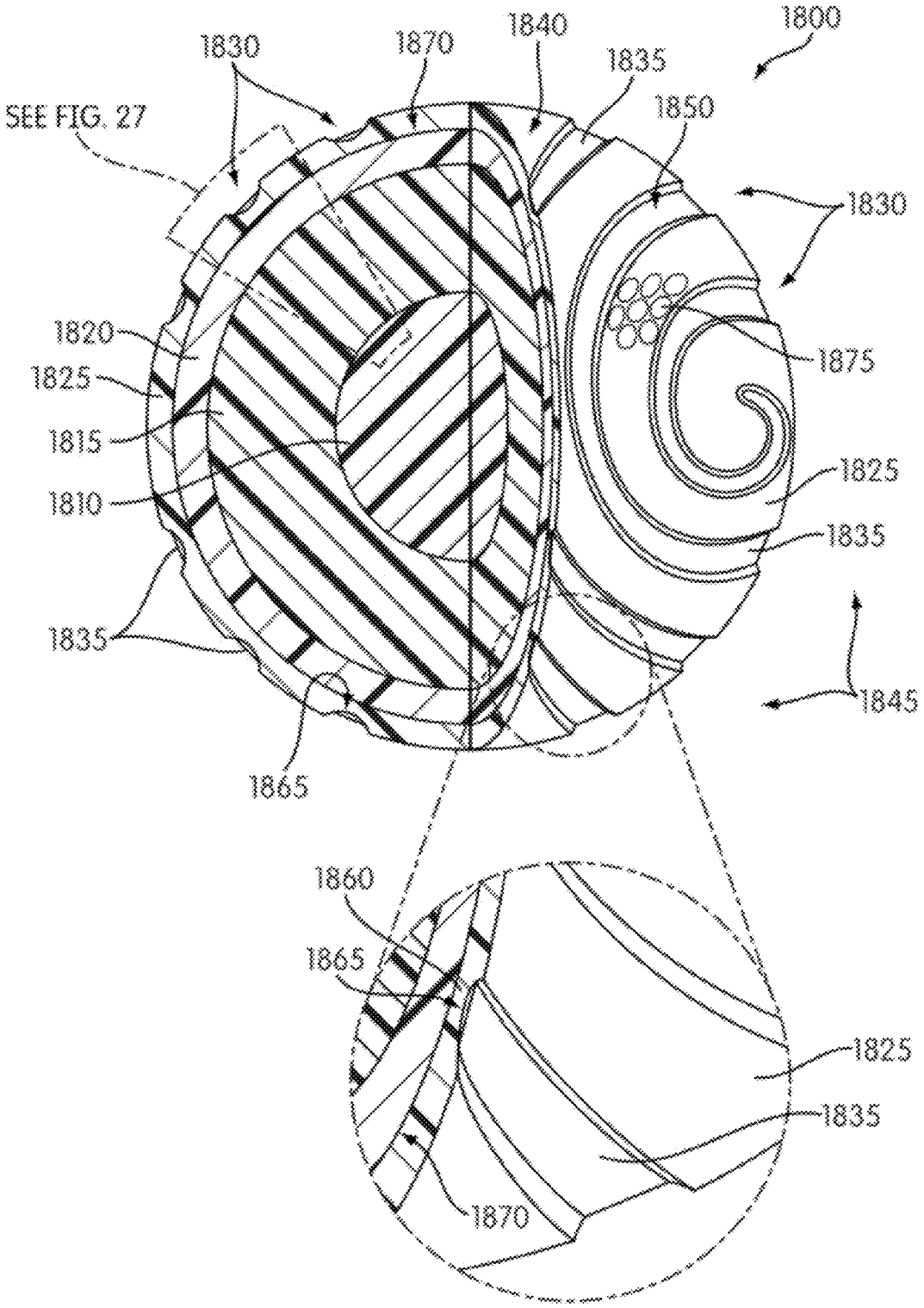
FIG. 26 shows a cutaway, partial cross-sectional view of an alternative golf ball embodiment having material-filled spiral grooves in an outer layer.

FIG. 26 illustrates an exemplary embodiment including a recessed groove material. FIG. 26 shows a golf ball 1800, having an inner core layer 1810, an outer core layer 1815, an inner cover layer 1820, and an outer core layer 1825. Ball 1800 may also include a groove 1830, and a groove material 1835 disposed within groove 1830. As shown in FIG. 26, in some embodiments, an outer surface 1850 of groove material 1835 may be recessed from an outer surface 1840 of outer cover layer 1825.

Groove material 1835 may have a compressibility, and/or hardness, that are different than outer cover layer 825. In some embodiments, outer cover layer 1825 may be more compressible than groove material 1835. For example, as mentioned above with respect to other embodiments, outer cover layer 1825 may comprise a polyurethane while groove material 1835 may comprise an ionomer. In other embodiments, groove material 1835 may be more compressible than outer cover layer 1825. For example, again as mentioned above with respect to other embodiments, outer cover layer 1825 may comprise an ionomer while groove material 1835 may comprise a polyurethane. In determining whether to utilize a more compressible material for outer cover layer 1825 or for groove material 1835, a ball designer may consider, as a factor, the desirability of performance characteristics provided by a more compressible material (e.g., spin, feel, control), and performance characteristics provided by a less compressible material (e.g., distance, durability). In order to achieve more compressible material characteristics, the more compressible material may be used to form outer cover layer 1825, which generally makes more contact with the club face. In order to achieve more incompressible material characteristics, the less compressible material may be used to form outer cover layer 1825.

Performance characteristics may also be determined by the relative surface areas of outer cover layer 1825 and groove material 1835 that make up the overall outer surface 1845 of ball 1800. For example, although a more compressible material may be utilized for recessed groove material 1835, the ball may be provided with more compressible material characteristics by making grooves 1830 wider and providing a higher ratio of groove material surface area to outer cover layer surface area.

Figure 27:
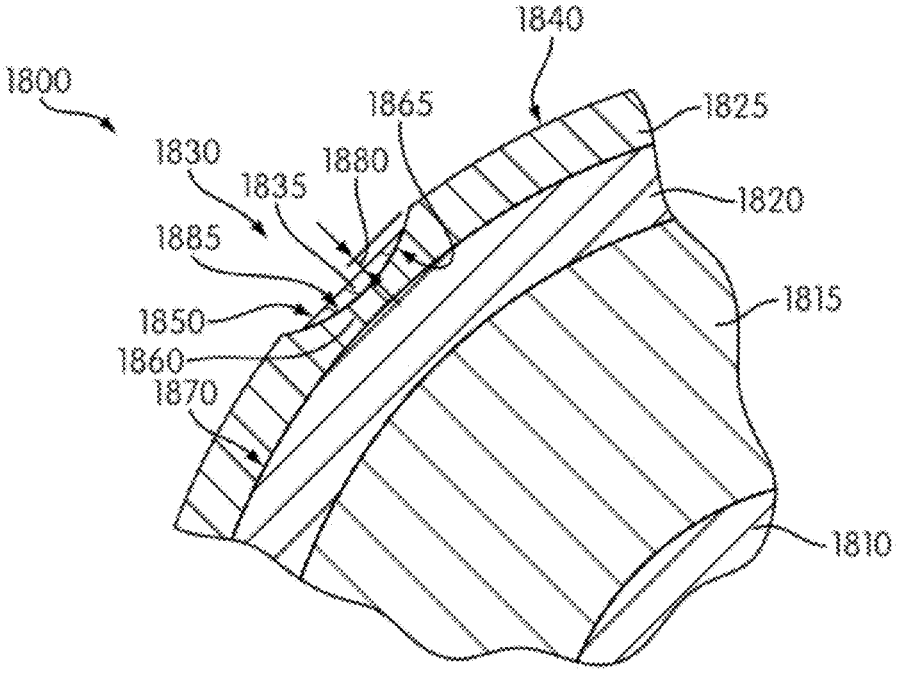
FIG. 27 shows a partial cross-sectional view of an exemplary alternative golf ball embodiment.

Groove 1830 may have any suitable shape. As shown in FIG. 26, groove 1830 may be arranged in a spiral configuration similar to groove 1330 in FIG. 21. In addition, groove 1830 may have any suitable cross-sectional shape. FIG. 27 is an enlarged view of a portion of ball 1800, showing an exemplary cross-sectional shape of groove 1830. As shown in FIG. 27, in some embodiments, groove 1830 may have a curved bottom surface 1885. As further illustrated in FIG. 27, groove 1830 may be formed as a recess in outer cover layer 1825. Therefore, a portion 1860 of outer cover layer 1825 may extend between an inner surface 1865 of groove material 1835 and an outer surface 1870 of inner cover layer 1820. As can also be seen in FIG. 27, an outer surface 1850 of groove material 1835 may be recessed from outer surface 1840, as illustrated by a dimension 1880.

Golf ball 1800 may also include other surface features. For example, in some embodiments, ball 1800 may include dimples 1875 on at least a portion of outer surface 1840 of outer cover layer 1825 or in other portions of golf ball 1800.

Figure 28:
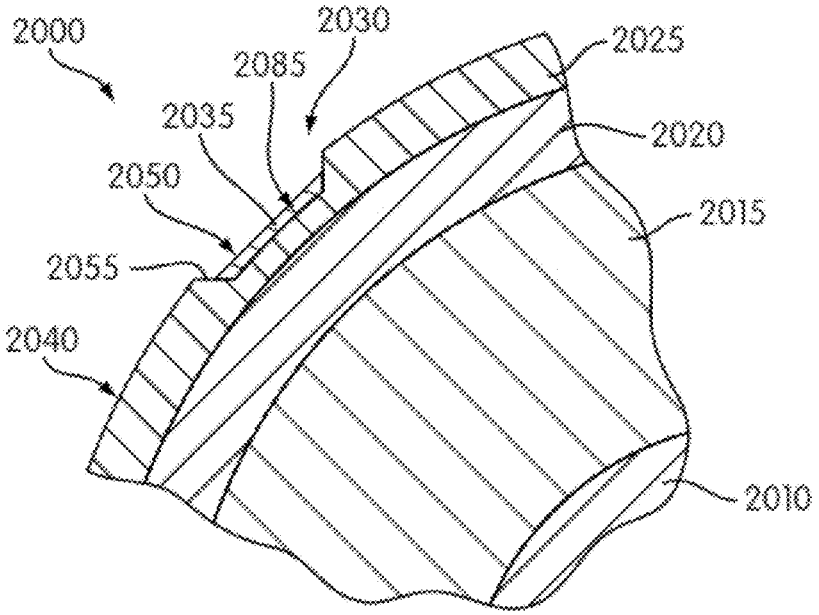
FIG. 28 shows a partial cross-sectional view of an exemplary alternative golf ball embodiment.
Figure 29:
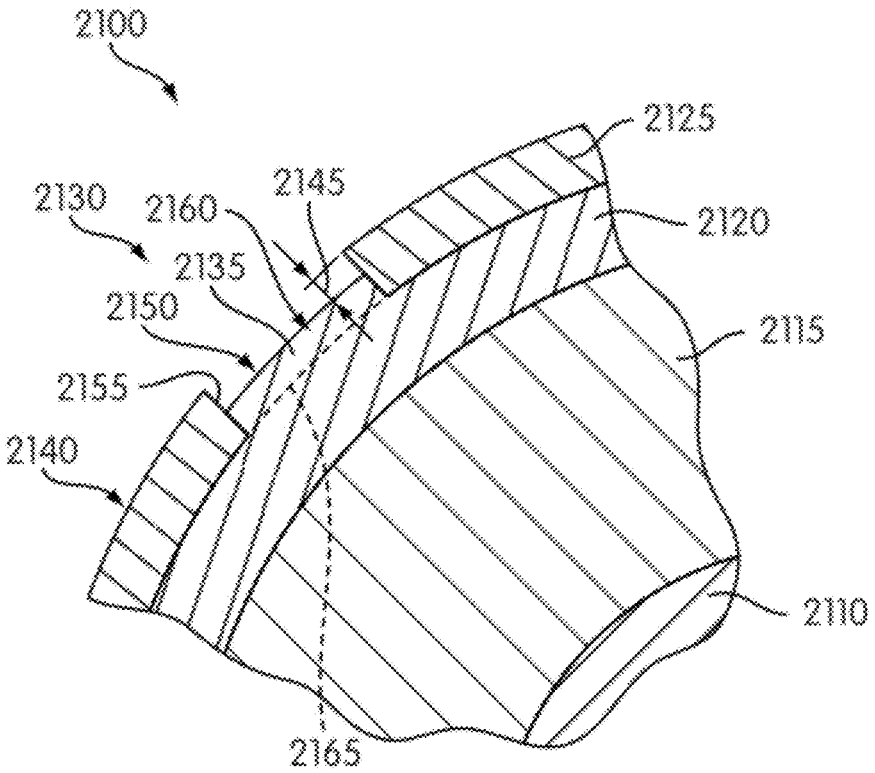
FIG. 29 shows a partial cross-sectional view of an exemplary alternative golf ball embodiment.

FIGS. 28 and 29 show enlarged, cross-sectional views of exemplary alternative groove configurations having recessed groove material. FIG. 28 illustrates an embodiment wherein the groove has beveled or angled side walls. FIG. 28 shows a golf ball 2000, having an inner core layer 2010, an outer core layer 2015, an inner cover layer 2020, and an outer core layer 2025. Ball 2000 may also include a groove 2030, and a groove material 2035 disposed within groove 2030. As shown in FIG. 28, in some embodiments, an outer surface 2050 of groove material 2035 may be recessed from an outer surface 2040 of outer cover layer 2025.

In some embodiments, groove 2030 may have sidewalls 2055 that are angled relative to outer surface 2040 of outer cover layer 2025. In some embodiments, opposing sidewalls 2055 may be angled farther away from one another at outer surface 2040 of outer cover layer 2025, as shown in FIG. 28. In some embodiments, a bottom surface 2085 of groove 2030 may be curved about the center of ball 2000, as also shown in FIG. 28.

FIG. 29 illustrates an embodiment wherein the groove extends completely through the outer cover layer. FIG. 29 shows a golf ball 2100, having an inner core layer 2110, an outer core layer 2115, an inner cover layer 2120, and an outer core layer 2125. Ball 2100 may also include a groove 2130, and a groove material 2135 disposed within groove 2130. As shown in FIG. 29, in some embodiments, an outer surface 2150 of groove material 2135 may be recessed from an outer surface 2140 of outer cover layer 2125. This is illustrated by a dimension 2145. Outer surface 2150 of groove material 2135 is illustrated as being curved about the center of ball 2100. However, it may also be possible for outer surface 2150 to be substantially planar.

As shown in FIG. 29, in some embodiments, groove 2130 may be defined by side walls 2155 and may extend completely through outer cover layer 2125. Also, in some embodiments, groove material 2135 may be formed by a portion 2160 of inner cover layer material that extends radially outward into groove 2130. A dashed line 2165 illustrates a boundary between inner cover layer 2125 and portion 1160 forming groove material 2135.

Figure 30:
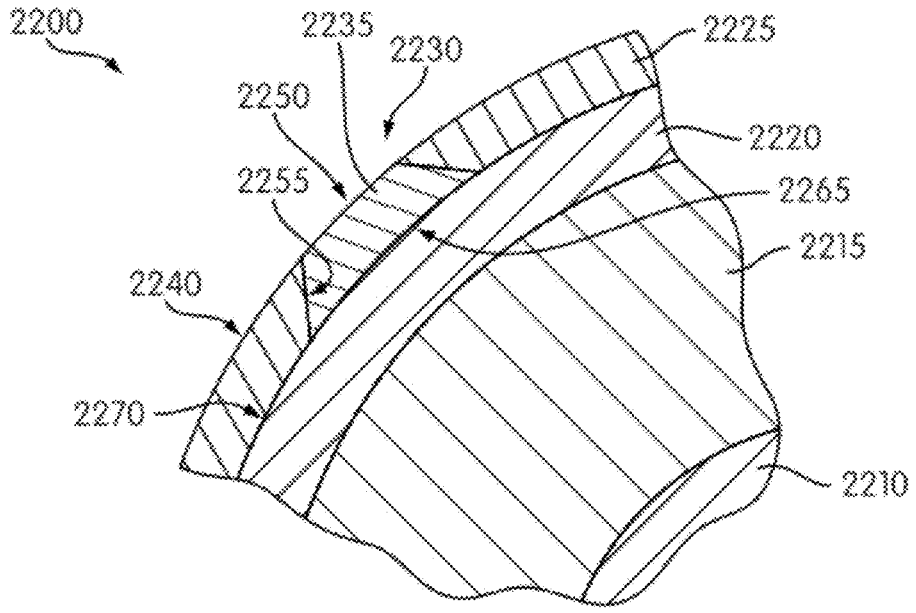
FIG. 30 shows a partial cross-sectional view of an exemplary alternative golf ball embodiment.
Figure 31:
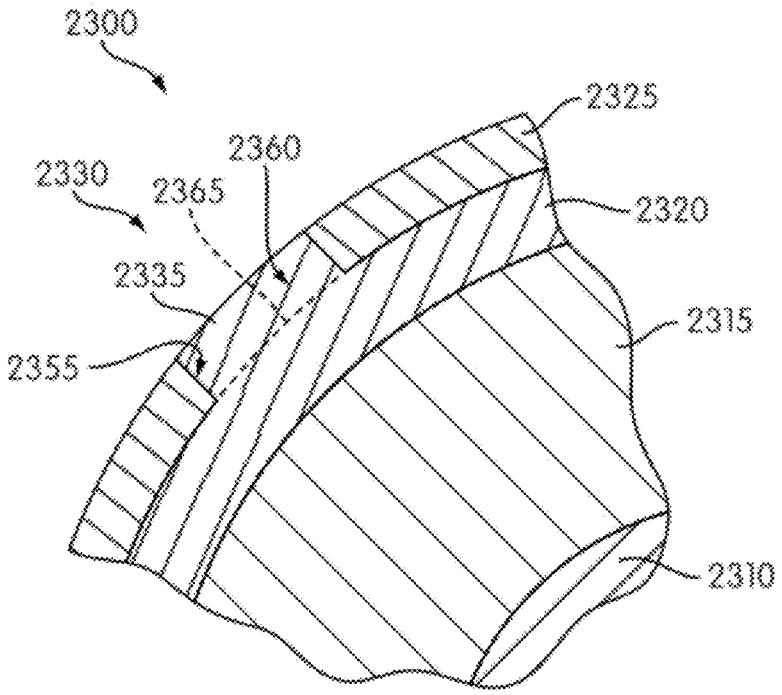
FIG. 31 shows a partial cross-sectional view of an exemplary alternative golf ball embodiment.

FIGS. 30 and 31 illustrate enlarged, cross-sectional views of exemplary groove configurations, wherein the groove material is substantially flush with the outer surface of the outer cover layer. The benefits and considerations of having groove material bulging or recessed are discussed above. The same considerations are also relevant to flush embodiments. In some cases, having flush groove material may provide a suitable compromise between bulged and recessed groove material configurations. Flush embodiments may also be easier to manufacture, and may produce a golf ball that appears to have a more traditional outer surface shape.

FIG. 30 shows a golf ball 2200, having an inner core layer 2210, an outer core layer 2215, an inner cover layer 2220, and an outer core layer 2225. Ball 2200 may also include a groove 2230, and a groove material 2235 disposed within groove 2230. As shown in FIG. 30, in some embodiments, an outer surface 2250 of groove material 2235 may be substantially flush with an outer surface 2240 of outer cover layer 2225. In addition, groove 2230 may include angled side walls 2255.

As also shown in FIG. 30, in some embodiments, groove 2230 may extend completely through outer cover layer 2225. Accordingly, an inner surface 2265 of groove material 2235 may be in contact with an outer surface 2270 of inner cover layer 2220.

FIG. 31 shows a golf ball 2300, having an inner core layer 2310, an outer core layer 2315, an inner cover layer 2320, and an outer core layer 2325. Ball 2300 may also include a groove 2330, and a groove material 2335 disposed within groove 2330. As illustrated in FIG. 31, in some embodiments, groove 2330 may be defined by side walls 2355 and may extend completely through outer cover layer 2325. In addition, in some embodiments, groove material 2335 may be formed by a portion 2360 of inner cover layer material that extends radially outward from the center of ball 2300. Portion 2360 is generally delineated by a dashed line 2365 in FIG. 31.

Figure 32:
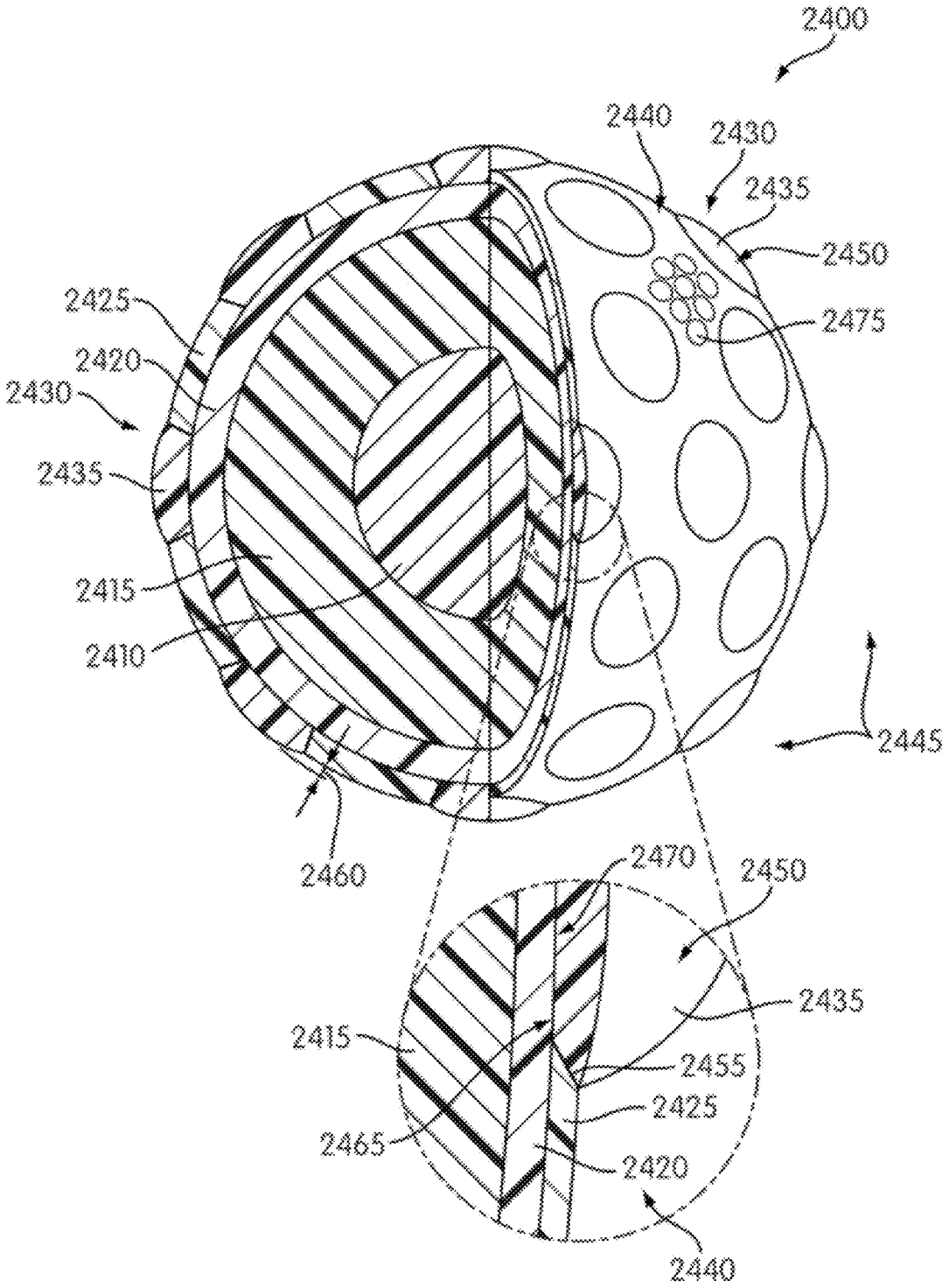
FIG. 32 shows a cutaway, partial cross-sectional view of an exemplary golf ball having material-filled, circular grooves in an outer layer.

FIG. 32 illustrates an alternative embodiment having bulged groove material. FIG. 32 shows a golf ball 2400, having an inner core layer 2410, an outer core layer 2415, an inner cover layer 2420, and an outer core layer 2425. Ball 2400 may also include a groove 2430, and a groove material 2435 disposed within groove 2430.

As shown in FIG. 32, in some embodiments, grooves 2430 (and the bulging groove material 2435 associated with each groove 2430) may be substantially circular. It will be understood that grooves 2430 may have any other suitable shape, such as squares, rectangles, triangles, and any other suitable shape.

Outer surfaces 2440 of outer cover layer 2425 and outer surfaces 2450 of groove material 2435 may constitute an outer surface 2445 of ball 2400. The size of grooves 2430 may vary and, accordingly, the ratio of surface area between outer surface 2440 and outer surface 2450 may also be varied to provide the desired performance characteristics.

Groove material 2435 may bulge beyond outer surface 2440 as indicated by a dimension 2460. In addition, grooves 2430 may include side walls 2455 that are angled with respect to outer surface 2440 of outer cover layer 2425.

As shown in FIG. 32, in some embodiments, grooves 2430 may extend completely through outer cover layer 2425. Accordingly, an inner surface 2465 of groove material 2435 may be in contact with an outer surface 2470 of inner cover layer 2420.

Golf ball 2400 may also include other surface features. For example, in some embodiments, ball 2400 may include dimples 2475 on at least a portion of outer surface 2440 of outer cover layer 2425 or in other portions of golf ball 2400.

Figure 33:
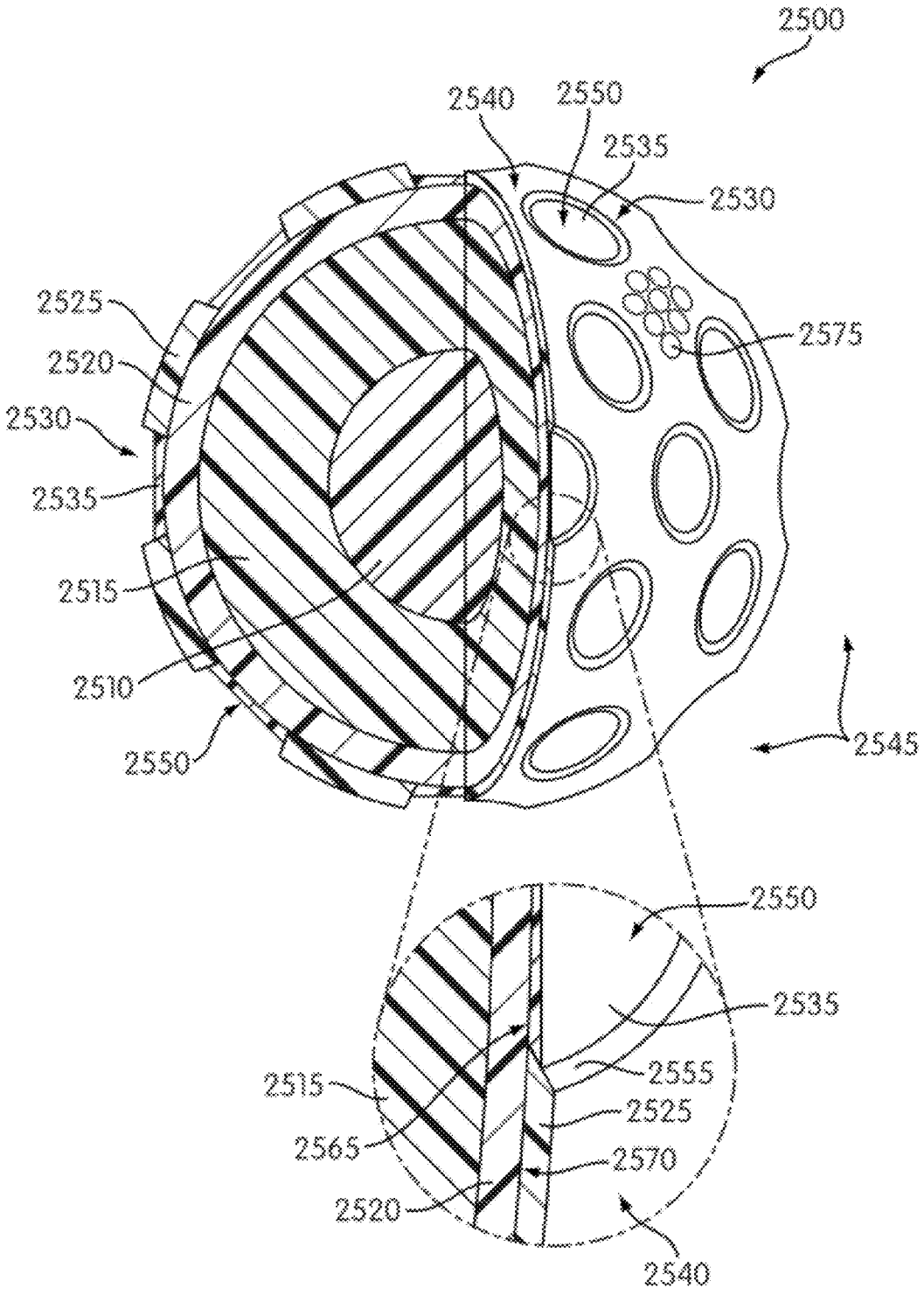
FIG. 33 shows a cutaway, partial cross-sectional view of an alternative golf ball embodiment having material-filled, circular grooves in an outer layer.

FIG. 33 illustrates a golf ball embodiment similar to ball 2400, but having recessed groove material. FIG. 33 shows a golf ball 2500, having an inner core layer 2510, an outer core layer 2515, an inner cover layer 2520, and an outer core layer 2525. Ball 2500 may also include a groove 2530, and a groove material 2535 disposed within groove 2530.

As shown in FIG. 33, in some embodiments, grooves 2530 (and the groove material 2535 associated with each groove 2530) may be substantially circular. It will be understood that grooves 2530 may have any other suitable shape, such as squares, rectangles, triangles, and any other suitable shape.

Outer surfaces 2540 of outer cover layer 2525 and outer surfaces 2550 of groove material 2535 may constitute an outer surface 2545 of ball 2500. The size of grooves 2530 may vary and, accordingly, the ratio of surface area between outer surface 2540 and outer surface 2550 may also be varied to provide the desired performance characteristics.

Outer surface 2550 of groove material 2535 may be recessed from outer surface 2540. In some embodiments, outer surfaces 2550 of groove material 2535 may be substantially planar, as shown in FIG. 33. In other embodiments, outer surfaces 2550 may curve about the center of ball 2500. In addition, grooves 2530 may include side walls 2555 that are angled with respect to outer surface 2540 of outer cover layer 2525.

As shown in FIG. 33, in some embodiments, grooves 2530 may extend completely through outer cover layer 2525. Accordingly, an inner surface 2565 of groove material 2535 may be in contact with an outer surface 2570 of inner cover layer 2520.

Golf ball 2500 may also include other surface features. For example, in some embodiments, ball 2500 may include dimples 2575 on at least a portion of outer surface 2540 of outer cover layer 2525 or in other portions of golf ball 2500.

Figure 34:
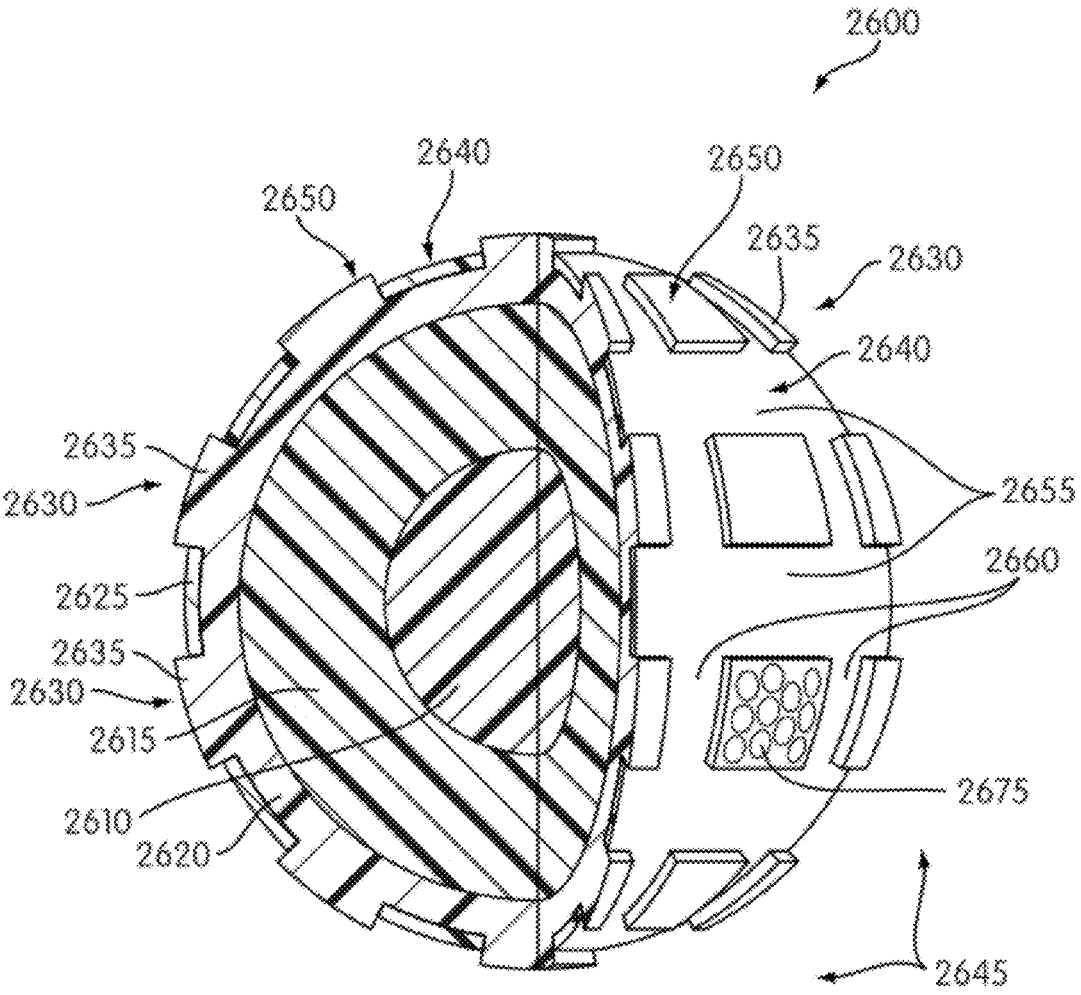
FIG. 34 shows a cutaway, partial cross-sectional view of an exemplary golf ball having a material-filled recessed grid in an outer layer.

FIG. 34 illustrates an alternative embodiment wherein the outer cover layer is formed as a grid defining grooves between the gridlines. FIG. 34 shows a golf ball 2600, having an inner core layer 2610, an outer core layer 2616, an inner cover layer 2620, and an outer core layer 2625. Ball 2600 may also include a groove 2630, and a groove material 2635 disposed within groove 2630.

As shown in FIG. 34, an outer surface 2640 of outer cover layer 2625 and an outer surface 2650 of groove material 2635 may form the overall outer surface 2645 of ball 2600. In some embodiments, outer surface 2650 of groove material 2635 may extend beyond outer surface 2640 of outer cover layer 2625. This configuration may operate on similar principles to the bulged groove material embodiments discussed above.

In some embodiments, outer cover layer 2625 may be formed as a grid, wherein the gridlines of the grid are formed by intersecting bands of material. For example, a first set of bands 2655 may intersect with a second set of bands 2660. Grid bands 2655 and 2660 may have any suitable configuration and orientation. As shown in FIG. 34, grid bands 2655 may be oriented as latitudinal gridlines. In other embodiments, grid bands 2655 may be oriented differently, such as longitudinally. Also, as shown in FIG. 1634 grid bands 2660 may be oriented longitudinally. In other embodiments, grid bands 2660 may be oriented differently, such as latitudinal.

The openings in the outer cover layer grid may define grooves 2630. In some embodiments, as shown in FIG. 34, groove material 2635 may be formed by portions of inner cover layer 2620 that extend radially outward into grooves 2630.

In some embodiments, groove material 2635 may be more compressible than outer cover layer 2625. In other embodiments, groove material 1635 may be less compressible than outer cover layer 2625. The advantages of each such configuration are discussed above in conjunction with other similar embodiments.

Golf ball 2600 may also include other surface features. For example, in some embodiments, ball 2600 may include dimples 2675 on at least a portion of outer surface 2640 of outer cover layer 2625 or in other portions of golf ball 2600.

The disclosed golf ball embodiments as shown in FIGS. 19-34 may be manufactured in several different ways. The following discussion provides details regarding exemplary processes for making certain disclosed embodiments. Many of the provided details apply generally for making golf balls having grooves and groove material.

The layers of a golf ball may be made using any of a number of molding processes, such as injection molding and compression molding. In some embodiments, outer layers may be molded on top of pre-molded inner layers. In some embodiments, an inner layer may be injection molded within a pre-molded outer shell.

In addition, pre-formed inner and/or outer layers may be supported during the process of co-molding an adjacent layer using a plurality of support pins. In some embodiments, the support pins may be a retractable part of the mold apparatus. In some embodiments, the support pins may be extensions of the pre-molded layer. For example, in some embodiments, support mold pins may be formed as part of a core layer and may meld with inner cover layer material during injection of the inner cover layer material. In such embodiments, the support pins may be formed of a material that is readily compatible with the material of the layer to be added. This compatibility may prevent or inhibit the formation of voids and/or delamination at the pin sites.

Use of support pins in molding processes are well-known in the art and, accordingly, one of ordinary skill would readily recognize support pin configurations that may be suitable for use in the methods described below.

An exemplary method of making a golf ball according to the present disclosure may include molding at least one core layer. In some embodiments the method may include molding multiple core layers, such as an inner core layer and an outer core layer. The formation of these core layers may be accomplished by injection molding and/or compression molding. Various techniques for forming golf ball core layers will be readily recognized by those having ordinary skill in the art.

In addition, the method may also include molding an outer cover layer radially outward of the core layer. The molding of this outer cover layer may be performed using injection molding or compression molding. In some embodiments, the method may include formation of an inner cover layer radially inward of the outer cover layer. In some embodiments, the inner cover layer may be formed first, and the outer cover layer may be molded afterward. In other embodiments, the outer cover layer may be pre-molded as a shell and then the inner cover layer may be injection molded under the pre-molded shell between the outer cover layer and the core layers. In some embodiments, the shell may be formed as two hemispherical shells, in order to enable a pre-molded core to be placed inside the shell before injecting the inner cover layer material.

Figure 35:
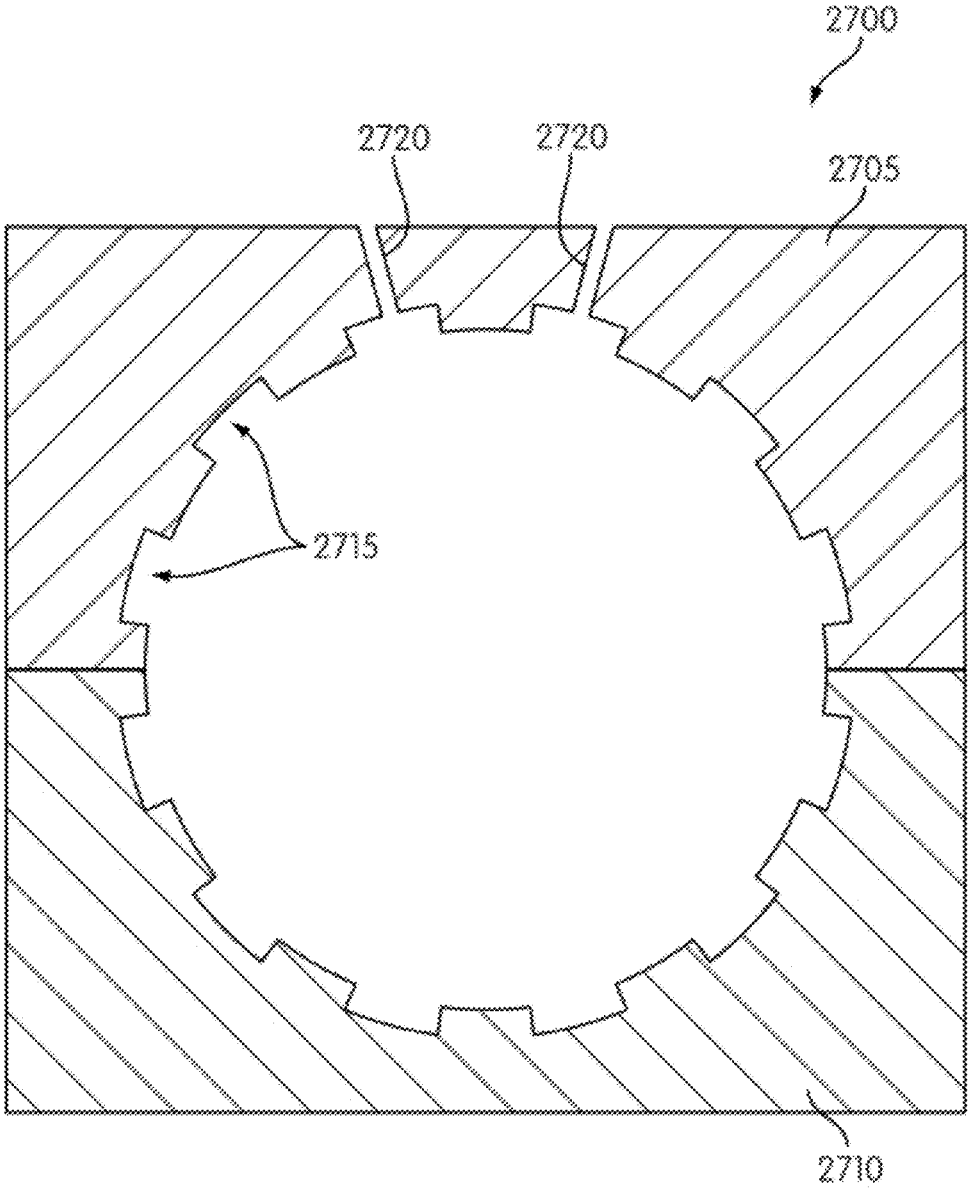
FIG. 35 shows a cross-sectional view of a mold for a golf ball.
Figure 36:
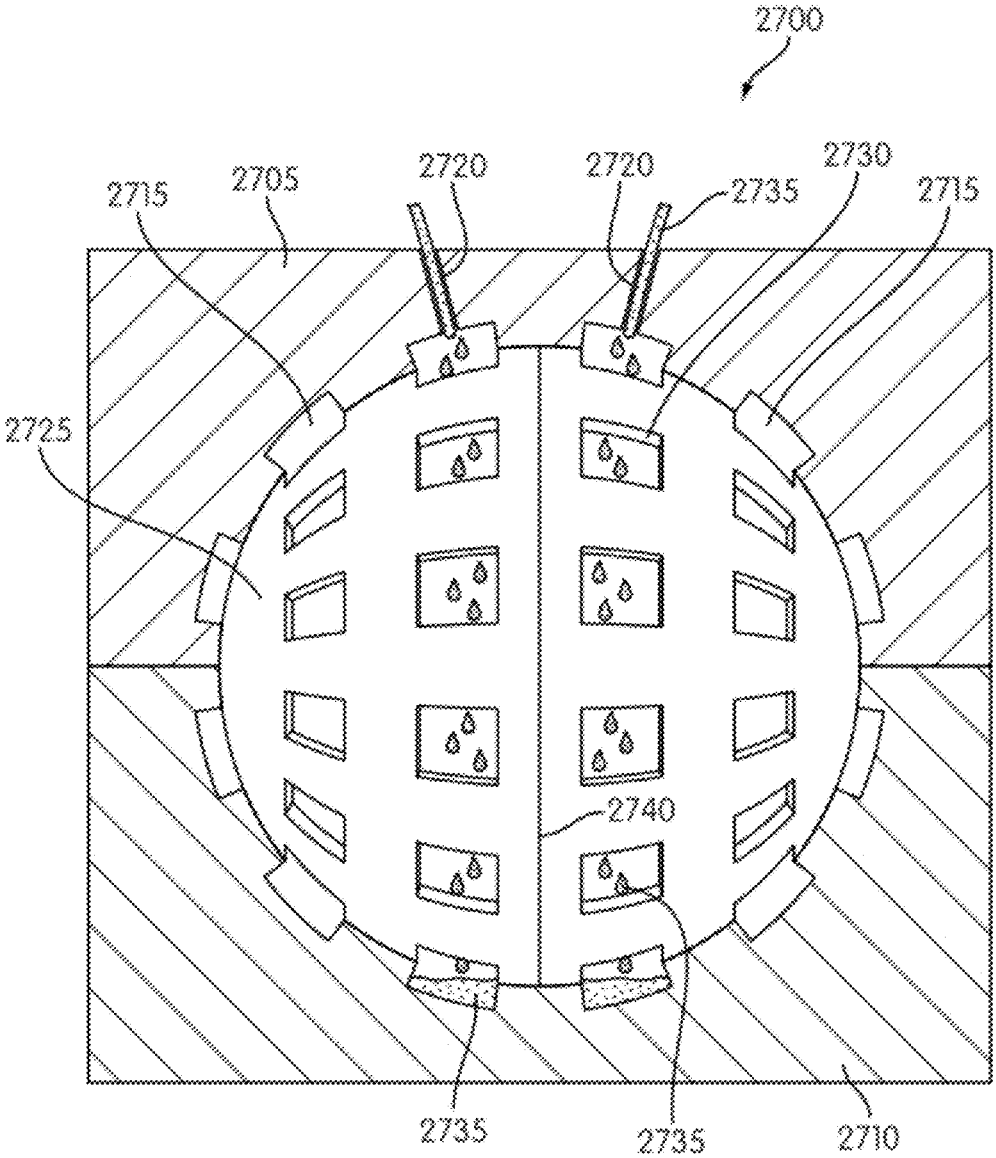
FIG. 36 shows a partial cross-sectional view of an apparatus and method for molding components of a golf ball.

FIGS. 35 and 36 illustrate an apparatus and method for molding a golf ball according to the embodiment shown in FIG. 34, wherein an inner cover layer is injection molded under and through a pre-formed, grid-like outer cover layer. FIG. 35 shows a cross-sectional view of a mold 2700, including a first mold section 2705 and a second mold section 2710. Mold 2700 may be used for injection molding groove material within a pre-formed grid-type shell. Accordingly, mold 2700 may include recesses 2715 which may be configured to receive injected groove material about a periphery of a pre-formed outer cover layer shell. Mold 2700 may also include one or more injection gates 2720 for injecting groove material into mold 2700.

FIG. 36 illustrates mold 2700 with an outer cover layer shell 2725 placed inside. As shown in FIG. 36, shell 2725 may be formed as two hemispherical half-shells, as indicated by an equator line 2740. In an exemplary method, the hemispherical half-shells may be snapped together about, or otherwise placed around one or more inner core layers (not shown) and then placed in mold 2700, as shown in FIG. 36. It will be noted that, for purposes of illustration, mold 2700 is shown in cross-section, whereas shell 2725 is shown in an elevation view.

The method may further include injecting a groove material 2735 through gates 2720 into the cavity within mold 2700 where it may flow into the void under shell 2725. Groove material 2735 may further flow radially outward through grooves 2730 (which may be formed completely through outer cover layer shell 2725), into recesses 2715. Molding groove material 2735 in this manner may form the groove material from portions of inner cover layer material that extend radially outward into grooves 2730.

As noted above, the groove material 2735 may be formed of a more or less compressible material than outer cover layer shell 2725.

Figure 37:
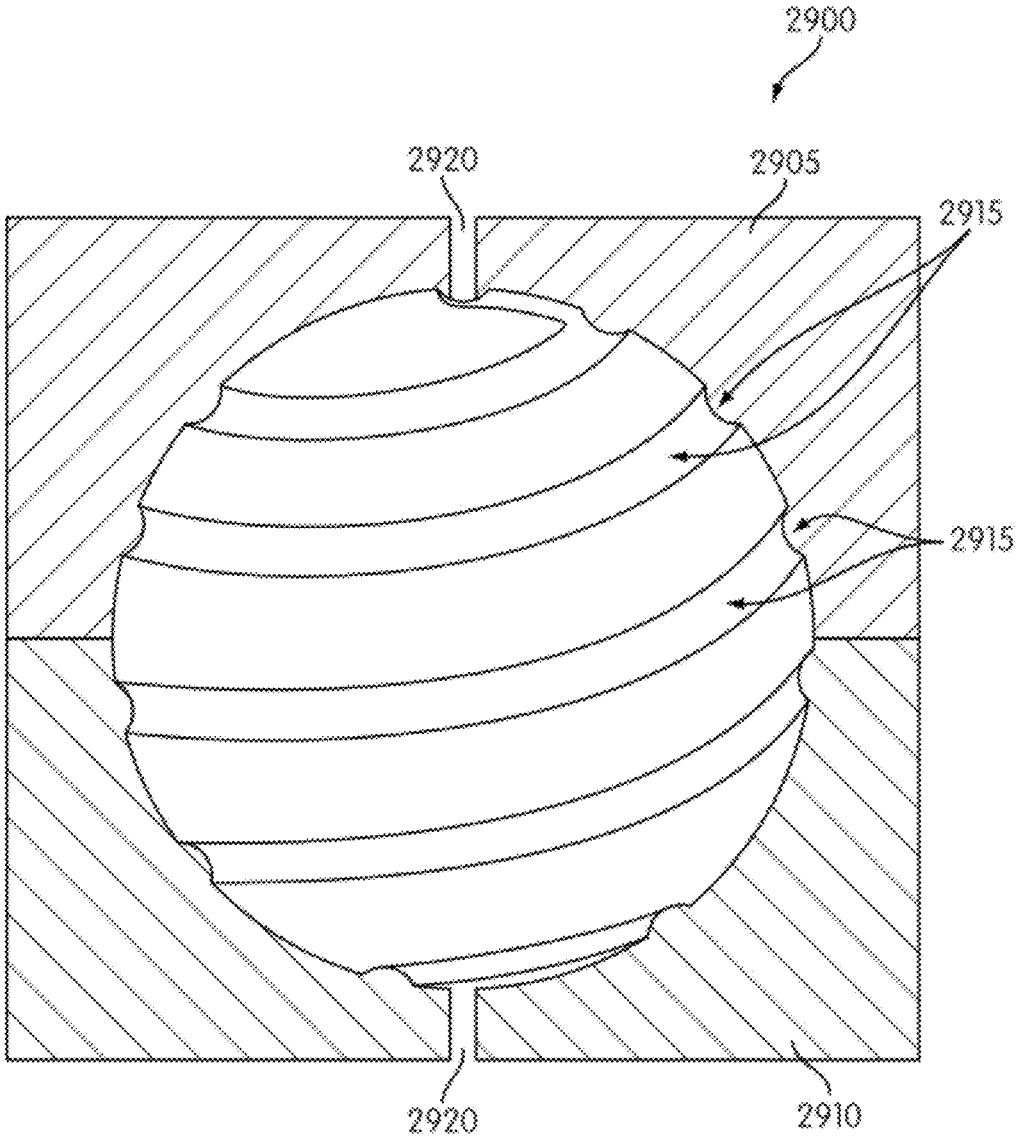
FIG. 37 shows a partial cross-sectional view of a mold for an outer cover layer of a golf ball.
Figure 38:
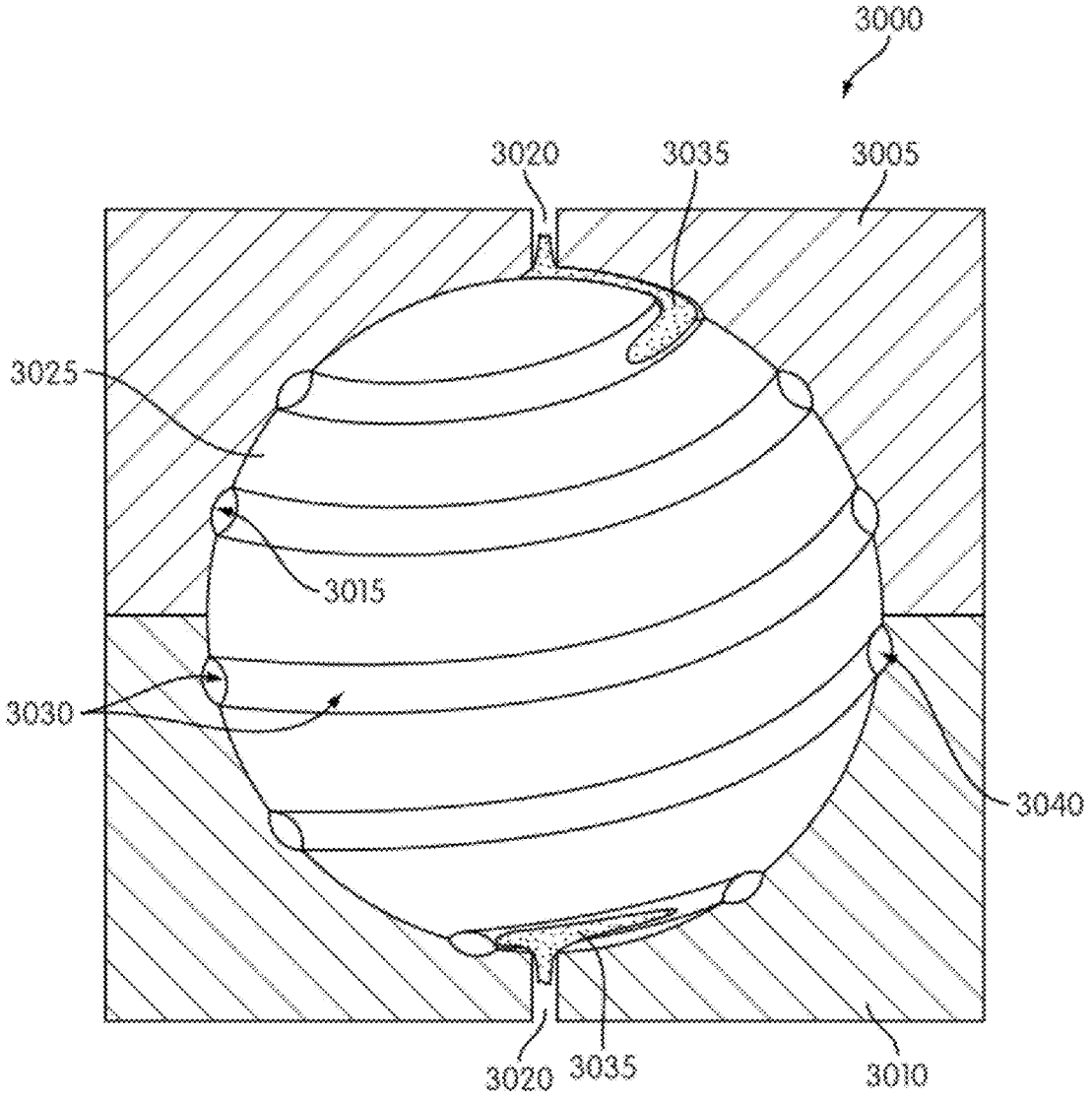
FIG. 38 shows a partial cross-sectional view of an alternative apparatus and method for molding components of a golf ball.

FIGS. 37 and 38 illustrate an apparatus and method for making a golf ball according to the embodiment shown in FIG. 21, including molding a grooved outer cover layer and molding a groove material into recess grooves on the pre-molded outer cover layer. FIG. 37 illustrates an outer cover layer mold 2900 configured to pre-mold the outer cover layer. Mold 2900 may include a first mold section 2905, and a second mold section 2910. Mold 2900 may further include spiral protrusions 2915, which may be configured to form channel-type recess grooves, such as grooves 1330 shown in FIG. 21. It will be noted that outer portions of mold 2900 are shown in cross-section, while a spherical inner void is shown in elevation to illustrate the arrangement of spiral protrusions 2915 along the walls of the spherical void. Mold 2900 may be used to injection mold outer cover layer material into injection gates 2920 to form an outer cover layer radially outward of one or more inner core layers and, in some embodiments, radially outward of one or more inner cover layers, thus forming a pre-molded golf ball component.

FIG. 38 illustrates an exemplary method of injecting a groove material into grooves 3030 formed in a pre-molded golf ball component 3025. FIG. 38 shows a groove material mold 3000. Mold 3000 may include a first mold section 3005 and a second mold section 3010. FIG. 38 also shows pre-molded golf ball component 3025 disposed within mold 3000. As shown in FIG. 38, mold 3000 may include a spiral groove 3015 configured to correspond with grooves 3030 in component 3025 to form a spiral void 3040 configured to receive groove material. In an exemplary method, groove material 3035 may be injected via injection gates 3020 into spiral void 3040, as shown in FIG. 38. Molding groove material 3035 in this manner may form groove material 3035 in recess groove 3030 such that the outer cover layer material extends between an inner surface of groove material 3035 and an outer surface of the inner cover layer.

Similar molds and methods may be used to form golf balls having other features of embodiments discussed above. For example, exemplary methods of making golf balls may include forming the grooves completely through the outer cover layer, and molding the groove material such that an inner surface of the groove material is in contact with an outer surface of the inner cover layer. Further, similar molds and methods may be used for form the grooves in any suitable size, shape, and arrangement, including those discussed above. For example, such molds and methods may be used to form grooves having angled side walls, rounded bottom surfaces, planar bottom surfaces, and other configurations discussed above. Also, similar molds and methods may be implemented to form the groove material in any of the various configurations discussed above.

Figure 39:
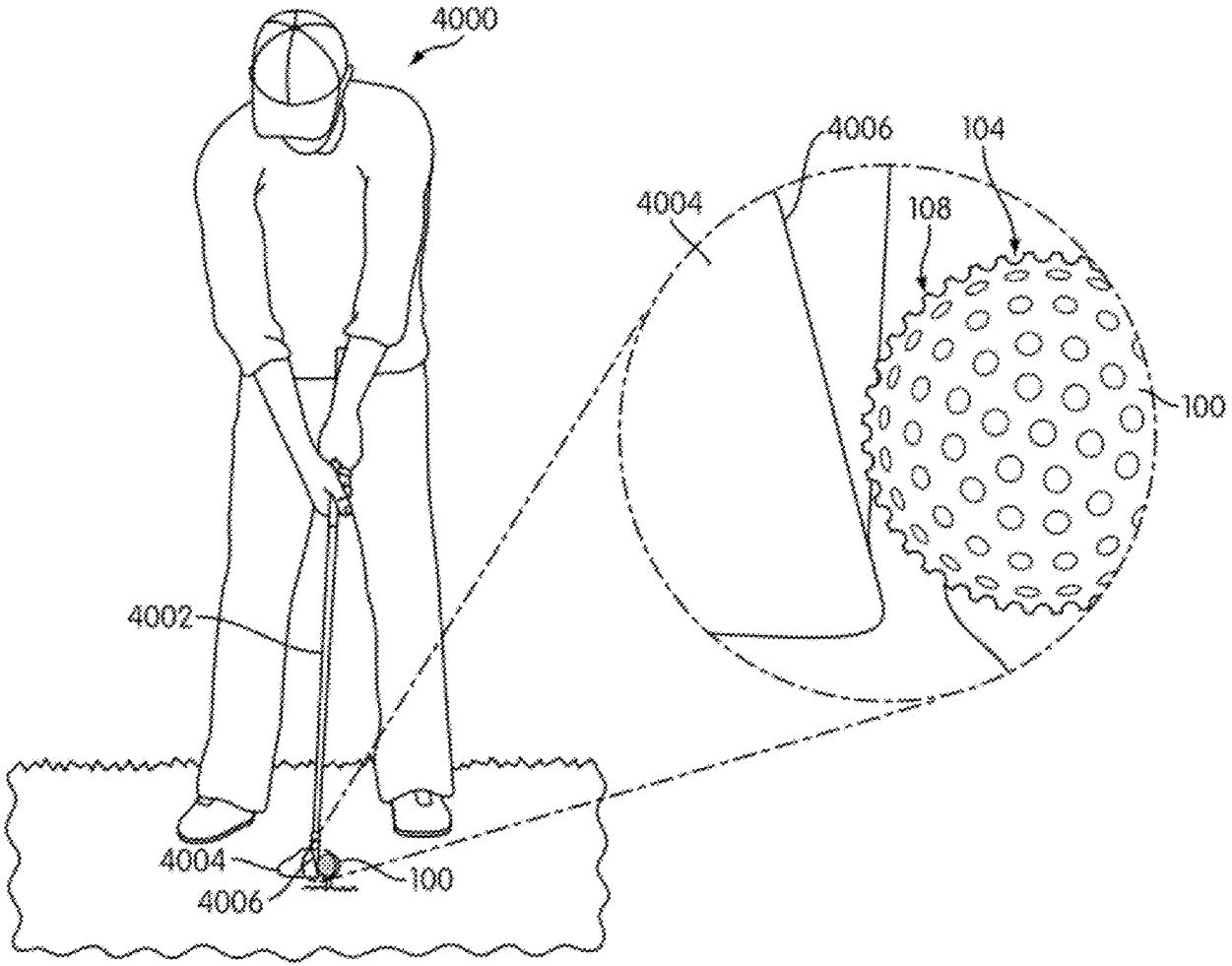
FIG. 39 shows a golfer about to hit a golf ball with a driver, and a detailed view of the golf ball prior to being hit by the driver.
Figure 40:
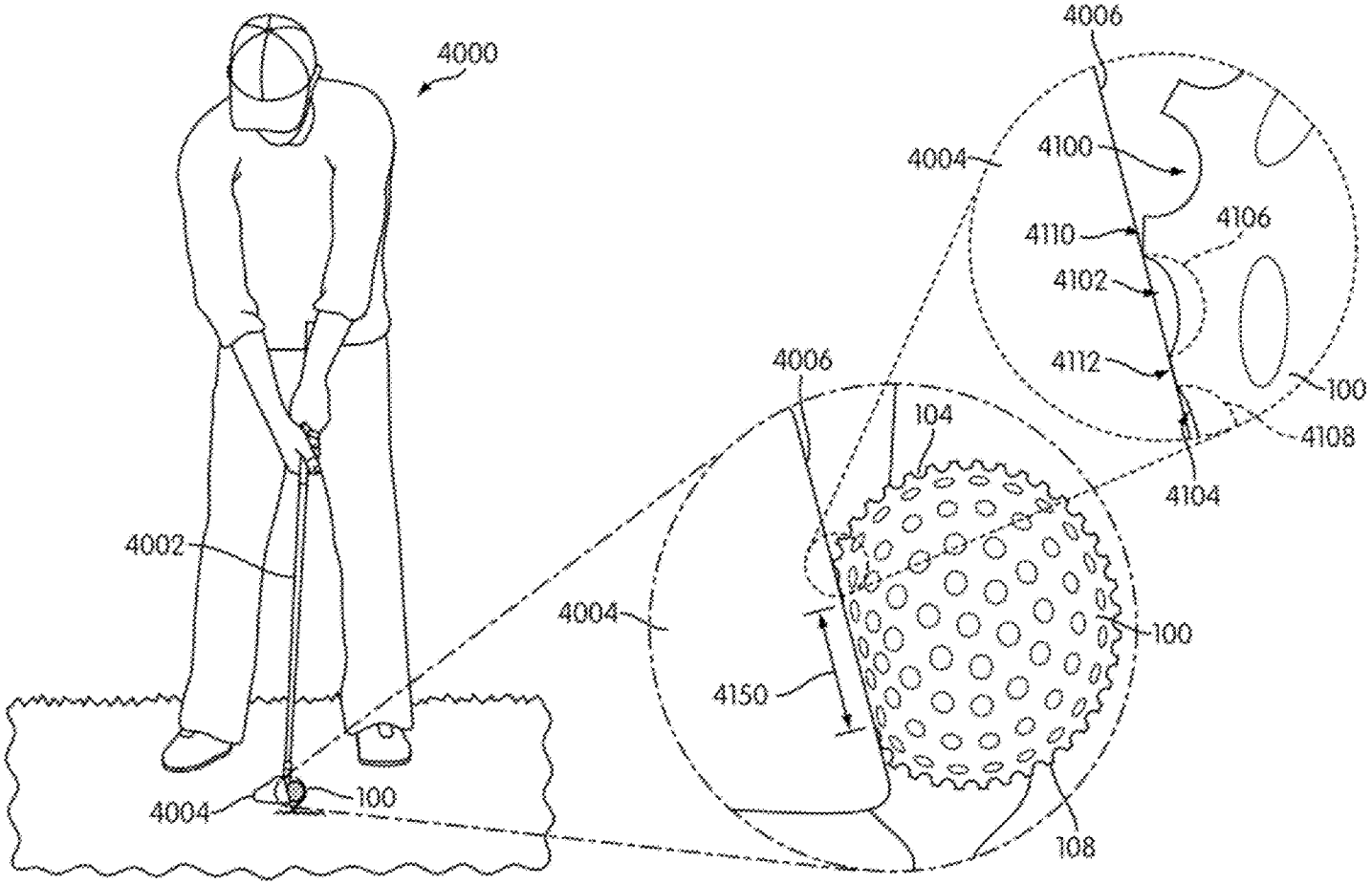
FIG. 40 shows the golfer hitting a golf ball with a driver, and two detailed views of the golf ball as it is being hit by the driver.
Figure 41:
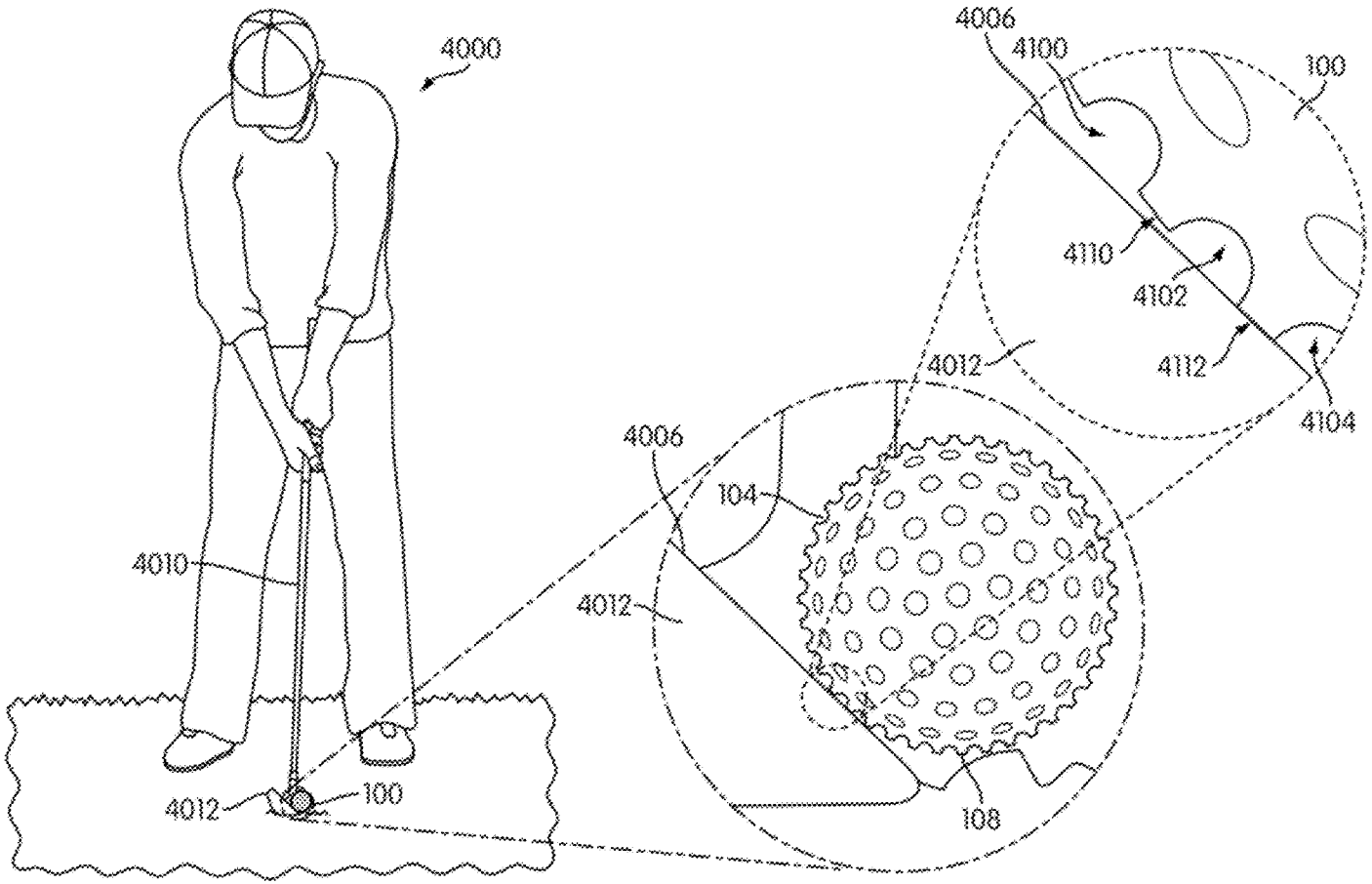
FIG. 41 shows the golfer hitting a golf ball with a iron, and two detailed views of the golf ball as it is being hit by the iron.

Although not wishing to be bound by any particular theory of action, it is believed that golf balls according to the present disclosure achieve superior play characteristics due to the interaction between a golf club face and the golf ball as is shown in FIGS. 39-41. Although these figures show embodiments of a golf ball where different materials correspond to the dimples and land respectively, it is believed that similar mechanisms apply to golf balls having different materials as the cover and in various grooves (as such mechanisms of action were discussed above).

In FIG. 39, a golfer 4000 swings a golf club 4002 toward golf ball 100. It is noted that golf ball 100 is referenced here, however the same results are achieved by any particular golf ball disclosed herein. The golf club 4002 is a driver, having a large club head 4004, and a club face 4006 that is wide and has a low loft angle. As seen in the zoomed-in section of FIG. 15, the golf ball 100 includes dimples 104 and land area 108 (as in FIG. 1 and others).

In FIG. 40, the club face 4006 strikes the golf ball 100 with a large amount of force, in accordance with a drive. The golf ball 100 therefore deforms, as is shown in the first zoom-in section. Specifically, the golf ball 100 deforms such that a first area 4150 of the golf ball cover layer is flat against the club face 4006. In first area 4150, the club face 4006 impacts both the land areas and the dimples, compressing them against core 202 (and any inner layers). In this first area 4150 where both the hard dimples 104 and the soft land 108 are flat against the club face, the cover layer "appears" to have a hardness that is between the hardness of the dimples and the hardness of the land (depending on the ratio of each). By "appears" is meant: how the club face 4006 interfaces with the cover layer in this area.

In particular, as seen in the second zoomed-in section of FIG. 40, at the periphery of first area 4150, the club face impacts the land while impacting the dimples to varying degrees. Specifically, first dimple 4100 is not impacted at all, while first land area 4110 is impacted to a slight degree. Second dimple 4102 is impacted only slightly, as shown by the difference between the present shape of dimple 4102 and the original shape denoted by outline 4106, because the first land 4110 and second land 4112 are partially but not entirely compressed. Similarly, third dimple 4104 is also impacted somewhat but not entirely, as shown by outline 4108. Therefore, during a golf shot involving a high degree of force (such as a drive), the golf ball 100 undergoes compression such that the club face touches at least some of the relatively hard surfaces of the dimples.

FIG. 41 shows a different type of golf shot in action. In FIG. 41 the golf club 4010 is, for example, an iron. Club head 4012 on iron 4010 has a higher loft angle, as seen by the angle of the club face 4006 in the first zoomed-in section of FIG. 41. In this scenario, the golf ball is hit with less force than in FIG. 40. Therefore, golf ball 100 does not compress against club face 4006 so as to deform the dimples, as shown in the first zoomed-in section of FIG. 41. FIG. 41 shows a periphery of the deformed second area 4160, where club face 4006 again impacts first land 4110 and second land 4112, but in this case does not deform first dimple 4100, second dimple 4102, or third dimple 4104. Therefore, the apparent hardness of the cover layer is lower, as compared to the apparent hardness of the cover layer under compression shown in FIG. 40, because the club face 4006 only touches relatively soft land areas 108 without also touching the relatively hard surfaces of dimples 104.

Thus, the present golf ball appears to be softer when hit with less force, but harder when hit with more force. Thereby, the present golf ball achieves improved play characteristics associated with harder cover layers (such as longer distance) during drives, while also achieving improved play characteristics associated with softer cover layers (such as higher spin) during short shots. Furthermore, golf balls made in accordance with this disclosure may also simultaneously achieve improved play characteristics that are unrelated to the hardness.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising: a core; and a cover layer, the cover layer substantially surrounding the core and including a plurality of dimples and at least one land area separating the dimples; wherein the cover layer includes a first portion of a material comprising a polyurethane, the first portion of the cover layer having a first hardness, and a second portion of a material comprising an ionomer, the second portion of the cover layer having a second hardness different from the first hardness; the first portion and the second portion being laterally adjacent to each other within the cover layer; and wherein at least one of the first and the second portion comprises at least an entire lateral width of at least one dimple and the other of the first portion and the second portion comprises at least a part of the at least one land area.

2. The golf ball according to claim 1, wherein the first portion of the cover layer includes the at least an entire lateral width of at least one dimple thereon, and the second portion of the cover layer includes the at least a part of the at least one land area thereon.

3. The golf ball according to claim 2, wherein the second portion of the cover layer includes the entirety of all of the land area(s) thereon.

4. The golf ball according to claim 2, wherein the first portion of the cover layer includes an entire lateral width of a subset of fewer than all of the plurality of dimples thereon, and the second portion of the cover layer includes less than the entirety of all of the land area(s) thereon.

5. The golf ball according to claim 1, wherein the first portion of the cover layer extends from an outer surface of the cover layer to an intermediate point between the outer surface of the cover layer and an inner surface of the cover layer.

6. The golf ball according to claim 1, wherein the first portion of the cover layer extends from an outer surface of the cover layer to an inner surface of the cover layer.

7. The golf ball according to claim 1, wherein the first portion of the cover layer includes at least a part of the at least one land area thereon, and the second portion of the cover layer includes the at least the entire lateral width of at least one dimple thereon.

8. The golf ball according to claim 1, wherein the second hardness is at least about 5 Shore D harder than the first hardness.

9. The golf ball according to claim 1, wherein the first portion includes all of the dimples and the second portion includes all of the land area of the cover layer.

10. A golf ball comprising: a core; and a cover layer substantially surrounding the core, the cover layer being formed of a first material having a first hardness, and the cover layer having a plurality of dimples and at least one land area thereon; the plurality of dimples being arranged on the cover layer in a first pattern; the at least one land area being arranged on the cover layer in a second pattern, the first pattern and the second pattern being non-overlapping patterns; wherein the cover layer is coated with a second material having a second hardness different from the first hardness, such that the coating material coats at least a portion of one of the first pattern and the second pattern but substantially does not coat the other of the first pattern and the second pattern; the first material comprises a member selected from the group consisting of: an ionomer material, and a polyurethane material; the second material comprises a member selected from the group consisting of: an ionomer and a polyurethane material; and the second material is different from the first material;

wherein an entire lateral width of at least one dimple is one of the first material and the second material and the at least one land area is the other of the first material and the second material.

11. The golf ball of claim 10, wherein the first material is an ionomer material, and the second material is a polyurethane material.

12. The golf ball of claim 11, wherein the second material overlaps at least a portion of the first pattern but does not substantially overlap the second pattern, and the second hardness is less than the first hardness.

13. The golf ball of claim 12, wherein the second material overlaps substantially all of the first pattern.

14. The golf ball of claim 10, wherein the first material is a polyurethane material, and the second material is an ionomer material.

15. The golf ball of claim 14, wherein the second material overlaps at least a portion of the second pattern but does not substantially overlap the first pattern, and the second hardness is greater than the first hardness.

16. The golf ball of claim 15, wherein the second material overlaps substantially all of the second pattern.

17. The golf ball of claim 10, wherein a surface of the cover layer corresponding to one of the first pattern and the second pattern includes pockets in the surface of the cover layer, and the second material is coated on the same one of the first pattern and the second pattern such that the second material fills the pockets.

* * * * *